US012637798B2

(12) United States Patent
Shin et al.

(10) Patent No.: US 12,637,798 B2
(45) Date of Patent: May 26, 2026

(54) CLOTHES TREATMENT APPARATUS

(71) Applicant: LG Electronics Inc., Seoul (KR)

(72) Inventors: Joongil Shin, Seoul (KR); Kyuchul Lee, Seoul (KR); Hyunseung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 313 days.

(21) Appl. No.: 18/575,138

(22) PCT Filed: Jun. 17, 2022

(86) PCT No.: PCT/KR2022/008621
§ 371 (c)(1),
(2) Date: Dec. 28, 2023

(87) PCT Pub. No.: WO2023/277418
PCT Pub. Date: Jan. 5, 2023

(65) Prior Publication Data

US 2024/0337062 A1 Oct. 10, 2024

(30) Foreign Application Priority Data

Jun. 28, 2021 (KR) ..... 10-2021-0083907

(51) Int. Cl.
*D06F 34/34* (2020.01)
*D06F 34/08* (2020.01)
(Continued)

(52) U.S. Cl.
CPC ..... *D06F 34/34* (2020.02); *D06F 34/08* (2020.02); *D06F 34/30* (2020.02); *D06F 34/32* (2020.02)

(58) Field of Classification Search
None
See application file for complete search history.

(56) References Cited

U.S. PATENT DOCUMENTS

| | | | | |
|---|---|---|---|---|
| 9,428,855 | B2 * | 8/2016 | Park | D06F 34/34 |
| 2020/0018004 | A1 | 1/2020 | Leisl, III et al. | |
| 2020/0257385 | A1 | 8/2020 | Hartmann et al. | |

FOREIGN PATENT DOCUMENTS

| | | |
|---|---|---|
| CN | 207047541 | 2/2018 |
| CN | 111691125 | 9/2020 |

(Continued)

OTHER PUBLICATIONS

Office Action in Korean Appln. No. 10-2021-0083907, mailed on Aug. 20, 2024, 12 pages (with English translation).

(Continued)

*Primary Examiner* — Rita P Adhlakha
(74) *Attorney, Agent, or Firm* — Fish & Richardson P.C.

(57) ABSTRACT

The present application relates to a clothes treatment apparatus comprising: a cabinet including a panel input hole and a mounting panel, which has a panel-mounting hole; a drum which is rotatably provided in the cabinet to accommodate clothes, and has a drum input hole communicating with the panel input hole; a control circuit board positioned in the cabinet; and a window having a window body positioned in the panel-mounting hole, a film sensor provided on the window body so as to sense whether the body of a user comes in contact with the window body, and a film wire for connecting the film sensor and the control circuit board, wherein the window includes a window guide, which protrudes from a transparent member toward the control circuit board so as to prevent the film wire from coming in contact with the mounting panel.

20 Claims, 30 Drawing Sheets

(51) Int. Cl.
*D06F 34/30* (2020.01)
*D06F 34/32* (2020.01)

(56) References Cited

FOREIGN PATENT DOCUMENTS

| | | | |
|---|---|---|---|
| EP | 2644765 | A2 | 10/2013 |
| JP | 2009-182002 | A | 8/2009 |
| JP | 2018-130557 | | 8/2018 |
| KR | 10-2007-0080071 | | 8/2007 |
| KR | 10-2018-0068628 | A | 6/2018 |
| KR | 20-2019-0000990 | | 4/2019 |

OTHER PUBLICATIONS

Extended European Search Report in European Appln. No. 22833474.4, mailed on Jun. 3, 2025, 7 pages.
Office Action in Korean Appln. No. 10-2021-0083907, mailed on Apr. 28, 2025, 12 pages (with English translation).
International Search Report and Written Opinion in Appln. No. PCT/KR2022/008621, mailed on Oct. 13, 2022, 18 pages (with English translation).

* cited by examiner

16

CLOTHES TREATMENT APPARATUS

CROSS-REFERENCE TO RELATED APPLICATIONS

This application is a National Stage application under 35 U.S.C. § 371 of International Application No. PCT/KR2022/008621, filed on Jun. 17, 2022, which claims the benefit of Korean Patent Application No. 10-2021-0083907, filed on Jun. 28, 2021. This disclosure of the prior application is considered part of and is incorporated by reference in the disclosure of this application.

TECHNICAL FIELD

The present application relates to a laundry treatment apparatus.

BACKGROUND

A laundry treatment apparatus may include any device capable of performing clothing treatment, such as washing, drying, or caring for the fabrics of clothing. Among laundry treatment apparatuses, a washing machine represents a device that removes contaminants from laundry by the action of detergent and water.

Washing machines may be categorized into agitation, vortex, and drum type washing machines according to the washing method. The agitation type machine washes clothing by rotating a washing rod protruding upward from the center of the tub from side to side. The vortex type washing machine washes laundry using friction between the water current and the laundry caused by rotating a disk-shaped pulsator provided in the lower part of the tub. The drum type washing machine washes laundry by placing water, detergent, and laundry in a drum having a number of lifters, which protrude from the inner surface of the drum, and rotating the drum.

There is a drum type washing machine (Korean Patent Application Publication No. 10-2005-0117737) among the conventional laundry treatment apparatuses. It includes a housing defining an exterior, and a front panel defining the front of the housing. It also includes an operation panel having an operation part arranged on an upper side of the front panel, wherein the operation panel is arranged separated from the front panel and is coupled to the upper side of the front panel. In other words, the front panel and the operation panel may be manufactured as separate components, and the front panel may be coupled to the operation panel that has been connected, or the operation panel may be coupled to the housing in which the front panel is disposed.

Another conventional laundry treatment apparatus is provided with an input/output device (interface) for a user to input control instructions to an electronic device (Korean Patent Application Publication No. 10-2014-0023986). Interfaces provided in the conventional laundry treatment apparatus include a display part configured to display control instructions selectable by the user, a search part configured for the user to search control instructions displayed on the display part, a selector allowing the user to select a control instruction displayed on the display part, and an input unit configured to request execution of the control instruction selected by the user. These interfaces are designed to be disposed in spaces separated from each other.

SUMMARY

An object of the present disclosure devised to solve the above-described problems is to provide a laundry treatment apparatus in which an operation indicator allowing a user to input a control instruction or configured to indicate an operation instruction to the user is directly installed on a mounting panel.

Another object of the present disclosure is to provide a laundry treatment apparatus capable of preventing foreign substances from infiltrating into a space between a panel installation hole formed through the mounting panel and a window of the operation indicator coupled to the panel installation hole.

Another object of the present disclosure is to provide a laundry treatment apparatus capable of preventing a film from being separated from a peripheral portion of the panel installation hole in forming the panel installation hole through a mounting panel coated with the film.

Another object of the present disclosure is to provide a laundry treatment apparatus including a couple structure capable of coupling a board support supporting a control circuit board in an operation indicator directly to a mounting panel.

Another object of the present disclosure is to provide a laundry treatment apparatus capable of simplifying the assembly structure for coupling a board support to a mounting panel.

Another object of the present disclosure is to provide a laundry treatment apparatus having a window that includes a structure capable of preventing a touch film fixed to the window and configured to recognize a touch signal from a user from contacting the mounting panel in order to prevent an electrical signal from being disturbed.

Another object of the present disclosure is to provide a laundry treatment apparatus including a structure capable of preventing a film wire connected to a control circuit board in a touch film fixed to a window from being damaged by a board support coupled to a mounting panel.

Another object of the present disclosure is to provide a laundry treatment apparatus having an interface in which display of control instructions, search or change of displayed control instructions, and selection of the displayed control instructions are integrated into one device.

The objects of the present disclosure can be achieved by providing a laundry treating apparatus including a cabinet provided with a mounting panel having a panel installation hole, a control circuit board positioned in the cabinet, and a window including a window body positioned in the panel installation hole, a film sensor provided on the window body, and a film wire connecting the film sensor and the control circuit board, wherein the window includes a window guide that prevents the film wire from contacting the mounting panel.

According to an embodiment of the present disclosure, the laundry treatment apparatus may include a cabinet including a mounting panel, the mounting panel being provided with a panel inlet and a panel installation hole, a drum rotatably arranged inside the cabinet to accommodate laundry, the drum having a drum inlet communicating with the panel inlet, a control circuit board disposed inside the cabinet, and a window including a window body disposed in the panel installation hole, a film sensor provided to the window body to sense whether a body of a user contacts the window body, and a film wire connecting the film sensor and the control circuit board, wherein the window comprises a window guide protruding from the light transmitting member toward the control circuit board to prevent the film wire from contacting the mounting panel.

The window guide may be disposed between the film wire and the mounting panel.

The mounting panel may include a coupling rib extending from an edge of the panel installation hole toward a position of the control circuit board to support the window body, wherein the window guide may be arranged to overlap the coupling rib in a height direction.

The window guide may be disposed between the coupling rib and the film wire.

The window may further include a window coupling portion extending from the window body toward the position of the control circuit board to couple the window body to the coupling rib, wherein an extension length of the window guide may be less than or equal to an extension length of the window coupling portion.

A free end of the window guide may be disposed farther from the control circuit board than a free end of the coupling rib.

The window guide may be spaced apart from the coupling rib.

One surface of the window guide facing the coupling rib may extend from the window body to be inclined upward toward the control circuit board.

A distance between the window guide and the coupling rib may increase as a distance from the window body increases.

The window may further include an outer extension extending from an edge of the window body and disposed outside the cabinet, and an inner extension extending from the edge of the window body and disposed inside the cabinet.

The inner extension may extend upward from a top surface of the window body, wherein the window guide may protrude toward the control circuit board from a surface of the window body facing a position of the control circuit board.

The window guide may be arranged on a lower side the window body.

The laundry treatment apparatus may further include a board support including an installation body disposed between the window body and the control circuit board, a wire passage provided to allow the film wire to be connected to the control circuit board by extending through the installation body.

The window guide may protrude from one surface of the window body facing the wire passage toward the wire passage.

The film sensor may be fixed to a surface of the window body facing a position of the control circuit board.

The cabinet further may include a panel through-hole formed through the mounting panel in a penetrating manner. The laundry treatment apparatus may further include a first circuit board disposed inside the cabinet, an encoder including a fixed part fixed to the first circuit board, a rotary part rotatably coupled to the fixed part, and a signal generator configured to generate an electrical signal when the rotary part rotates, an actuator including a shaft inserted into the panel through-hole and coupled to the rotary part, a shaft through-hole formed through the shaft in a penetrating manner to receive the rotary part inserted thereinto, a handle fixed to the shaft so as to be positioned on an outside of the cabinet and configured to receive an input of force necessary for rotation of the shaft, an accommodation space provided inside the handle and communicating with the shaft through-hole, and a handle through-hole formed through one surface of the handle to allow the accommodation space to communicate with an outside therethrough, and a display part including a fastening body inserted into the shaft through-hole and fixed to the fixed part, an accommodation body fixed to the fastening body and disposed inside the accommodation space, and a display fixed to the accommodation body to face the handle through-hole and configured to display information.

The display may be configured to display preset information according to the electrical signal generated by the signal generator.

The present disclosure may provide a laundry treatment apparatus in which an operation indicator that allows a user to input a control instruction to a washing machine or displays operation instructions for the user is directly installed on a mounting panel.

Further, the present disclosure may provide a laundry treatment apparatus capable of preventing foreign substances from infiltrating into a space between a panel installation hole formed through a mounting panel and a window of an operation indicator coupled to the panel installation hole.

Further, the present disclosure may provide a laundry treatment apparatus capable of preventing a film from being separated from a peripheral portion of the panel installation hole in forming the panel installation hole through a mounting panel coated with the film.

Further, the present disclosure may provide a laundry treatment apparatus including a coupling structure capable of coupling a board support member supporting a control circuit board in an operation indicator directly to a mounting panel.

Further, the present disclosure may provide a laundry treatment apparatus capable of simplifying the assembly structure for coupling a board support member to a mounting panel.

Further, the present disclosure may provide a laundry treatment apparatus having a window that includes a structure capable of preventing a touch film fixed to the window and configured to recognize a touch signal from a user from contacting the mounting panel in order to prevent an electrical signal from being disturbed.

Further, the present disclosure may provide a laundry treatment apparatus including a structure capable of preventing a film wire connected to a control circuit board in a touch film fixed to a window from being damaged by a board support coupled to a mounting panel.

Further, the present disclosure may provide a laundry treatment apparatus having an interface in which display of control instructions, search or change of displayed control instructions, and selection of the displayed control instructions are integrated into one device.

DETAILED DESCRIPTION

Hereinafter, a preferred embodiment of a laundry treatment apparatus will be described in detail with reference to the accompanying drawings.

Figure 1:
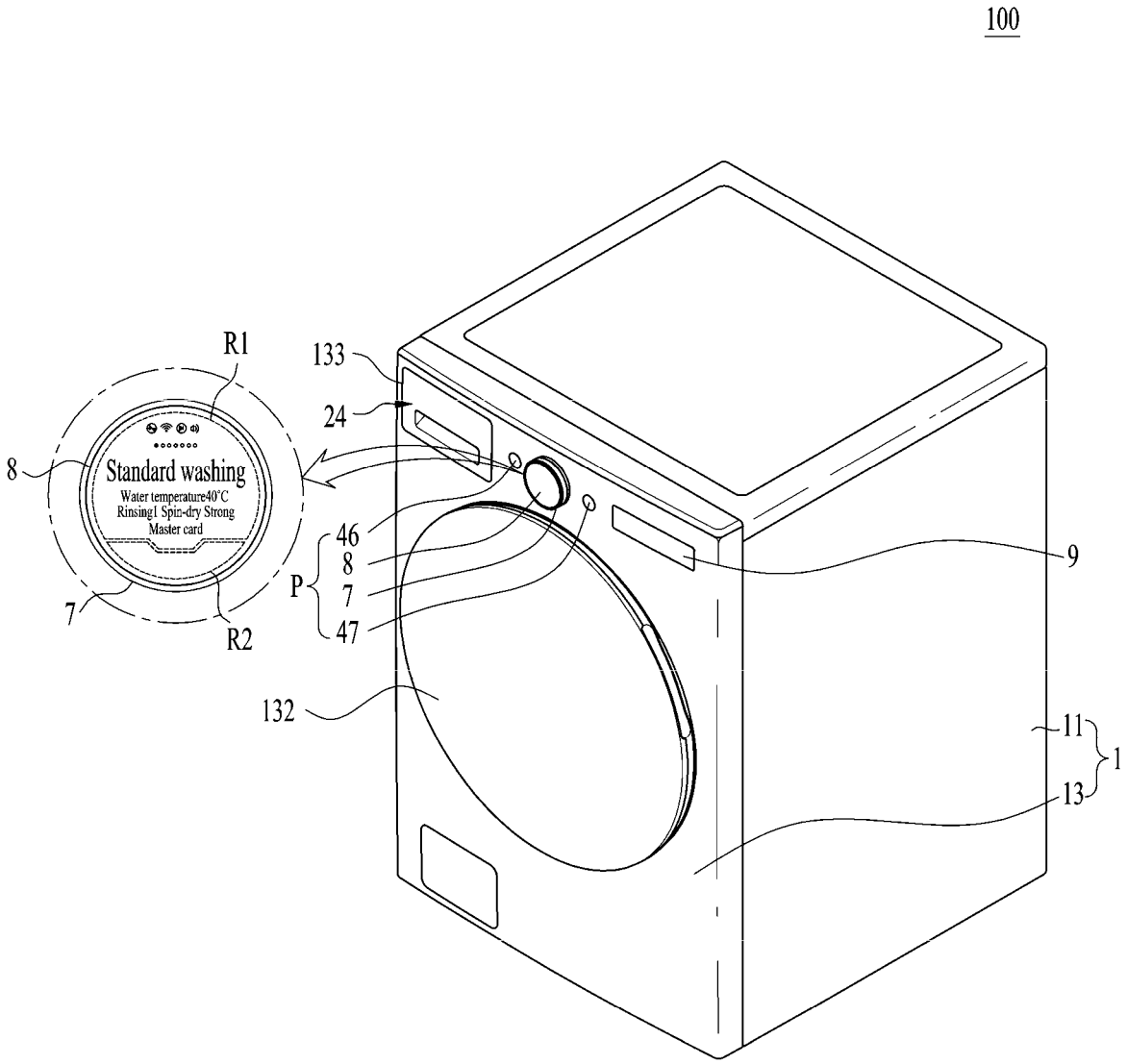
FIGS. 1 and 2 illustrate an interface and an example of a laundry treatment apparatus having the interface.

As shown in FIG. 1, a laundry treatment apparatus 100 may include a cabinet 1, and an operation indicator 9 provided in the cabinet 1. The operation indicator 9 described in the present disclosure may refer to a device or program that enables communication between a user and the laundry treatment apparatus (including other electronic devices). Communication between the user and the laundry treatment apparatus refers to the process of the user inputting control instructions to the laundry treatment apparatus, and the process of the laundry treatment apparatus delivering information to the user.

The user may input control instructions to the laundry treatment apparatus via the operation indicator 9. Further, the operation indicator 9 may output information about the laundry treatment apparatus to the user. As an example, when the laundry treatment apparatus is a washing machine, a specific control instruction may be selecting a course or an option. A selectable course may refer to a duvet, normal, standard, or rapid mode. Also, selectable options may include the amount of washing water, a dewatering time, and the number of rinses.

Further, examples of information output via the operation indicator 9 may include the remaining time and the type of the option being operated. The examples above are merely illustrative, and any component that allows the user to provide input and provides output to the user may correspond to the operation indicator 9.

The operation indicator 9 may perform the function of a main input/output unit in the laundry treatment apparatus 100, but is not limited thereto. It may also perform the function of a sub-input/output unit that assists the function of an interface P, which will be described later. That is, the interface P may perform basic course selection and information display, and the operation indicator 9 may select and indicate contents related to options.

Further, the laundry treatment apparatus 100 may include the interface P provided in the cabinet 1. The interface P described in the present disclosure refers to a device or program that enables communication between a user and the laundry treatment apparatus (including other electronic devices). The communication between the user and the laundry treatment apparatus refers to the operation of the user inputting control instructions to the laundry treatment apparatus and the operation of the laundry treatment apparatus delivering information to the user.

The interface P may be configured to communicate with the operation indicator 9. The interface P may control the laundry treatment apparatus 100 by receiving input information from the operation indicator 9. Conversely, the operation indicator 9 may receive information input to the interface P and control the laundry treatment apparatus 100.

The cabinet 1 may include a cabinet body 11 having one open side, and a panel (or mounting panel) 13 fixed to the open side of the cabinet body. FIG. 1 illustrates a case where the mounting panel 13 is fixed to the front side of the cabinet body 11 to define the front face of the laundry treatment apparatus.

Figure 2:
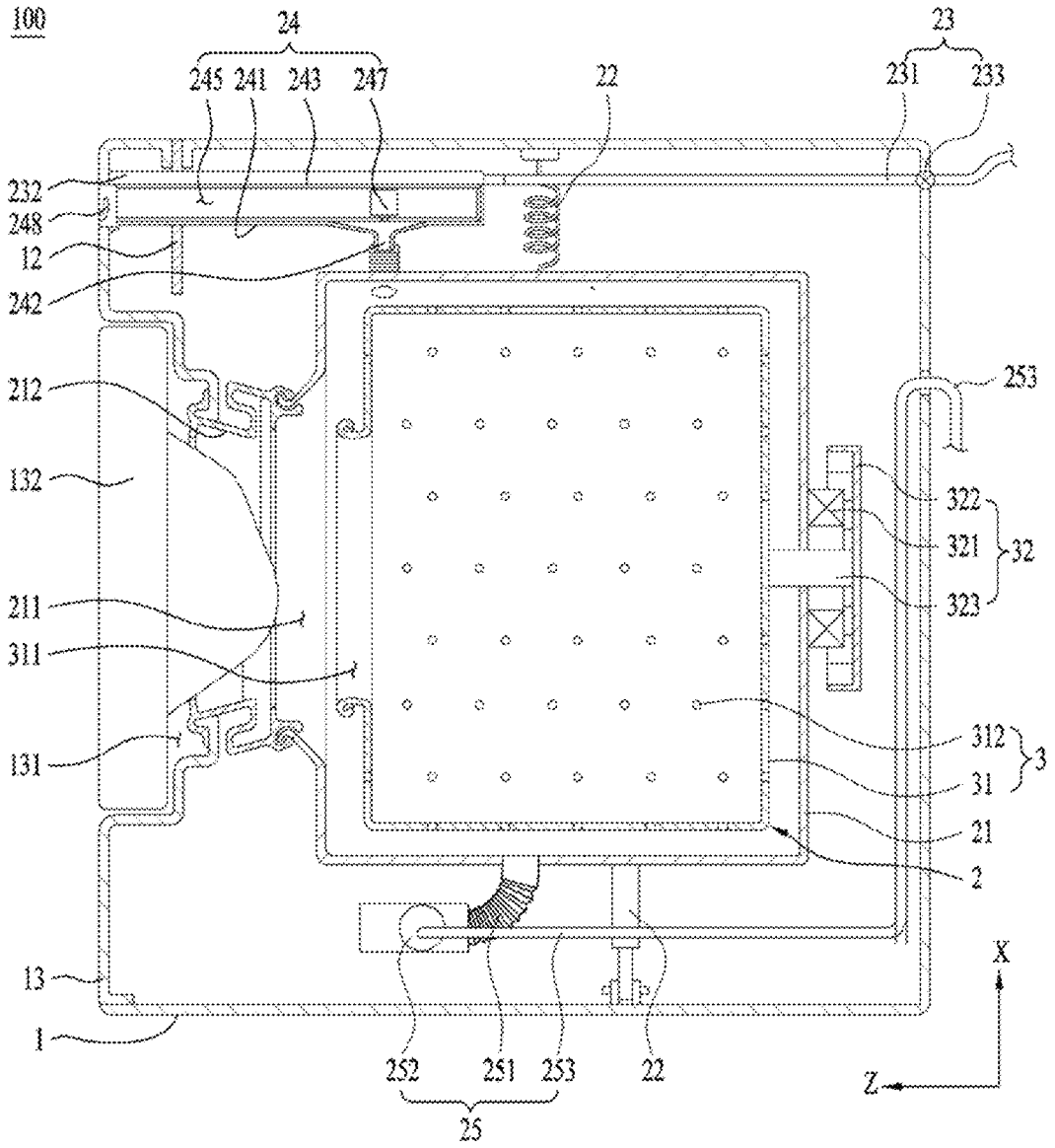

As shown in FIG. 2, the mounting panel 13 is provided with a panel inlet 131 allowing the interior and exterior of the cabinet 1 to communicate with each other. The panel inlet 131 is arranged to be closed by a door 132 rotatably fixed to the cabinet 1.

A tub 2 providing a space to store water and a drum 3 rotatably disposed inside the tub to provide a space to accommodate clothing (collectively referred to as laundry objects) are arranged inside the cabinet 1.

The tub 2 may include a tub body 21 having the shape of a hollow cylinder. The tub body 21 may be fixed inside the cabinet 1 by a tub support 22. FIG. 2 illustrates a case where the tub support 22 includes a spring (connecting the upper space of the tub body to the cabinet) and a damper (connecting the lower space of the tub body to the cabinet).

A tub inlet 211 is provided on a side of the space in the tub body 21 that faces the panel inlet 131. The panel inlet 131 and the tub inlet 211 are connected through a gasket 212. The gasket 212 is provided as an elastic member such as rubber. It is a means to prevent water inside the tub body 21 from being discharged into the cabinet 1 and to minimize transmission of vibration of the tub body 21 to the cabinet 1.

The tub body 21 is supplied with water via a water supply part 23, and water stored in the tub body 21 may be discharged from the cabinet 1 through a drainage part 25.

The drainage part 25 may include a pump 252 disposed at a position lower than that of the tub body 21, a first drainage pipe 251 connecting the tub body 21 to the pump 252, and a second drainage pipe 253 directing water discharged from the pump 252 to the outside of the cabinet.

The water supply part 23 may include a water supply pipe 231 connecting the tub body 21 to a water source located outside of the cabinet, and a water supply valve 233 configured to control opening and closing of the water supply pipe 231.

As shown in the figure, the laundry treatment apparatus 100 may further include a detergent supply part 24.

Figure 3:
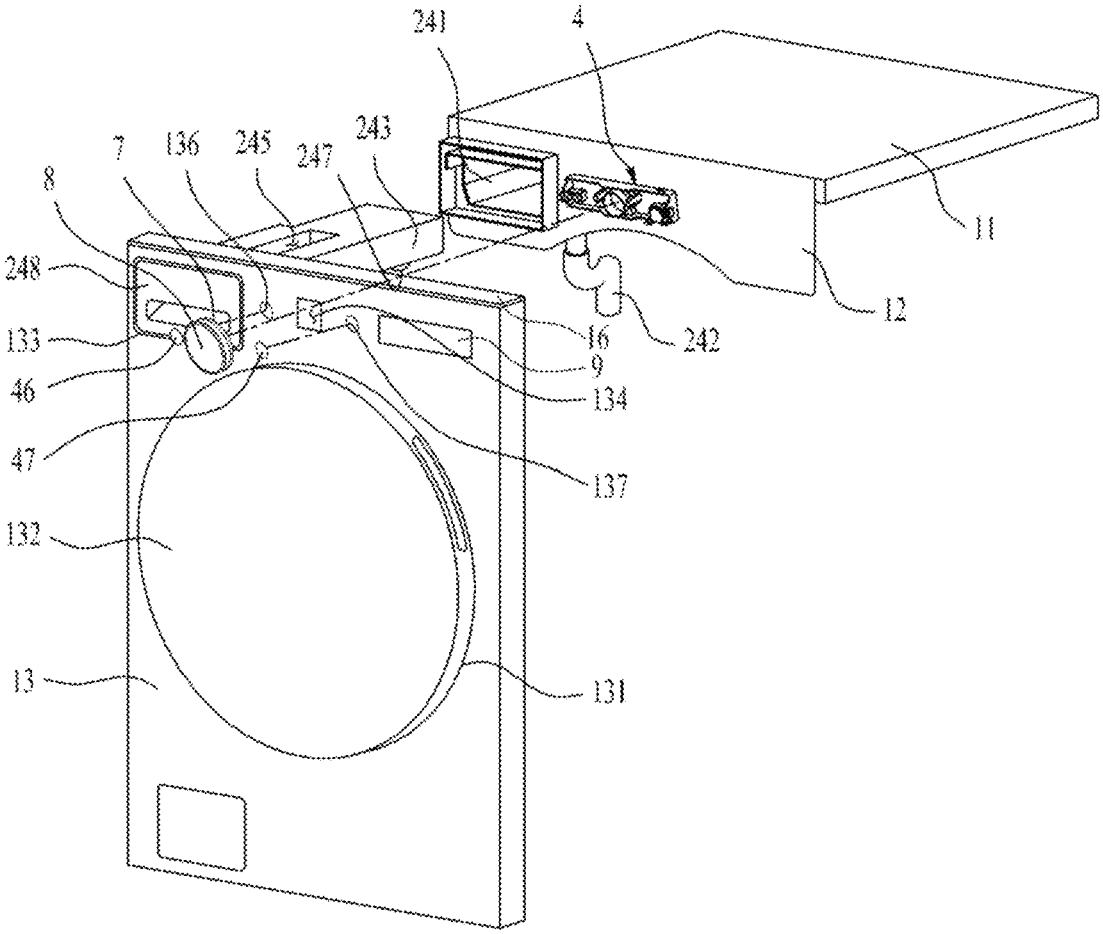
FIGS. 3 and 4 illustrate an example of a coupling structure of a cabinet and an interface.

As shown in FIG. 3, the detergent supply part 24 may include a drawer housing 241 arranged inside the cabinet 1, a connection pipe 242 connecting the drawer housing to the tub body 21, and a drawer 243 withdrawable from the drawer housing 241 through a drawer inlet 133 provided in the mounting panel 13.

The drawer 243 may include a chamber 245 providing a space to store detergent, and a discharge channel 247 along which the detergent in the chamber is discharged to the drawer housing 241. The discharge channel 247 may be provided with a water trap (siphon channel, etc.) to move liquid into the drawer housing 241 when the level of liquid stored in the chamber 245 exceeds a preset level.

When the detergent supply part 24 is arranged in the laundry treatment apparatus 100, the water supply part 23 may further include a nozzle 232 through which water is supplied to the chamber 245. The nozzle 232 may be fixed to the cabinet 1 so as to define a top surface of the drawer housing 241, and the water supply pipe 231 may be arranged to connect the nozzle 232 to a water supply source.

The front surface of the drawer 243 may be provided with a drawer panel 248. The drawer panel 248 may be shaped to close the drawer inlet 133. Also, the drawer panel 248 may be provided with a drawer handle.

As shown in FIG. 2, the drum 3 may include a drum body 31 of a cylindrical shape disposed inside the tub body 21, and a drive part 32 configured to rotatably fix the drum body 31 to the tub body 21.

A drum inlet 311 is provided on a side of the space in the drum body 31 that faces the tub inlet 211. Thus, clothing may be introduced into the drum body 31 through the panel inlet 131, the tub inlet 211, and the drum inlet 311.

The drum body 31 is provided with drum through-holes 312 allowing the inside of the drum body to communicate with the outside therethrough. The drum through-holes 312 may be provided in a circumferential surface, a front surface (the surface surrounding the drum inlet), and a rear surface of the drum body 31, respectively. Thus, water or detergent supplied into the tub body 21 may be supplied into the drum body 31 through the drum through-holes 312.

The drive part 32 may include a stator 321 fixed to a rear surface of the tub body 21 and forming a rotating magnetic field, a rotor 322 rotated by the rotating magnetic field, and a rotation shaft 323 extending through the rear surface of the tub body 21 to connect the drum body 31 and the rotor 322.

Figure 4:
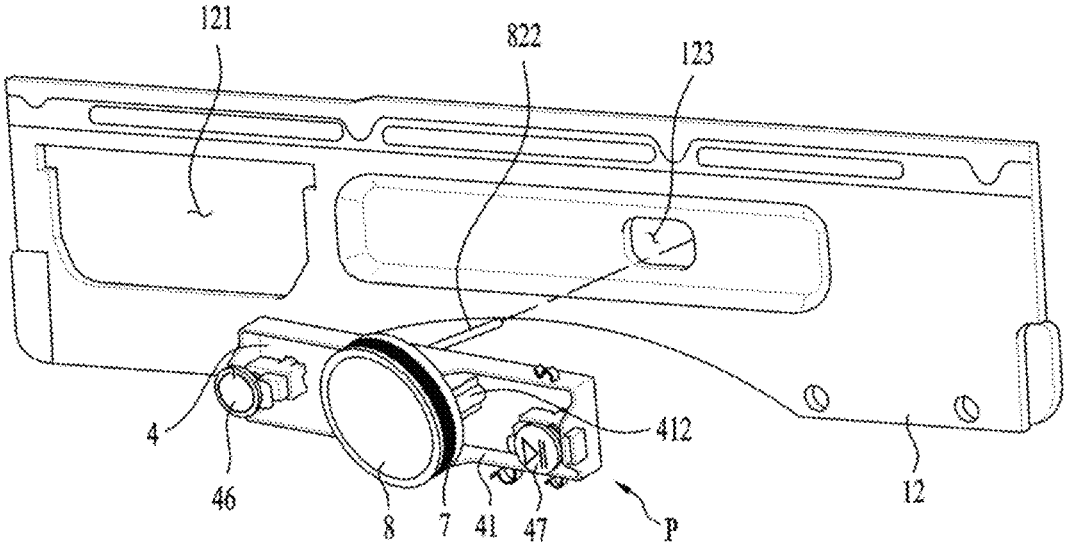

As shown in FIG. 3, the mounting panel 13 may be fixed to the cabinet body 11 by a panel support 12. That is, the panel support 12 may be fixed to the cabinet body 11, and the mounting panel 13 may be fixed to the panel support 12. In this case, as shown in FIG. 4, the panel support 12 may be provided with a drawer through-hole 121 through which the drawer 243 passes.

The interface P may be fixed in an interface mounting groove provided in the panel support 12, or may be fixed to the mounting panel 13 so as to be positioned in the interface mounting groove.

As shown in FIG. 1, the laundry treatment apparatus 100 may include the cabinet 1, and the operation indicator 9 provided in the cabinet 1. The operation indicator 9 described in the present disclosure may refer to a device or program that enables communication between a user and the laundry treatment apparatus (including other electronic devices). Communication between the user and the laundry treatment apparatus means the operation of the user inputting control instructions to the laundry treatment apparatus, and the operation of the laundry treatment apparatus delivering information to the user.

The user may input control instructions to the laundry treatment apparatus via the operation indicator 9. Further, the operation indicator 9 may output information about the laundry treatment apparatus to the user. As an example, when the laundry treatment apparatus is a washing machine, a specific control instruction may be selecting a course or an option. A selectable course may refer to a duvet, normal, standard, or rapid mode. Also, selectable options may include the amount of washing water, a dewatering time, and the number of rinses.

Further, examples of information output via the operation indicator 9 may include the remaining time and the type of the option being operated. The examples above are merely illustrative, and any component that allows the user to provide input and provides output to the user may correspond to the operation indicator 9.

The operation indicator 9 may perform the function of a main input/output unit in the laundry treatment apparatus 100, but is not limited thereto. It may also perform the function of a sub-input/output unit that assists the function of an interface P, which will be described later. That is, the interface P may perform basic course selection and information display, and the operation indicator 9 may select and indicate contents related to options.

Further, the laundry treatment apparatus 100 may include the interface P provided in the cabinet 1. The interface P described in the present disclosure refers to a device or program that enables communication between a user and the laundry treatment apparatus (including other electronic devices). The communication between the user and the laundry treatment apparatus refers to the operation of the user inputting control instructions to the laundry treatment apparatus and the operation of the laundry treatment apparatus delivering information to the user.

The interface P may be configured to communicate with the operation indicator 9. The interface P may control the laundry treatment apparatus 100 by receiving input information from the operation indicator 9. Conversely, the operation indicator 9 may receive information input to the interface P and control the laundry treatment apparatus 100.

The cabinet 1 may include a cabinet body 11 having one open side, and a panel (or mounting panel) 13 fixed to the open side of the cabinet body. FIG. 1 illustrates a case where the mounting panel 13 is fixed to the front side of the cabinet body 11 to define the front face of the laundry treatment apparatus.

As shown in FIG. 2, the mounting panel 13 is provided with a panel inlet 131 allowing the interior and exterior of the cabinet 1 to communicate with each other. The panel inlet 131 is arranged to be closed by a door 132 rotatably fixed to the cabinet 1.

A tub 2 providing a space to store water may be arranged inside the cabinet 1. A drum 3 rotatably disposed inside the tub to provide a space to accommodate clothing (collectively referred to as laundry objects) is provided.

Figure 5:
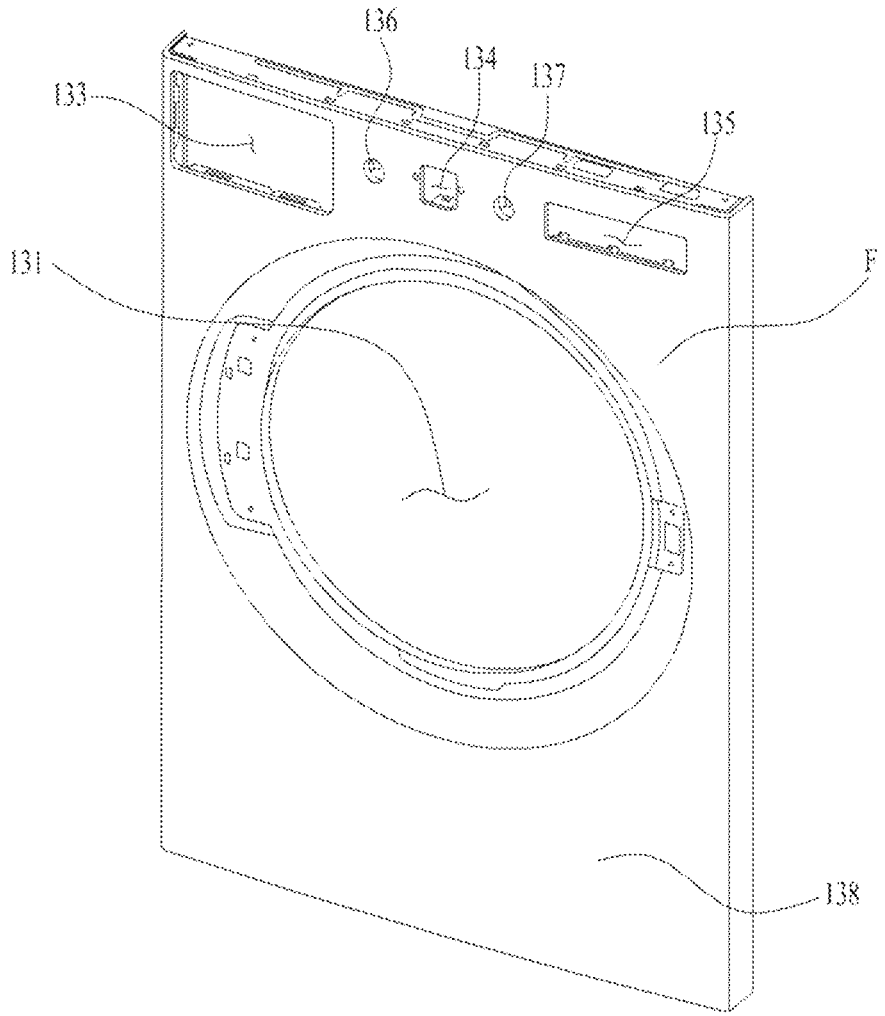
FIG. 5 shows an example of a mounting panel.

As shown in FIG. 5, the cabinet 1 may include multiple through-holes formed through the mounting panel 13 in a penetrating manner. The mounting panel 13 may include a mounting plate 138 defining the front face of the cabinet 1. Specifically, the multiple through-holes may be formed through the mounting plate 138 in a penetrating manner.

As described above, the cabinet 1 may include a panel inlet 131 and a drawer inlet 133. Further, the cabinet may include a first button mounting portion 136, a second button mounting portion 137, and a panel through-hole 134, which are formed through the mounting panel 13 in a penetrating manner.

A first button 461 and a second button 471 may be coupled to the first button mounting portion 136 and second button mounting portion 137, respectively, and be exposed to the user. Further, the interface P may be installed in the panel through-hole 134. Details of the first button mounting portion 136, the second button mounting portion 137, and the panel through-hole 134 will be described later.

In addition to the above-described through-holes (the first button mounting portion, second button mounting portion, and panel through-hole), the cabinet 1 may include a panel installation hole 135 formed through the mounting panel 13 in a penetrating manner. The above-described operation indicator 9 may be installed in the panel installation hole 135. Specifically, the operation indicator 9 may be installed in the panel installation hole 135 such that a portion of the operation indicator 9 is exposed to the user. The specific structure of the operation indicator 9 will be described later.

Further, the cabinet 1 may have a coating film fixed to a surface of the mounting panel 13 exposed to the outside of the cabinet 1. The "the surface exposed to the outside of the cabinet" may mean the surface defining the outer surface of the cabinet 1 before the components to be coupled to the panel inlet 131, drawer inlet 133, panel through-hole 134, and panel installation hole 135 are connected.

The mounting panel 13 may be manufactured by coating the outer surface with the coating film F first and then punching the above-described through-holes 131, 133, and 134 in the mounting panel 13. In other words, the through-holes 131, 133, and 134 provided in the mounting panel 13 may be punched inwardly in the mounting panel 13 to which the coating film F is attached.

In the process of forming the above-described through-holes 131, 133, and 134 in the mounting panel 13, some members of the mounting panel 13 may be curled into the through-holes 131, 133, and 134, and the exterior of the members of the mounting panel 13 that are curled inward may not be coated with the coating film.

The mounting panel 13 may be formed of a metal material, such as stainless steel. When the mounting panel is formed of a metal material, it may not be as easy to implement color on the outer side of the panel as when the panel is formed of a synthetic resin. Therefore, the coating film F may have a specific pattern or color to implement the color on the mounting panel 13. Thereby, the aesthetics of the laundry treatment apparatus 100 may be improved as a whole.

Further, the coating film F may protect the outer surface of the mounting panel 13. In the case where the mounting panel 13 is formed of a metal material, damage to the outer surface may raise issues such as corrosion or degraded aesthetics of of the mounting panel 13. The coating film F may prevent the mounting panel 13 from being damaged.

Figure 6:
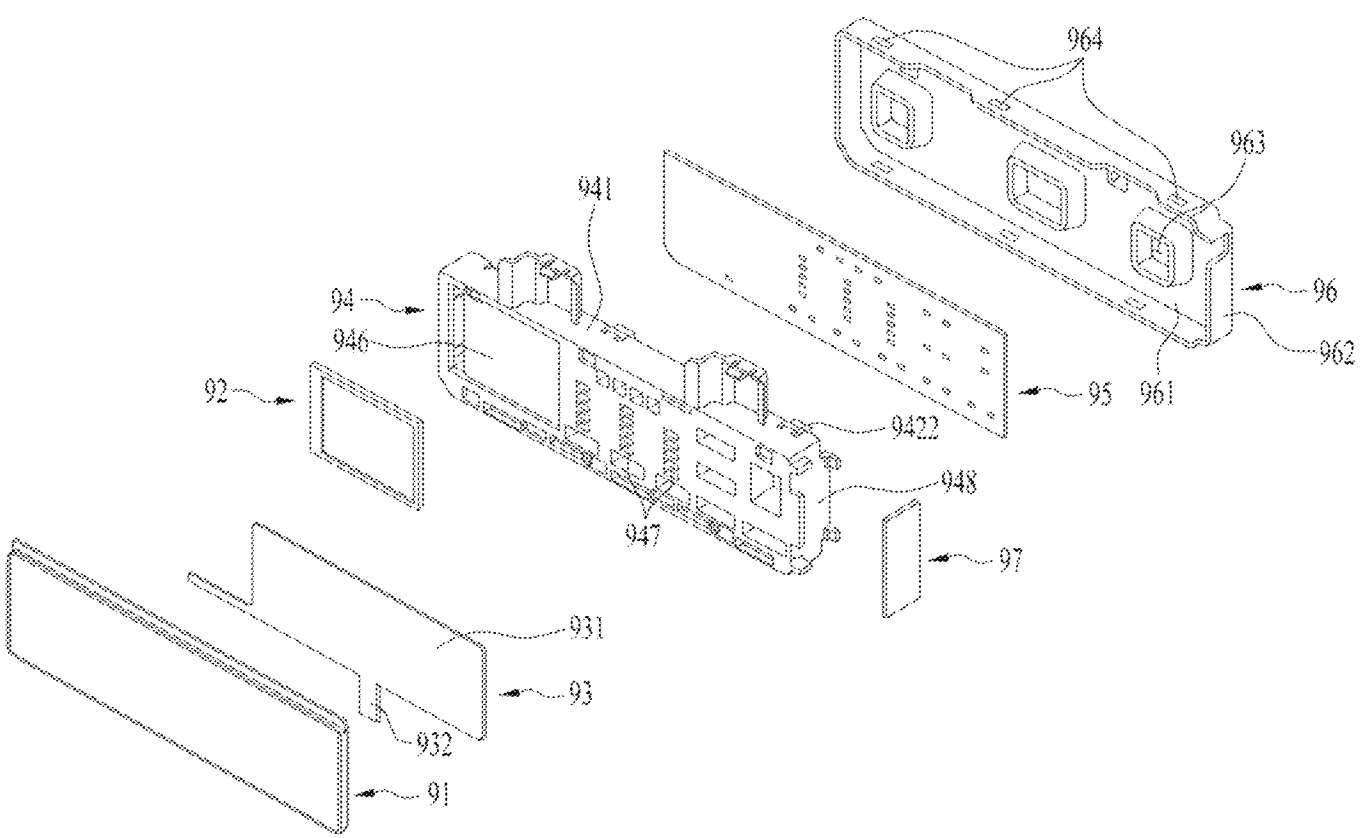
FIG. 6 is an exploded view of an example of an operation indicator.

FIG. 6 is an exploded perspective view of the above-described operation indicator 9.

The operation indicator 9 may include a window 91 coupled to the panel installation hole 135. The window 91 may be arranged to close the panel installation hole 135. The window 91 may prevent foreign substances from being introduced into the cabinet 1 through the panel installation hole 135.

Further, the window 91 may be formed of a light-transmitting material such that light emitted from the inside of the cabinet 1 may reach the user. Further, the window 91 may be coupled to the panel installation hole 135 and exposed to the outside of the cabinet 1. Thus, the user can check the interior of the cabinet 1 through the window 91.

Further, the window 91 may be positioned on the exterior of the cabinet 1 such that the user may contact the window. The user may input control instructions by touching the window 91 with a finger or other portion of the body.

In other words, the window 91 may constitute part of the input unit through which the user may input control instructions, and may constitute part of an output unit through which information output from the inside is delivered to the user.

Also, the operation indicator 9 may include a control circuit board 95 disposed inside the cabinet 1. The control circuit board 95 may receive a control signal input to the laundry treatment apparatus 100, and may control the operation of the laundry treatment apparatus 100 based on the control signal.

The control circuit board 95 may be configured to deliver the input control signal to the interface P, rather than directly controlling the operation of the laundry treatment apparatus 100. In the case where control circuit board 95 is configured to only deliver the control signal to the interface P rather than directly controlling the operation of the laundry treatment apparatus 100, the operation indicator 9 may serve as an auxiliary input unit.

In addition, separate from the control circuit board 95 and the interface P, a main controller may be provided inside the cabinet 1 to control the laundry treatment apparatus 100. In this case, the control circuit board 95 and the interface P may not directly control the laundry treatment apparatus, but may serve to transmit information related to option/course selection to the main controller.

Further, the operation indicator 9 may include a touch film 93 fixed to a surface of the window facing the inside of the cabinet 1. The touch film 93 may include a sensor configured in the form of a thin film.

The touch film 93 may include a film sensor 931 fixed to a surface of the window 91 facing the inside of the cabinet 1 to sense whether a user's body contacts the window 91.

Further, the touch film 93 may include a film wire 932 connecting the film sensor 931 and the control circuit board 95 to transmit an electrical signal input via the film sensor 931 to the control circuit board 95.

Both the film sensor 931 and the film wire 932 may be provided in the form of a thin film. The film sensor 931 and the film wire 932 may be formed of a flexible material. In other words, the film sensor 931 and the film wire 932 may be formed of a flexible material and thus be configured to be bent according to the situation.

That is, the film sensor 931 may be bent to have a predetermined curvature even when one surface of the window 91 to which the film sensor 931 is fixed is a curved surface, such that the film sensor 931 may be tightly coupled to the window 91.

Further, the film wire 932 may be formed of a flexible material to extend through a structure positioned between the film sensor 931 and the control circuit board 95 to couple the film sensor 931 and the control circuit board 95.

Further, the operation indicator 9 may include a board support 94 arranged to support the control circuit board 95 such that the control circuit board 95 is positioned inside the cabinet 1. The board support 94 may be positioned between the panel installation hole 135 and the control circuit board 95. That is, the position of the board support 94 may be closer to the window 91 than the position of the control circuit board 95.

The board support 94 may be directly coupled to the mounting panel 13 with the control circuit board 95 installed. Thus, further configuration for installing input/output device including the control circuit board 95 on the laundry treatment apparatus may be omitted. In other words, the board support 94 may be arranged such that the control circuit board 95 is positioned inside the cabinet 1, thereby improving spatial efficiency inside the cabinet 1. A structure by which the board support 94 is coupled to the mounting panel 13 will be described later.

The board support 94 may include an installation body 941 providing a space in which the control circuit board 95 is installed. The installation body 941 may have an accommodation space formed on a side facing the inside of the cabinet. The control circuit board 95 may be installed in the accommodation space.

The installation body 941 may be configured to accommodate the control circuit board 95 on a side facing away from the panel installation hole 135. Accordingly, the installation body 941 may prevent the control circuit board 95 from being exposed to foreign substances from the outside of the cabinet 1.

Further, the operation indicator 9 may include an information output unit 92 on which information controlled by the control circuit board 95 is displayed. The information output unit 92 may be connected to the control circuit board 95. The information output unit 92 may be a display panel. When the information output unit 92 is a display panel, the information output unit 92 may be connected to the control circuit board 95 to display information about the laundry treatment apparatus 100, such as a status of the laundry treatment apparatus 100 or an option selection, in response to a signal delivered from the control circuit board 95.

In addition, the information output unit 92 may be arranged to face the window 91. Specifically, the information output unit 92 may be arranged to contact the window 91. The user may check the information displayed on the information output unit 92 through the window 91.

Further, the information output unit 92 may be coupled and fixed to the board support 94. The board support 94 may include a display seating groove 946 in which the information output unit 92 is mounted. The display seating groove 946 may be recessed in the installation body 941 facing the window 91. One side of the display seating groove 946 may be provided with a through-hole formed in the installation body 941 such that a connection line connecting the information output unit 92 and the control circuit board 95 may extend through the through-hole.

In other words, when the information output unit 92 is a display panel, the information output unit 92 may be positioned between the board support 94 and the window 91.

Alternatively, the information output unit 92 may be configured as a light emitting member (not shown) such as an LED bulb. When the information output unit 92 is a light emitting member (not shown), the light emitting member may be connected to the control circuit board 95 and may indicate information about the laundry treatment apparatus 100 according to a signal delivered from the control circuit board 95.

In an example of indicating information for the user when the information output unit 92 is a light emitting member (not shown), the information output unit 92 may have a plurality of light emitting members. The light emitting members may be arranged side by side along the height direction of the window 91. Depending on the number of light emitting members that are turned on, the user may identify the currently selected option.

For example, when four light emitting members are arranged side by side along the height direction, and only one light emitting member at the lowest position is turned on, the user may recognize that stage 1 is selected. When the two lowest light emitting members are turned on, the user may recognize that stage 2 is selected.

When the information output unit 92 is configured as a light emitting member (not shown), the information output unit 92 may display the signal transmitted from the control circuit board 95 in the manner described above such that the user may recognize the signal.

Even when the information output unit 92 is a light emitting member (not shown), the information output unit 92 may be supported on the board support 94. The board support 94 may include a light emitting member insertion hole 947 formed through the installation body 941. The information output unit 92 may be inserted into the light emitting member insertion hole 947 and connected to the control circuit board 95.

When the information output unit 92 is configured as a light emitting member (not shown), one end of the information output unit 92 may be connected to the control circuit board 95 and the opposite end thereof may be arranged to face the window 91. A letter film (not shown) that is recognizable by the user when the light emitting member (not shown) is turned on may be attached to one surface of the window 91 to indicate information to the user.

The operation indicator 9 may further include a communication module 97 capable of transmitting and receiving communication signals to and from other components of the laundry treatment apparatus 100 or a separate electronic device. The communication module 97 may be configured to transmit and receive communication signals to and from a control device such as the interface P.

The operation indicator 9 may use the communication module 97 to transmit and receive signals to and from other controllers provided in the laundry treatment apparatus 100 as well as an external device (e.g., a remote control device) to control the operation of the laundry treatment apparatus 100.

The communication module 97 may be coupled to the board support 94. The board support 94 may include a communication module coupling portion 948. The communication module coupling portion 948 may be arranged on one side of the installation body 941. The communication module coupling portion 948 may be formed in the shape of a hook protruding from an outer side surface of the installation body 941. The communication module 97 may be coupled to one side of the installation body 941 by the hook.

The operation indicator 9 may include a board cover 96 coupled to the board support 94 to prevent foreign substances from being introduced into the control circuit board 95. The board cover 96 may be coupled to the installation body 941. One side of the installation body 941 facing away from the window 91 may be open to allow the control circuit board 95 to be installed in the installation body 941. The board cover 96 may be arranged to shield the open side of the installation body 941.

The board cover 96 may include a board cover shielding body 961 arranged in parallel with the control circuit board 95, and a board cover extension body 962 extending from a periphery of the board cover shielding body 961 toward the board support 94.

The board cover shielding body 961 may prevent foreign substances from being introduced into the installation body 941 from the outside, and the board cover extension body 962 may couple the board cover shielding body 961 to the board support 94.

The board cover 96 may include a board cover through-hole 963 formed through the board cover shielding body 961 in a penetrating manner. Through the board cover through-hole 963, a power line for supplying power to the control circuit board 95 may be connected to the control circuit board 95.

Further, the board cover 96 may include a board cover fastening hole 964 formed through the board cover extension body 962 in a penetrating manner. The board cover 96 may be coupled to the board support 94 through the board cover fastening hole 964.

The board support 94 may include a cover holding body 9422 protruding from an outer side surface of the installation body 941. The board cover fastening holes 964 may be supported on the cover holding body 9422. With the board cover 96 coupled to the board support 94, the cover holding body 9422 may be positioned in the board cover fastening hole 964. With the structure described above, the board cover 96 may be coupled to the board support 94 without the need for additional fastening members.

Since the board cover 96 may prevent foreign substances from being introduced into the control circuit board 95, and may be coupled without a separate fastening member. Accordingly, assemblability may be improved.

Figure 7:
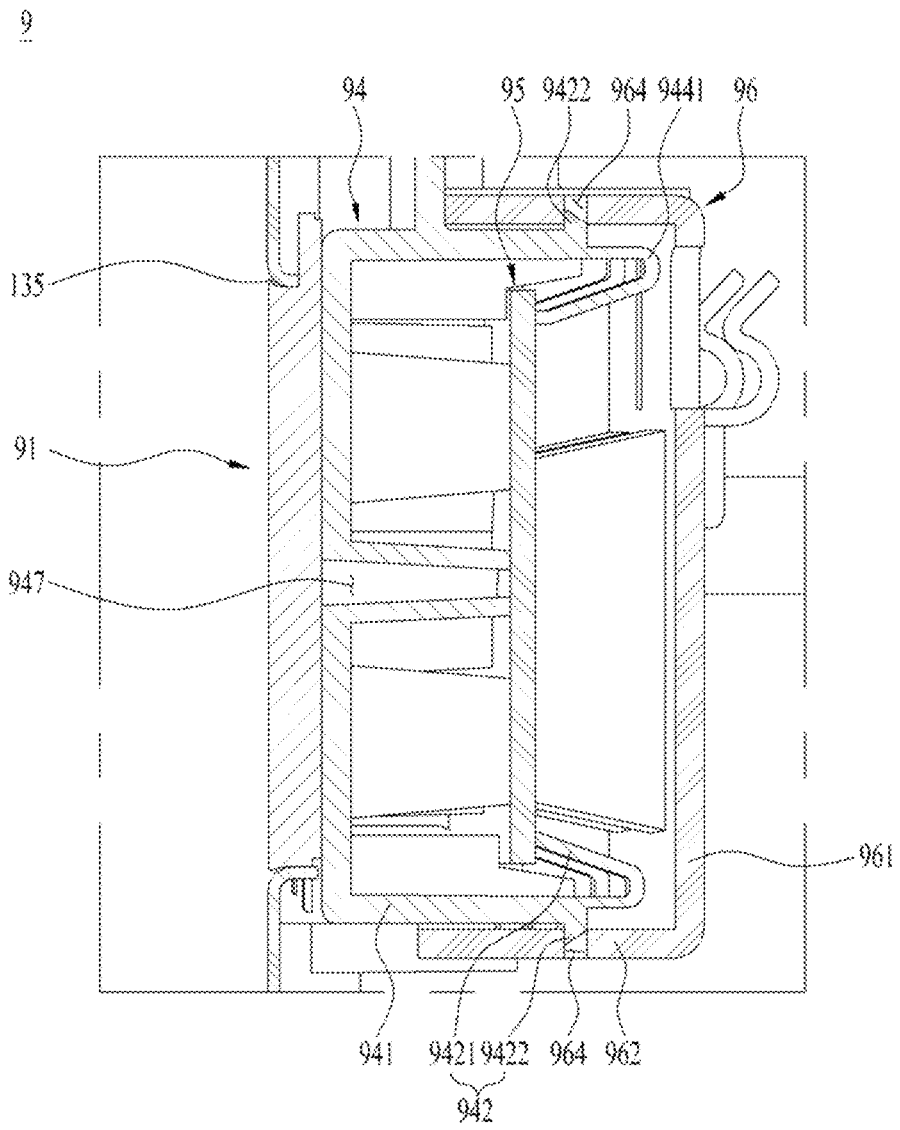
FIG. 7 is a cross-sectional view of an example of a coupling structure of an operation indicator.

FIG. 7 is a cross-sectional view illustrating the operation indicator 9 in a coupled position.

Referring to FIG. 7, it may be seen that the window 91 is coupled to the panel installation hole 135, and that the board support 94, the control circuit board 95, and the board cover 96 are coupled in order, from the window 91 toward the inside of the cabinet 1.

However, embodiments are not limited thereto. The control circuit board 95 may be arranged in the board cover 96, and the board support 94 may support the board cover 96 in which the control circuit board 95 is arranged.

The installation body 941 may be configured to accommodate the control circuit board 95 on a side facing away from the window 91. The control circuit board 95 may be installed such that one surface thereof facing the window 91 is supported on the installation body 941.

Further, the board support 94 may include a board securing body 942 extending from the installation body 941. The board securing body 942 may include an elastic protrusion 9421 that supports a surface of the control circuit board 95 positioned to face the drum 3. The elastic protrusion 9421 may include a plurality of elastic protrusions on the perimeter of the installation body 941. The elastic protrusion 9421 may extend in a hook shape.

Specifically, the elastic protrusion 9421 may extend from the installation body 941 in a direction away from the window 91 and then bend back toward the window 91. In other words, a portion of the elastic protrusion 9421 may be positioned outside the installation body 941 while a free end of the elastic protrusion 9421 may be positioned inside the installation body 941.

The free end of the elastic protrusion 9421 may be supported on the control circuit board 95. The elastic protrusion 9421 may be disposed on the top and bottom sides of the installation body 941. Further, the position of the elastic protrusion 9421 is not limited to the above-described example. The elastic protrusion 9421 may be arranged at various positions, as long as it can be supported on the control circuit board 95.

An example of an assembly process for coupling the control circuit board 95 to the installation body 941 is described below. A user may insert the control circuit board 95 into a space between the elastic protrusions 9421 facing each other. The elastic protrusions 9421 may be deformed to a predetermined extent while the control circuit board 95 is inserted. Then, they restore the original shape thereof.

Specifically, as the control circuit board 95 is inserted, the elastic protrusions 9421 may be deformed outward of the installation body 941. That is, the elastic protrusions 9421 may be moved a predetermined distance in a direction away from the control circuit board 95. In other words, the elastic protrusion 9421 may be rotated by a predetermined angle around a point where it is in contact with the installation body 941.

The control circuit board 95 may be moved into the installation body 941 through the widened space between the elastic protrusions 9421 moved outward. Once the control circuit board 95 is moved into the installation body 941 by a predetermined distance, the control circuit board 95 may be positioned closer to the window than to the free end of the elastic protrusion 9421. Then, the elastic protrusions 9421 that have been moved outward of the installation body 941 may return to their original position by elastic force. Once the position of the elastic protrusions 9421 is restored, one surface of the control circuit board 95 facing the drum 3 may be supported on the elastic protrusions 9421, and the opposite surface of the control circuit board 95 facing the window 91 may be supported on the installation body 941. Also, the perimeter of the control circuit board 95 may be supported on the installation body 941.

The board support 94 may further include a cover holding body 9422 to which the board cover 96 is coupled. The board securing body 942 may further include the cover holding body 9422 to which the board cover 96 is coupled. The cover holding body 9422 may protrude from the perimeter of the installation body 941 in a direction away from the control circuit board 95. Further, the cover holding body 9422 may protrude from the elastic protrusions 9421 in a direction away from the control circuit board 95.

The board cover 96 may be arranged to surround the perimeter of the installation body 941. The board cover 96 may be coupled to the cover holding body 9422. As described above, the board cover 96 may include the board cover fastening hole 964 formed through the board cover extension body 962, and the cover holding body 9422 may be coupled to the board cover fastening hole 964.

Specifically, a portion of the cover holding body 9422 may be positioned inside the board cover fastening hole 964. This allows the board cover 96 to be coupled to the board support 94 without a separate coupling member.

The board support 94 may include a light emitting member insertion hole 947 formed through one surface of the installation body 941 that faces the window 91. The light emitting member insertion hole 947 may extend through the installation body 941 toward the control circuit board 95.

One end of the light emitting member insertion hole 947 may be arranged to contact the control circuit board 95. As described above, the information output unit 92 may include a light emitting member (not shown). The light emitting member may include at least one LED lamp. The light emitting member may be connected to the control circuit board 95 and be accommodated in the light emitting member insertion hole 947. That is, one end of the light emitting member of the information output unit 92 may be connected to the control circuit board 95 and the opposite end thereof may be arranged close to the window 91. The control circuit board 95 may transmit a signal to the light emitting member (not shown) to turn on the light emitting member (not shown). When the light emitting member is turned on, the user may recognize, through the window 91, that the light emitting member is turned on.

The light emitting member insertion hole 947 may prevent the light emitting member (not shown) from being damaged by external impact or vibration.

Figure 8:
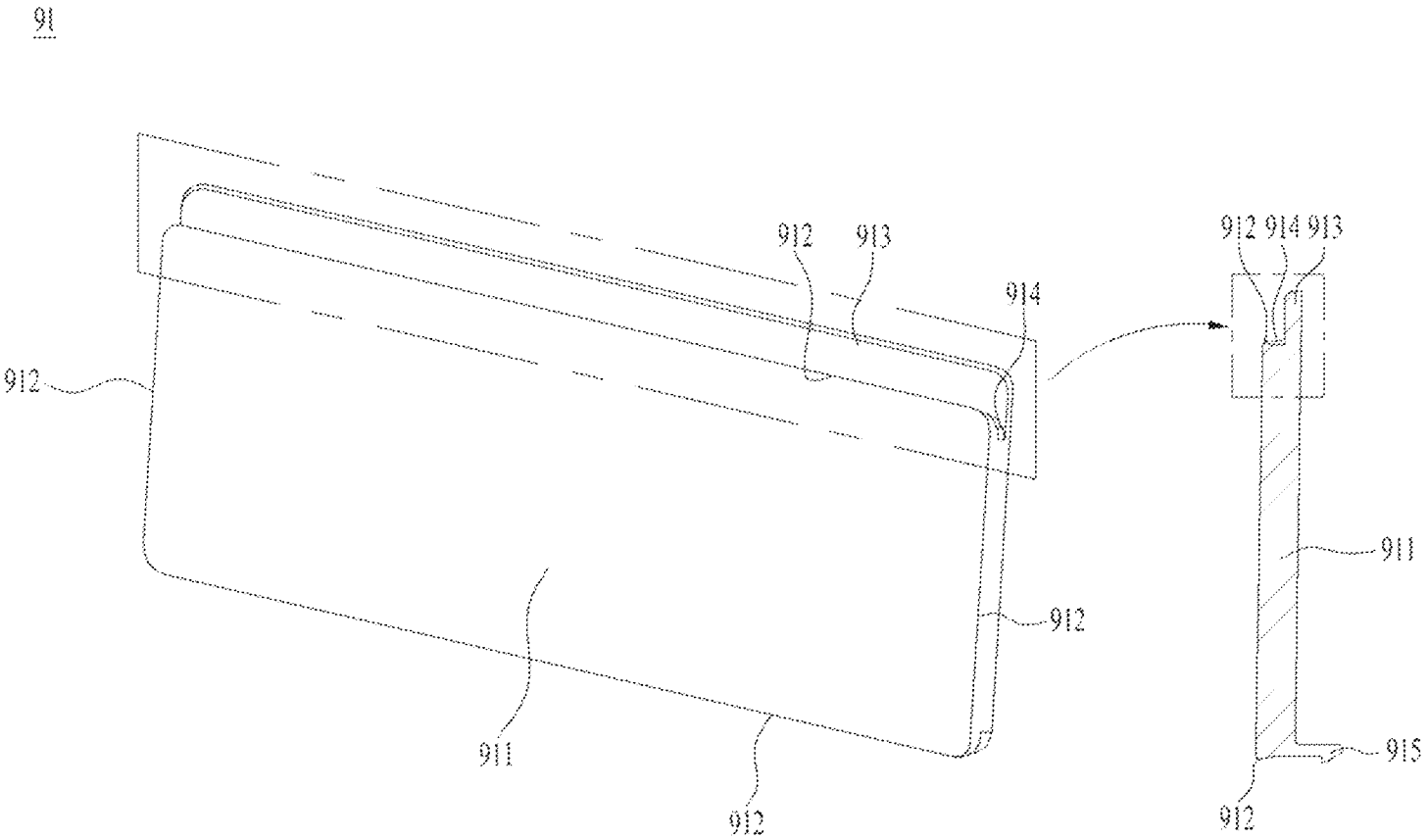
FIG. 8 shows an example of a window and a cross-section of the window.
Figure 9:
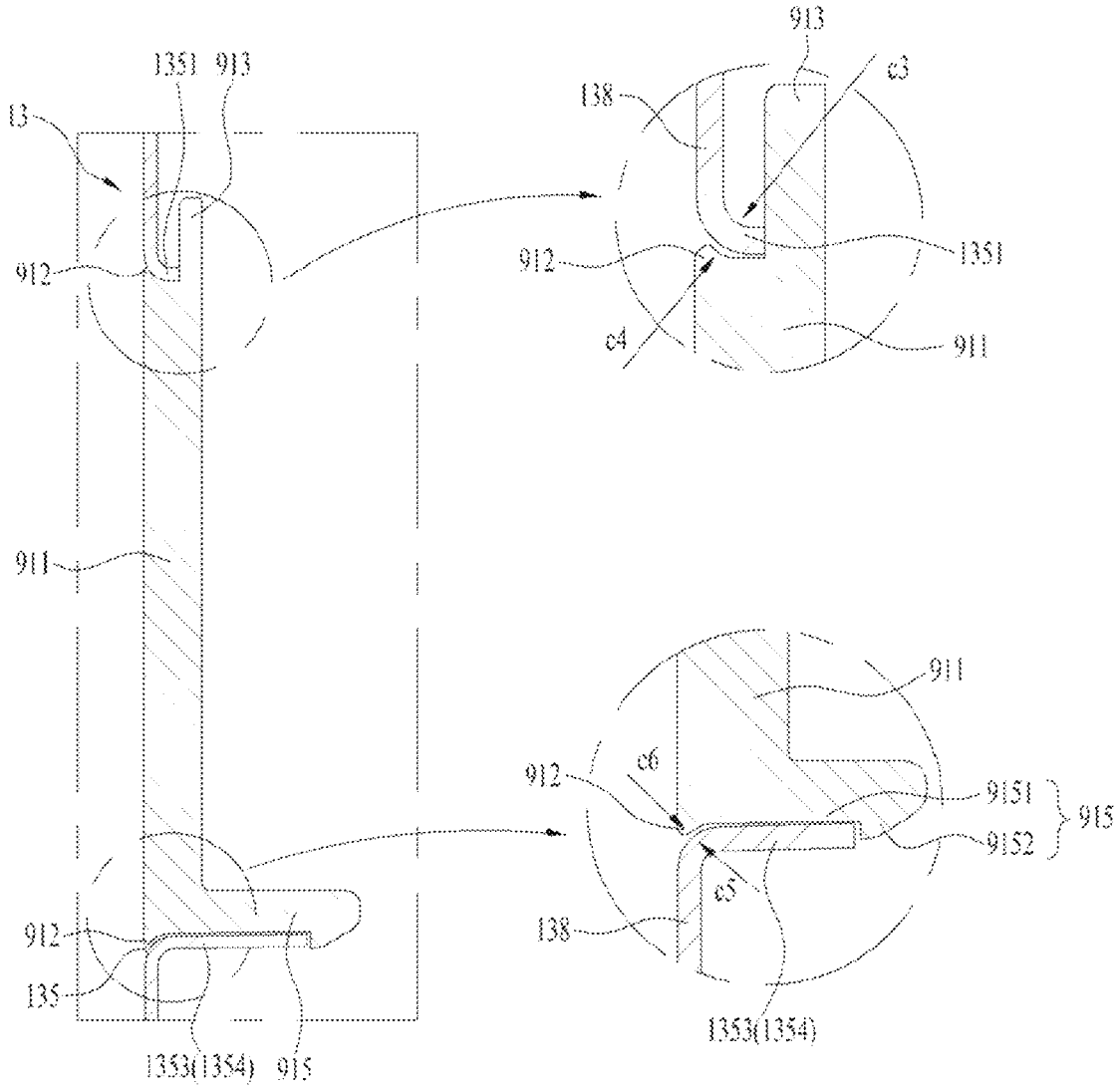
FIG. 9 is a cross-sectional view of an example of the window coupled to the mounting panel.

FIG. 8 shows a window and a cross-section thereof according to one embodiment of the present disclosure. FIG. 9 is a cross-sectional view of the window installed on a mounting panel according to one embodiment of the present disclosure.

Referring to FIGS. 8 and 9, the window 91 may include a window body 911 positioned in the panel installation hole 135. The window body 911 may be formed in a shape corresponding to the panel installation hole 135. Specifically, when the panel installation hole 135 is formed through the mounting panel 13 in a rectangular shape, the window body 911 may also be formed in a rectangular shape.

The window body 911 may be formed of a light-transmitting material. Thus, a user may recognize the information indicated on the information output unit 92 disposed at the rear of the window body 911. The window body 911 may be coated with a letter film. The letter film may block light from being transmitted through a portion of the window body 911.

In one example where the letter film is provided, the letter film may allow light to be transmitted through a portion of the window body 911 disposed at a position corresponding to that of the information output unit 92. Further, the letter film may be configured to block light from being transmitted through a portion of the window body 911 disposed at a position not corresponding to that of the information output unit 92.

Thus, the letter film may prevent unnecessary portions of the interior of the cabinet 1 from being visually exposed to the user through the window body 911. The portion of the interior of the cabinet 1 that needs to be exposed to the user may refer to the portion disposed at a position corresponding to that of the information output unit 92. In this way, the letter film may prevent the internal parts of the laundry treatment apparatus from being unnecessarily exposed to degrade aesthetics.

Further, the window 91 may further include an outer extension 912 and an inner extension 913 provided at the edge of the window body 911 to close the panel installation hole 135.

The outer extension 912 may extend from the edge of the window body 911 and be positioned outside of the cabinet 1. On the other hand, the inner extension 913 may extend from the edge of the window body 911 and be positioned inside of the cabinet 1. In other words, the outer extension 912 may be exposed to the user, while the inner extension 913 may not be exposed to the user after the window 91 is coupled.

The outer extension 912 and the inner extension 913 may prevent foreign substances from being introduced into the gap between the window body 911 and the mounting panel 13. Foreign substances entering through the panel installation hole 135 may cause a malfunction of electronic components positioned inside the cabinet 1, such as the control circuit board 95. Therefore, the outer extension 912 and the inner extension 913 may prevent foreign substances from being introduced into the cabinet, thereby improving the stability of the laundry treatment apparatus.

The inner extension 913 may be positioned closer to the drum 3 than to the outer extension 912. That is, both the inner extension 913 and the outer extension 912 extend from an edge of the window body 911, but the inner extension 913 may extend from a portion of the edge of the window body 911 that is positioned closer to the drum 3, and the outer extension 912 may extend from a portion of the edge of the window body 911 that is positioned farther from the drum 3.

The outer extension 912 may primarily shield the space between the window body 911 and the panel installation hole 135, and the inner extension 913 may secondarily block the space between the window body 911 and the panel installation hole 135. That is, the space between the window body 911 and the panel installation hole 135 may be double-blocked by the outer extension 912 and the inner extension 913.

The outer extension 912 may be arranged along the edge of the window body 911. That is, the outer extension 912 may be arranged along the entire perimeter of the window body 911. Specifically, the outer extension 912 may increase the area of the window body 911 exposed to the outside of the cabinet 1.

On the other hand, the inner extension 913 may be provided on at least a portion of the edge of the window body 911. That is, when the window body 911 is formed in a rectangular shape, the inner extension 913 may be provided on only one of the four sides of the window body 911. In particular, the inner extension 913 may extend upward from the top surface of the window body 911.

Specifically, foreign substances introduced from above the window body 911 are likely to easily enter the control circuit board 95 by gravity. Therefore, the inner extension 913 may be provided only on the top surface of the window body 911.

Further, the window 91 may be coupled to the outer side of the mounting panel 13, facing the inside of the cabinet 1. In the case where the inner extension 913 is provided along the entire edge of the window body 911, it may not be easy to install the window 91. Accordingly, the inner extension 913 may be provided at a portion of the edge of the window body 911 to improve the assemblability of the window 91.

Also, a distance the outer extension 912 extends from the window body 911 may be less than a distance the inner extension 913 extends from the window body 911. Since the outer extension 912 is exposed to the outside of the cabinet 1, the aesthetics and unity of the entire laundry treatment apparatus may be degraded in the case where the extension length of the outer extension 912 excessively exceeds the area of the panel installation hole 135.

On the other hand, the inner extension 913 may extend independently of the area of the panel installation hole 135 because it is disposed inside the cabinet 1. That is, the inner extension 913 may extend longer than the outer extension 912, thereby further improving the effect of prevention of infiltration of foreign substances.

Further, in one example of installing the window 91 on the mounting panel 13, the inner extension 913 may be first inserted into the cabinet through the panel installation hole 135, and the window body 911 may be rotated around the inner extension 913 to be positioned in the panel installation hole 135. When the inner extension 913 is longer than the outer extension 912, the inner extension 913 may more reliably support the window body 911 during the installation of the window 91. Thereby, the assemblability of the window 91 may be improved.

Further, the outer extension 913 may extend longer than a spacing distance between the edge of the panel installation hole 135 and the window body 911. That is, the distance which the outer extension 913 extends from the edge of the window body 911 may be longer than the distance between the window body 911 and the panel installation hole 135, thereby preventing foreign substances from being introduced into the gap formed at the edge of the window body 911.

The mounting panel 13 may further include a flange 1351 positioned at an edge of the panel installation hole 135. The flange 1351 may extend from the edge of the panel installation hole 135 toward the drum.

The flange 1351 may be formed in the process of penetrating the mounting panel 13 to form the panel installation hole 135. As described above, the panel installation hole 135 may be formed as a portion of the mounting panel 13 is bent inward in the process of penetrating the mounting panel 13 toward the inside of the cabinet 1 to form the panel installation hole 135. In other words, the flange 1351 may form a portion of the mounting panel 13.

The outer extension 912 may extend longer than a spacing distance between the window body 911 and the flange 1351. In other words, the outer extension 912 may prevent the space between the window body 911 and the flange 1351 from being exposed to the outside. Thus, the outer extension 912 may prevent foreign substances from infiltrating into the space between the window body 911 and the flange 1351.

The flange 1351 may be positioned between the outer extension 912 and the inner extension 913. That is, the drum 3 may be positioned farther from the outer extension 912 than from the flange 1351. In addition, the distance of the position of the inner extension 913 to the drum 3 may be shorter than the distance of the position of the flange 1351 to the drum 3.

The outer extension 912 may extend from an edge of the window body 911 toward the flange 1351. The outer extension 912 may contact the flange 1351 to shield the panel installation hole 135.

The inner extension 913 may be arranged to contact the free end of the flange 1351. In other words, the inner extension 913 may be arranged to contact one end of the flange 1351 that is positioned close to the drum 3. The inner extension 913 may contact the flange 1351, thereby preventing foreign substances from being introduced into the gap between the flange 1351 and the window body 911.

In one example, the window 91 may be coupled to the mounting panel 13 as described below. The inner extension 913 may be inserted into the cabinet 1 through the panel installation hole 135 and brought into contact with one end of the flange 1351. Then, the window 91 may be rotated around the point of contact between the flange 1351 and the inner extension 913 such that the window body 911 is positioned in the panel installation hole 135.

As described above, when the flange 1351 and the inner extension 913 contact each other, the inner extension 913 may more effectively prevent infiltration of foreign substances, and the assemblability of the window 91 may be improved.

The flange 1351 may be connected to one surface of the mounting panel 13 with the panel installation hole 135 to have a predetermined curvature. The one surface 138 of the mounting panel in which the panel installation hole 135 is formed may be defined as a mounting plate. The mounting plate 138 may define the front face of the cabinet 1. For simplicity, in the following description, the one surface of the mounting panel 13 in which the panel installation hole 135 is formed will be referred to as the mounting plate 138.

In other words, the flange 1351 may be configured to have a predetermined curvature with the mounting plate 138, and one surface of the outer extension 912 facing the flange may be configured to have a curvature corresponding to the curvature of the flange 1351.

Referring to the figures, a portion of the flange 1351 that is positioned on the window body 911 may be extended to have a predetermined curvature c3 with the mounting plate 138. In this case, the outer extension 912 facing the flange 1351 may be configured to have a corresponding curvature c4.

Further, a portion of the flange 1351 that is positioned under the window body 911 may be extended to have a predetermined curvature c5 with the mounting plate 138. In this case, the outer extension 912 facing the flange 1351 may be configured to have a corresponding curvature c6.

In this case, the curvatures of the flange 1351 may be defined as first curvatures c3 and c5, and the curvatures of the outer extension 912 may be defined as second curvatures c4 and c6. The first curvatures c3 and c5 may correspond to the second curvatures c4 and c6.

When the flange 1351 and the outer extension 912 are configured to have corresponding curvatures as described above, the outer extension 912 may more effectively close the panel installation hole 135. Thereby, infiltration of foreign substances may be more effectively prevented. Further, since the portions of the flange 1351 and the outer extension 912 contact each other may be formed as curved surfaces, thereby preventing the flange 1351 or window 91 from being damaged during the assembly process.

On the other hand, the outer extension 912 and the inner extension 913 may be integrated with the window body 911. That is, the outer extension 912 and the inner extension 913 may be integrated in the process of molding the window 91, rather than being made as separate components from the window body 911 and then coupled thereto. Thus, gaps may be prevented from being formed between the window body 911 and the outer extension 912 and between the window body 911 and the inner extension 913. Therefore, the effect of preventing infiltration of foreign substances may be improved.

The window 91 may further include a window channel 914 provided between the inner extension 913 and the outer extension 912. The window channel 914 may prevent foreign substances introduced into the panel installation hole 135 from moving to the control circuit board 95.

Specifically, the window channel 914 may be formed by the inner extension 913, outer extension 912, and window body 911. Since the inner extension 913 and outer extension 912 extend from the edge of the window body 911, the channel through which a fluid can flow may be formed between the inner extension 913 and the outer extension 912.

In particular, when the inner extension 913 is disposed on the top surface of the window body 911, the window channel 914 may also be formed on the upper portion of the window body 911. Although the outer extension 912 may primarily block infiltration of foreign substances, various foreign substances including water may enter the gap between the outer extension 912 and the mounting panel 13. When the foreign substances pass over the outer extension 912 and remains on the top of the window body 911, they may decay and raise issues such as foul odor. Thus, the window channel 914 may guide the foreign substances to a side of the window body 911.

When the window channel 914 is disposed on the top of the window body 911, the introduced foreign substances may be moved downward by gravity. The window channel 914 may prevent foreign substances from being introduced into the control circuit board 95 by restrict the path along which the foreign substances travels. Thus, foreign substances may be prevented from causing a malfunction or error in the laundry treatment apparatus.

The top surface of the window body 911 may be inclined downward to one side of the window body 911 widthwise. That is, the window channel 914 may be inclined downward to one side of the window body 911 widthwise. Further, the top surface of the window body 911 may be inclined downward to both sides with respect to one point.

As described above, the window body 911 may be formed in a rectangular shape. Specifically, it may be formed of a thin plastic member having a rectangular shape. Also, the outer extension 912 may be provided along the entire edge of the window body 911. On the other hand, the inner extension 913 may be provided on one surface of the edge of the window body 911.

In particular, the inner extension 913 may be provided on the top surface of the edge of the window body 911. The inner extension 913 may extend upward from the top surface of the edge of the window body 911.

In other words, the outer extension 912 may extend from four sides of the window body 911 having the rectangular shape. On the other hand, the inner extension 913 may extend from the top surface on the top side among the four sides of the window body 911.

The window 91 outside of the cabinet 1 may be coupled to the mounting panel 13 through the panel installation hole 135. That is, it may be coupled from the outside. Thus, when the inner extension 913 is provided on one side only, it becomes easier to position the inner extension 913 inside of the cabinet 1. Thus, the assemblability for coupling the window 91 to the mounting panel 13 may be improved.

Further, foreign substances entering from above the window body 911 is likely to be introduced into the control circuit board 95 by gravity. Therefore, when the inner extension 913 is provided on the top surface of the window body 911, blocking infiltration of foreign substances may be further improved than when the inner extension is provided on any other side except the top surface of the window body 911.

The window body 911 may be configured to have an area smaller than the area of the panel installation hole 135 so as to be coupled to the panel installation hole 135. Thus, a gap may be formed between the edge of the panel installation hole 135 and the window body 911. Accordingly, the extension length of the outer extension 912 may be greater than a spacing distance between the edge of the panel installation hole 135 and the window body 911.

When the extension length of the outer extension 912 is greater than the spacing distance between the edge of the panel installation hole 135 and the window body 911 as described above, the outer extension 912 may block the infiltration of foreign substances into the gap between the window body 911 and the edge of the panel installation hole 135. Further, with the configuration above, the outer extension 912 may more effectively close the panel installation hole 135.

Also, in the process of installing the window 91 in the mounting panel 13, it may be moved from the outside of the cabinet 1 toward the inside. In this case, the outer extension 912 may determine the position of the window body 911 such that the window 91 does not fall into the cabinet 1.

When the extension length of the outer extension 912 is greater than a spacing distance between the window body 911 and the edge of the panel installation hole 135, the outer extension 912 may be brought into contact with the mounting panel 13 during installation of the window 91. When the outer extension 912 contacts the mounting panel 13, the window body 911 may be recognized as being arranged in position. Further, since movement of the window body 911 into the cabinet 1 is restricted by the outer extension 912, the window 91 may be prevented from falling into the cabinet 1 through the panel installation hole 135. Therefore, the assemblability of the window 91 may be improved.

The window 91 may further include a window coupling portion 915 for coupling the window body 911 to the mounting panel 13. The window coupling portion 915 may extend from the window body 911 toward a side on which the drum 3 is positioned. Specifically, the window coupling portion 915 may be disposed on the side of the window body 911 facing away from the inner extension 913.

In particular, when the inner extension 913 is provided on the top surface of the window body 911, the window coupling portion 915 may be disposed close to the bottom surface of the window body 911. As described above, in coupling the window 91 to the mounting panel 13, the inner extension 913 may first be inserted into the panel installation hole 135, and the window body 911 may be rotated around the point of contact between the inner extension 913 and the flange 1351. Once the window body 911 is positioned in the panel installation hole 135, the window coupling portion 915 may also be coupled to the mounting panel 13 to support the window body 911.

In other words, when the inner extension 913 and the window coupling portion 915 are positioned on the window body to face each other, the window body 911 may be supported on multiple sides. Thereby, the window 91 may be more firmly fixed to the mounting panel 13.

The mounting panel 13 may include the flange 1351 as described above. The flange 1351 may include a coupling rib 1354 that supports the window body. The coupling rib 1354 may refer to a portion of the flange 1351 positioned close to the panel inlet 131. In particular, the coupling rib 1354 may support the bottom surface of the window body 911.

When the panel installation hole 135 is formed in a rectangular shape as described above, a portion extending from the perimeter of the panel installation hole 135 toward the inside of the cabinet 1 may be referred to as the flange 1351. Further, the portions of the flanges 1351 disposed on the top and bottom sides among the four sides defining the edge of the panel installation hole 135 may be referred to as support ribs 1353. Further, of the support ribs 1353, the support rib 1353 disposed on the bottom side may be referred to as the coupling rib 1354.

That is, the portion of the flange 1351 that is provided closest to the panel inlet 131 may be referred to as the coupling rib 1354.

However, embodiments are not limited thereto. A portion of the flange 1351 with which the window coupling portion 915 is engaged may be defined as the coupling rib 1354.

The coupling rib 1354 may be configured to support the bottom side of the window body 911. Further, the window coupling portion 915 may be engaged with and supported by the coupling rib 1354.

Specifically, the window coupling portion 915 may include a window support body 9151 extending from one surface of the window body 911 facing the inside of the cabinet 1, and a window fixing body 9152 protruding from the window support body 9151 and engaged with the coupling rib 1354.

The window support body 9151 may extend parallel to the coupling rib 1354. Also, the window support body 9151 may contact the coupling rib 1354 to support the window body 911. The window fixing body 9152 may be formed in a hook shape to be engaged with the coupling rib 1354. That is, the window support body 9151 and the window fixing body 9152 may be integrated to form a hook shape to be engaged with and supported by the coupling rib 1354.

Further, a plurality of window coupling portions 915 may be provided. The window coupling portions 915 may be spaced apart from each other on one surface of the window body 911. Further, the plurality of window coupling portions 915 may couple the window body 911 to the mounting panel 13 at various points. Thus, the window body 911 may be more firmly coupled to the mounting panel 13.

Figure 10:
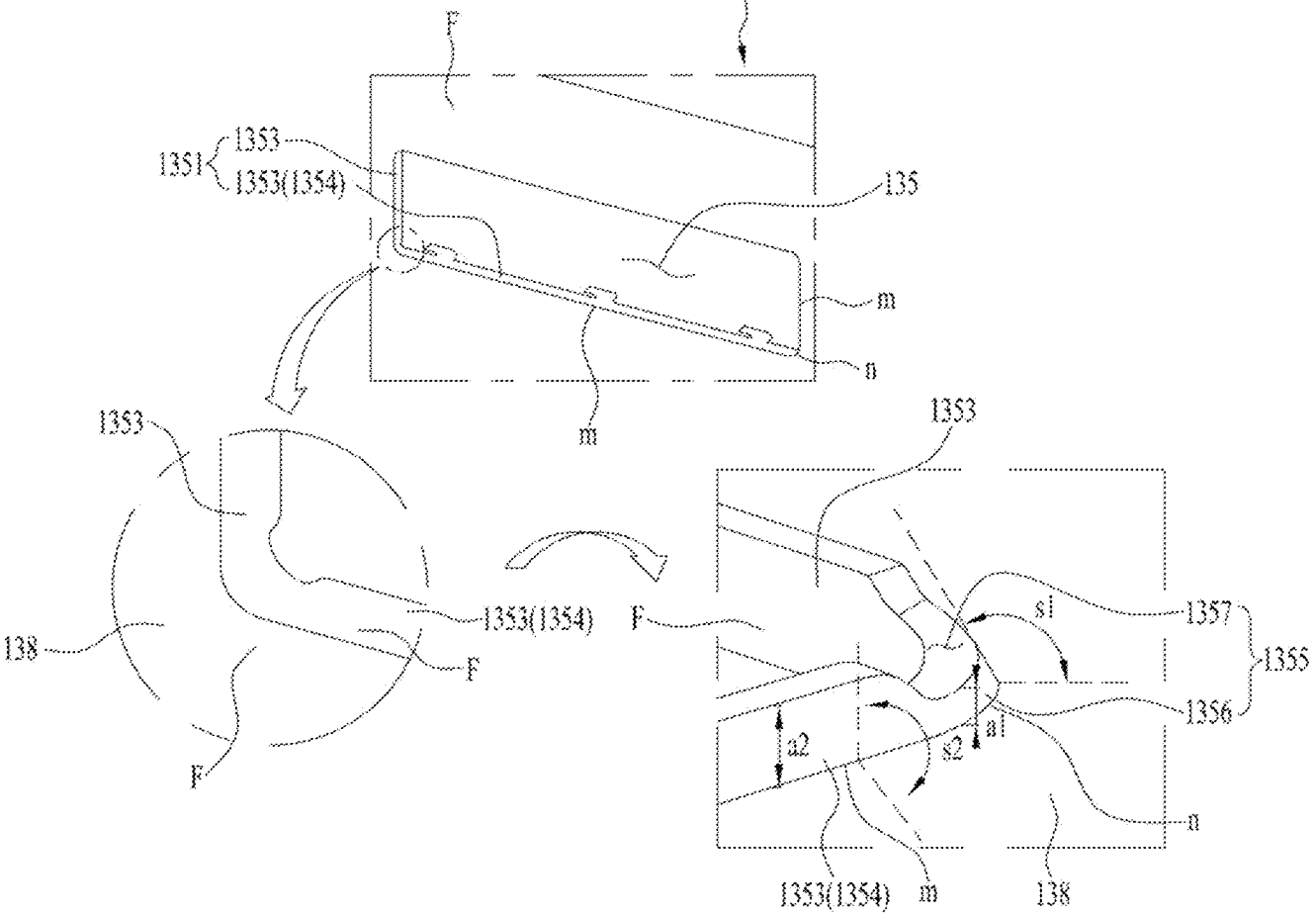
FIG. 10 shows an example of a panel installation hole seen from multiple sides.
Figure 11:
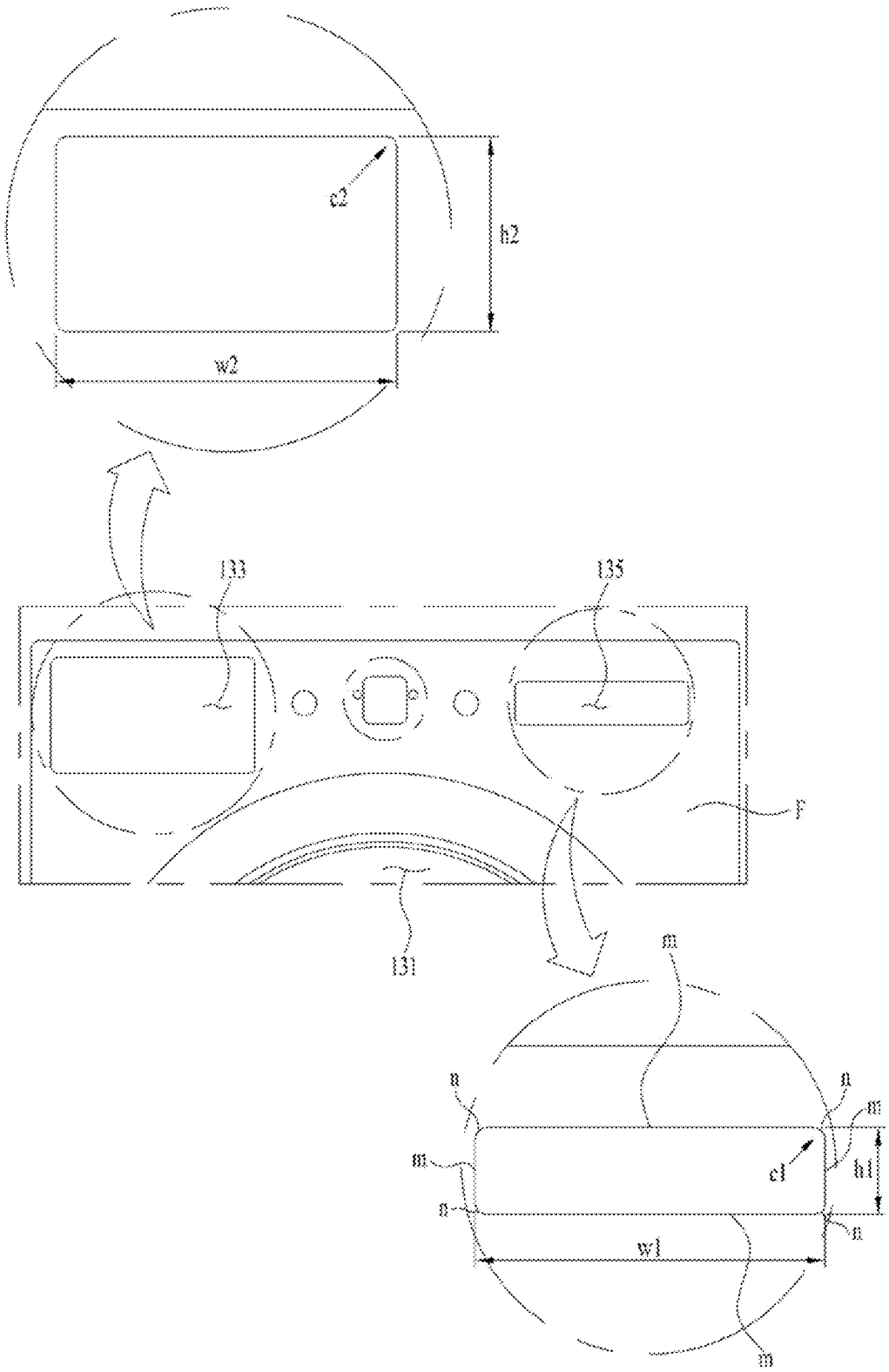
FIG. 11 shows an example of the panel installation hole and drawer inlet.

FIG. 10 shows a panel installation hole 135 according to one embodiment of the present disclosure. FIG. 11 shows a panel installation hole 135 and a drawer inlet 133 which are formed in the mounting panel 13 according to one embodiment of the present disclosure.

Referring to FIGS. 10 and 11, the laundry treatment apparatus according to one embodiment of the present disclosure may include a flange 1351 extending from the edge of the panel installation hole 135 toward the side on which the drum 3 is positioned. The flange 1351 may be formed naturally in the process of penetrating one surface of the mounting panel 13 to form the panel installation hole 135, as described above. The one surface of the mounting panel 13 in which the panel installation hole 135 and panel inlet 131 are formed may be referred to as a mounting plate 138. That is, the mounting plate 138 may define the front surface of the cabinet 1.

Hereinafter, for simplicity, the one surface of the mounting panel 13 in which the panel inlet 131 and the panel installation hole 135 are formed will be referred to as the mounting plate 138.

The laundry treatment apparatus may further include a coating film fixed to a surface of the mounting panel 13 exposed to the outside of the cabinet 1. The coating film may be fixed to the outer surface of the mounting plate 138. Further, the coating film F may be fixed to a surface of the flange 1351 facing the panel installation hole 135.

Specifically, the panel installation hole 135 may be formed by penetrating the mounting panel 13 with the coating film F fixed thereto. Thus, the flange 1351 may be formed as a portion of the mounting panel 13 is curled inward. At this time, the coating film F may also be curled inward along with the flange 1351.

The coating film F initially remains fixed to the mounting panel 13 having a flat shape and is then fixed to the flange 1351 as the panel installation hole 135 is formed. The flange 1351 is configured to bend from the mounting plate 138. Accordingly, as the surface to which the coating film F is fixed is deformed, the coating film F may be separated from the surface. In other words, in the process of forming the panel installation hole 135, the coating film F may be separated from the flange 1351.

Accordingly, the laundry treatment apparatus according to one embodiment of the present disclosure may include an anti-separation portion 1355 that prevents the coating film F from being separated from the flange 1351.

Specifically, the flange 1351 may include the anti-separation portion 1355 that prevents the coating film F from being separated from the flange 1351 during the formation of the panel installation hole 135.

In particular, the panel installation hole 135 may have a polygonal shape with rounded corners. In this case, the panel installation hole 135 may include a straight portion m disposed on each side. Further, the panel installation hole 135 may include a corner n that connect neighboring straight portions m to each other in a rounded manner.

For example, when the panel installation hole 135 is formed in a rectangular shape with rounded corners, the panel installation hole 135 may include four straight portions m and four corners n.

The anti-separation portion 1355 may be provided on the flange 1351 disposed at the corners n. During the formation of the panel installation hole 135, the density of the coating film F at the flange 1351 disposed at the corners n is likely to increase, and thus the coating film Fis likely to be separated. Therefore, the anti-separation portion 1355 may be provided at the corners n to prevent the coating film F from being separated from the flange 1351.

As described above, the panel installation hole 135 may be formed in a rectangular shape. As the panel installation hole 135 is formed in a rectangular shape, the flange 1351 extending from the edge of the panel installation hole 135 may also be formed in a rectangular shape. Further, the coating film F fixed to the flange 1351 may be positioned along the shape of the flange 1351. In this case, the coating film F disposed at the corners of the rectangular-shaped flange 1351 has a sharply increased density of arrangement, which may result in increased possibility of separation of the film. Bent portions may be formed at the corners of the flange 1351, which may cause the coating film F to be separated.

Accordingly, when the panel installation hole 135 is formed in a rectangular shape, the anti-separation member 1355 may be disposed at the corners of the rectangular-shaped panel installation hole 135. In other words, the anti-separation portion 1355 may be disposed at portions of the flange 1351 corresponding the corners of the panel installation hole 135.

As described above, since the coating film F is most likely to be separated at the corners of the panel installation hole 135, the anti-separation portion 1355 may be provided at the corners to prevent the coating film F from being separated from the flange 1351.

The flange 1351 may include a support rib 1353 provided on at least one side of the panel installation hole 135 to support the window 91. The support rib 1353 may refer to a portion of the flange 1351 extending from the straight portion m. Specifically, the support rib 1353 may refer to portions of the flange 1351 positioned on the bottom, left and right sides of the panel installation hole 135. In other words, the portions of the flange 1351 that are positioned on the three sides of the rectangular-shaped panel installation hole 135 except the top side may be defined as the support rib 1353.

Further, the anti-separation portion 1355 may include a prevention rib 1356 extending from the corners of the panel installation hole 135 to the side on which the drum 3 is positioned. That is, the prevention ribs 1356 may form part of the flange 1351. Specifically, the prevention ribs 1356 may be configured to connect the support ribs 1353 positioned on each side of the rectangular-shaped panel installation hole 135. In other words, the sides of the rectangular-shaped flange 1351 may be provided with support ribs 1353 and the corners of the rectangle may be provided with the prevention ribs 1356.

In other words, the support ribs 1353 may be arranged at the straight portions m and the prevention ribs 1356 may be arranged at the corners n. The preventer ribs 1356 may connect neighboring support ribs 1353 to each other.

In general, when the mounting panel 13 is penetrated to form the panel installation hole 135, the surface in which the panel installation hole 135 is formed, i.e., the mounting plate 138, and the flange 1351 form an angle of about 90 degrees.

As the extent to which the corners of the flange 1351 are bent from the mounting panel 13 increases, the density of the coating film F may increase. Accordingly, the likelihood of separation of the coating film F may increase. Therefore, the extent of bending of the prevention ribs 1356 disposed at the corners of the flange 1351 may be adjusted to prevent the coating film F from being separated. In other words, the coating film F may be prevented from being separated by adjusting the angle formed between the prevention ribs 1356 and the mounting panel 13.

The prevention rib 1356 may be inclined with respect to one surface of the mounting panel 13 in which the panel installation hole 135 is formed. That is, the prevention rib 1356 may be inclined with respect to the mounting plate 138. In other words, the prevention ribs 1356 may be inclined rather than being perpendicular to the mounting plate 138.

The prevention ribs 1356 may be configured to form a first angle s1 with one surface of the mounting panel 13 in which the panel installation hole 135 is formed. Further, the support ribs 1353 may be configured to form a second angle with the one surface of the mounting panel 13 in which the panel installation hole 135 is formed. The first angle s1 may be greater than the second angle s2.

In other words, as described above, the prevention ribs 1356 may be configured to form the first angle s1 with the mounting plate 138, and the support ribs 1353 may be configured to form the second angle with the mounting plate 138.

The first angle s1 and the second angle s2 may be angles formed along the prevention rib 1356 or the supporting rib 1353 on the surface of the mounting plate 138 facing the drum 3. In other words, the first angle s1 and the second angle s2 may be angles toward the inside of the cabinet.

The second angle s2 may be generally about 90 degrees, and the first angle s1 may be greater than the second angle s2, and thus may be an obtuse angle greater than 90 degrees. Preferably, the first angle s1 may be greater than or equal to 100 degrees, and may be less than or equal to 120 degrees.

When fabrication is performed as described above, the window 91 may be sufficiently installed in the panel installation hole 135 while preventing the coating film F from being separated from the flange 1351.

The anti-separation portion 1355 may prevent the coating film F from being separated by adjusting the length of the anti-separation rib 1356. In particular, as the length of the flange 1351 disposed at the corners of the panel installation hole 135 increases, the density of the coating film F disposed at the corresponding corners may increase, and thus the likelihood of the coating film F being separated from the flange 1351 may increase.

Accordingly, the extension length a1 of the prevention rib 1356 may be less than or equal to the extension length a2 of the support rib 1353. In other words, both the prevention ribs 1356 and the supporting ribs 1353 may constitute part of the flange 1351 extending from the edge of the panel installation hole 135 such that the extension length of the prevention ribs 1356 positioned at the corners of the rectangular-shaped panel installation hole 135 may be less than the extension length of the support ribs 1353 positioned on the sides of the panel installation hole 135 to prevent the coating film F from being separated from near a corner.

In other words, the coating film F is also fixed on the prevention ribs 1356. The coating film F may be prevented from being separated by shortening the length of the prevention ribs 1356.

Further, a portion of the support rib 1353 that is disposed close to the panel inlet 131 to support the bottom side of the window may be defined as the coupling rib 1354. Also, a support rib 1353 provided on a straight portion m disposed close to the panel inlet 131 among the support ribs 1353 may be defined as a coupling rib 1354. The coupling rib 1354 may constitute part of the support ribs 1353, wherein the extension length a1 of the prevention ribs 1356 may be less than the extension length a2 of the coupling ribs 1354.

As described above, by providing the prevention ribs 1356 disposed at the corners of the rectangle to be shorter than the coupling ribs 1354 disposed on the sides, the coating film F may be more effectively prevented from being separated.

The anti-separation portion 1355 may include a cut-open portion 1357 that shortens the length of the flange 1351. In particular, the cut-open portion 1357 may be provided in a portion of the flange 1351 disposed at the corners of the panel installation hole 135. That is, the cut-open portion 1357 may be provided in a portion of the flange 1351 disposed at the corners n.

In other words, the cut-open portion 1357 may be provided to shorten the length of the portions of the flange 1351 disposed at the corners of the flange 1351 extending along the edge of the panel installation hole 135 having a rectangular shape.

As described above, since there is a high possibility of separation of the coating film F at the portions of the flange 1351 positioned at the corners, the cut-open portion 1357 may shorten the length of the corners of the flange 1351 to prevent the coating film F from being separated.

Specifically, the cut-open portion 1357 may be bent at an end of the flange 1351 facing the board support 94, in a direction away from the board support 94. That is, the cut-open portion 1357 may represent a point at which an end of the flange 1351 is bent.

The cut-open portion 1357 may be formed by bending a portion of the flange 1351, thereby shortening the extension length of the flange 1351. That is, the cut-open portion 1357 may shorten the extension length of the portions of the flange 1351 that are disposed at the corners of the panel installation hole 135.

In view of the above, the anti-separation portion 1355 may be provided as either the prevention rib 1356 or the cut-open portion 1357. The prevention ribs 1356 may shorten the length of the flange 1351 at the corners of the panel installation hole 135 by adjusting the length of the prevention ribs 1356. On the other hand, the cut-open portion 1357 may be formed by removing a portion of the flange 1351, thereby shortening the length of the flange 1351 at the corners of the panel installation hole 135.

In other words, even when the anti-separation rib 1356 and cut-open portion 1357 are provided separately, they may have the same effect of shortening the length of the flange 1351. In other words, the anti-separation portion 1355 may be provided with either the prevention rib 1356 or the cut-open portion 1357.

Referring to FIG. 11, the reason for forming the anti-separation portion 1355 in the panel installation hole 135 may be derived from its relationship with the other through-holes 133 formed in the cabinet 1.

As mentioned above, the cabinet 1 may include the drawer inlet 133 formed through the mounting panel 13. Referring to FIG. 11, the drawer inlet 133 may be formed spaced apart from the panel installation hole 135. The drawer inlet 133 may have a larger area than the panel installation hole 135.

Both the drawer inlet 133 and the panel installation hole 135 may be formed in a rectangular shape. When a through-hole is formed in a rectangular shape, the corners of the through-hole may be rounded. As the radius of the corners of the rectangular shape decreases, the shape of the rectangle may become clearer. Accordingly, the aesthetics of the laundry treatment apparatus may be improved. In other words, it may be considered desirable from an aesthetic point of view to reduce the radius of the corners in forming the through-hole of the rectangular shape.

The panel installation hole 135 may be configured to have a smaller area than the drawer inlet 133. In other words, the height H1 of the panel installation hole may be less than the height H2 of the drawer inlet. Accordingly, in order to present a rectangular shape of the panel installation hole 135, the radius c1 of the corners of the panel installation hole 135 may be provided to be less than the radius c2 of the corners the drawer inlet.

As the radius of the corners decreases, the density of the coating film F increases, and thus the coating film F may be more easily separated from the corners of the panel installation hole 135. Therefore, the panel installation hole 135 may be provided with the anti-separation portion 1355 to prevent the coating film F from being separated.

Further, the radius of the corners of the through-hole may be determined by the width of the through-hole divided by the height of the through-hole. That is, the radius of the corners to present the rectangular shape of the through-hole may be determined according to the aspect ratio of the through-hole.

The value w1/h1 obtained by dividing the width w1 of the panel installation hole 135 by the height h1 may be greater than or equal to the value w2/h2 obtained by dividing the width w2 of the drawer inlet 133 by the height H2 thereof.

As the value w/h obtained by dividing the width by the height increases, the radius of the corners to present the rectangular shape may decrease. Accordingly, as the value w/h obtained by dividing the width by the height decreases, the radius of the corners decreases, and the possibility that the coating film F is separated from the corners increases.

Therefore, it becomes more necessary to provide the anti-separation portion 1355 at the corners of the panel installation hole 135 to prevent the coating film F from being separated. Accordingly, the panel installation hole 135 may be provided with the anti-separation portion 1355.

While the anti-separation portion 1355 is illustrated as being provided in the panel installation hole 135, embodiments are not limited thereto. The anti-separation portion may also be provided in other through-holes formed in the mounting panel 13 as needed.

Figure 12:
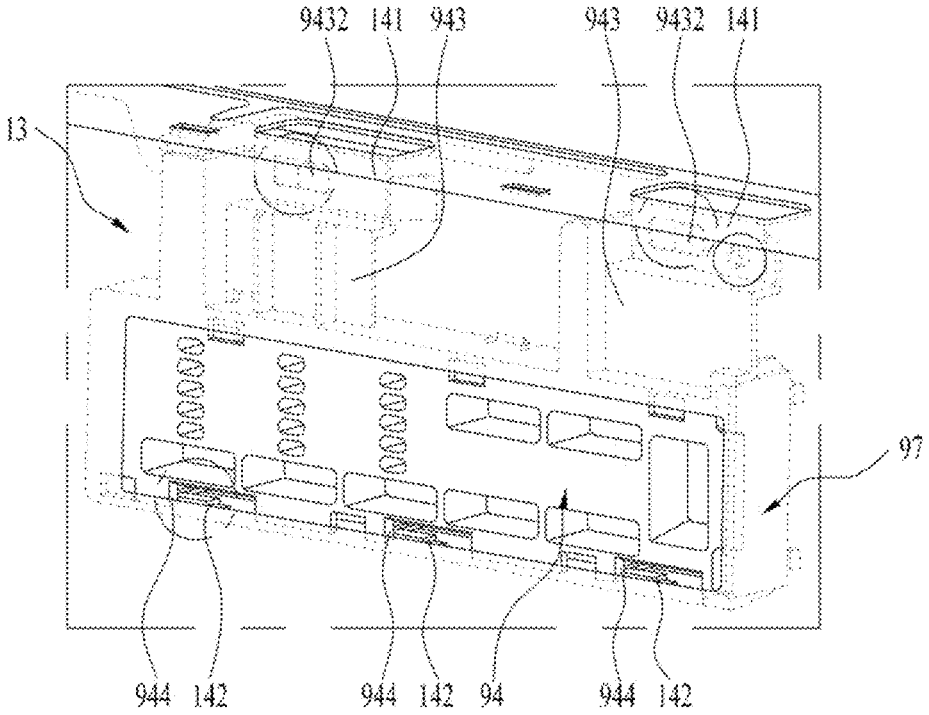
FIG. 12 shows an example of an engagement structure of a board support member and the mounting panel.
Figure 13:
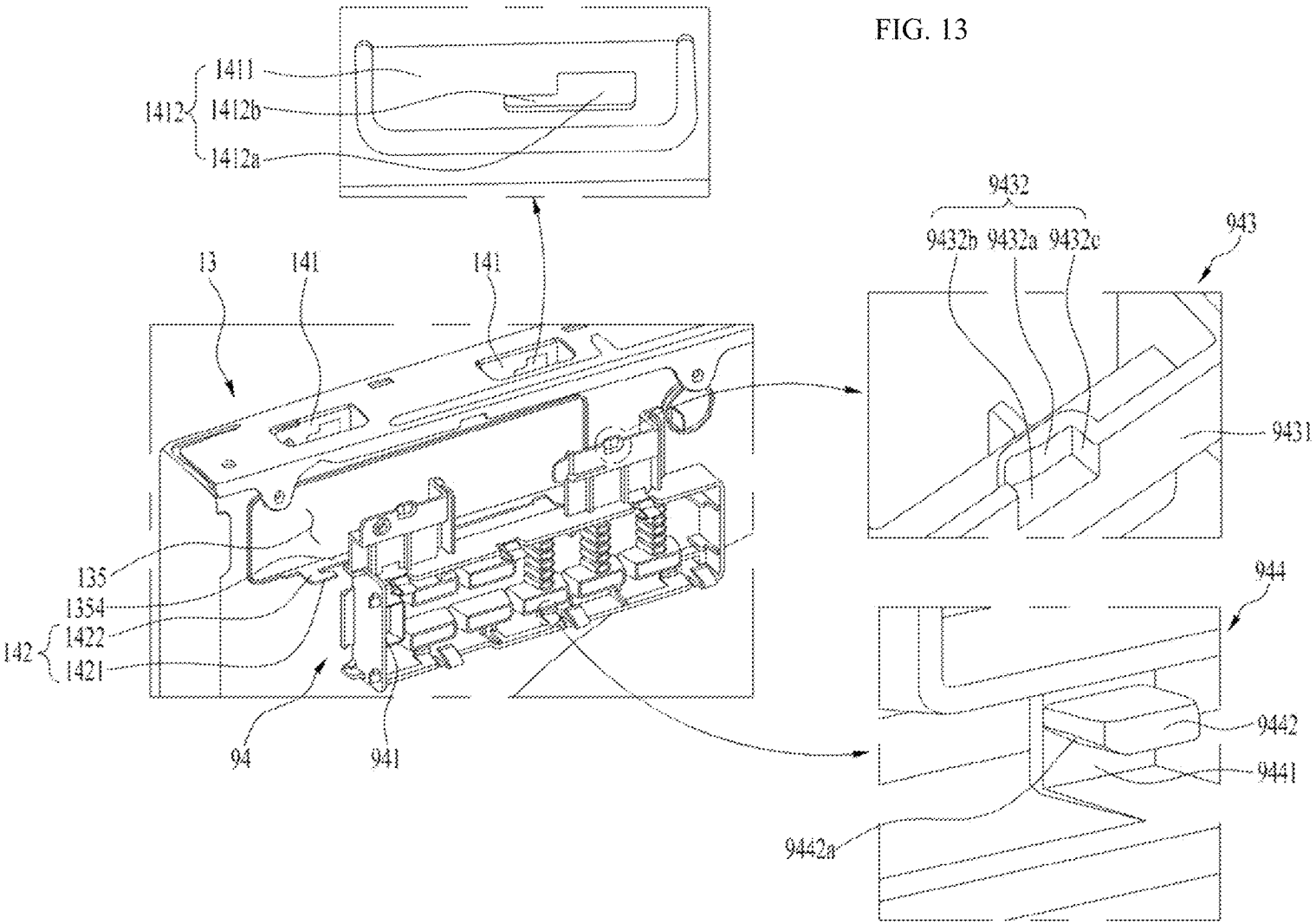
FIG. 13 shows an example of an engagement structure of the board support member and mounting panel, seen from another side.

FIG. 12 shows the board support coupled to the mounting panel 13. FIG. 13 is an exploded perspective view of the mounting panel and board support.

Referring to FIG. 12, the board support 94 may be coupled to an inner side of the mounting panel 13. With the window 91 not installed, a portion of the board support 94 may be exposed through the panel installation hole 135, and the other portion may be covered by the mounting panel 13 and thus not be exposed. The position of the board support 94 covered by the mounting panel 13 is indicated by a dashed line.

Referring to FIGS. 12 and 13, the laundry treatment apparatus 100 according to one embodiment of the present disclosure may include panel seating portions 141 and 142 provided on the mounting panel 13 to which the board support 94 is fixed. The panel seating portions 141 and 142 may position the board support 94 inside the cabinet 1.

The panel seating portions 141 and 142 may be integrally provided in the mounting panel 13. The board support 94 may be directly coupled to the mounting panel 13 by the panel seating portions 141 and 142. Thus, the components of the operation indicator 9, including the control circuit board 95 coupled to the board support 94, may be coupled to the mounting panel 13 without a separate housing. Thus, the space inside the cabinet 1 may be utilized more efficiently. Accordingly, the capacity of the drum 3 may be further secured inside the same cabinet 1.

Specifically, the panel seating portions 141 and 142 may include a first seating portion 141 to which one side of the board support 94 is fixed. Further, the board support 94 may include an installation body 941 that provides a space in which the control circuit board 95 is installed, and a first coupling portion 943 that extends from one surface of the installation body 941 toward the first seating portion 141 and is coupled to the first seating portion 141.

In other words, the first coupling portion 943 may be coupled to the first seating portion 141 to position the installation body 941 inside the cabinet 1. The first coupling portion 943 may also allow the control circuit board 95 installed on the installation body 941 to be positioned inside the cabinet 1.

More specifically, the first seating portion 141 may include an extension body 1411 extending from a top surface of the mounting panel 13 toward the installation body 941, and an extension body through-hole 1412 in which the first coupling portion 943 is coupled. The extension body through-hole 1412 may be formed through the extension body 1411 to form a portion to which the first coupling portion 943 is coupled.

The first seating portion 141 may extend from the top surface of the mounting panel 13 and may be integrated with the top surface of the mounting panel 13. That is, as the first seating portion 141 is integrated with the mounting panel 13, the coupling may be enhanced. Further, the board support 94 may be more reliably supported.

The first seating portion 141 may be formed by bending a portion of the top surface of the mounting panel 13 toward the inside of the cabinet 1. When the first seating portion 141 is formed as described above, a through-hole may be formed in the top surface of the mounting panel 13 provided with the first seating portion 141. However, since the mounting panel 13 may define the exterior of the laundry treatment apparatus 100, the portion at which the first seating portion 141 is formed may be exposed to the outside.

When the space in which the first seating portion 141 is formed is exposed, foreign substances are likely to infiltrate into the cabinet 1 through the through-hole. Further, aesthetics may be degraded. Accordingly, a shielding portion 16 (see FIG. 3) may be coupled to the upper portion of the mounting panel 13.

The shielding portion 16 may be configured to cover the upper portion of the mounting panel 13. The shielding portion 16 may prevent the first seating portion 141 from being exposed to the outside. Thus, foreign substances may be prevented from being introduced through the top surface of the mounting panel 13 provided with the first seating portion 141. Further, various parts may be prevented from being exposed, thereby improving aesthetics.

The first coupling portion 943 may include a connection body 9431 extending from the top surface of the installation body 941 toward the top surface of the mounting panel 13, and a coupling body 9432 protruding from the connection body 9431 toward the extension body 1411 and inserted into the extension body through-hole 1412.

As the first coupling portion 943 includes the connection body 9431 and the coupling body 9432, it may be coupled to the first coupling portion 943. In particular, the connection body 9431 and the coupling body 9432 may be integrally formed to support the installation body 941 on the first seating portion 141.

Specifically, the extension body through-hole 1412 may include an insertion hole 1412*a* into which the coupling body 9432 is inserted, and a support hole 1412*b* arranged in communication with the insertion hole 1412*a* to form a single through-hole with the insertion hole 1412*a*. That is, the support hole 1412*b* may be arranged in contact with the insertion hole 1412*a*.

In other words, the extension body through-hole 1412, which forms one through-hole, may be divided into the insertion hole 1412*a* and the support hole 1412*b* based on the position or function. In particular, the insertion hole 1412*a* may be formed to have an area into which the coupling body 9432 may be inserted. Further, the support hole 1412*b* may be configured to have a smaller area than the insertion hole 1412*a*.

Specifically, the insertion hole 1412*a* may serve as a passage into which the coupling body 9432 is inserted when the first seating portion 141 and the coupling body 9432 are positioned separated. On the other hand, the support hole 1412*b* may serve as a passage through which the coupling body 9432 already inserted into the insertion hole 1412*a* may move.

The coupling body 9432 may include a first body 9432*a* spaced apart from the connection body 9431 and arranged to face the extension body through-hole 1412, a second body 9432*b* connecting the first body 9432*a* to the connection body 9431, and a third body 9432*c* connecting the first body 9432*a*, the second body 9432*b*, and the connection body 9431.

Specifically, the first body 9432*a*, second body 9432*b*, and third body 9432*c* may be connected perpendicularly to each other. The first body 9432*a*, second body 9432*b*, and third body 9432*c* may be integrated with each other. With the first coupling portion 943 coupled to the first seating portion 141, the second body 9432*b* may be positioned in the support hole 1412*b* and the third body may be positioned in the insertion hole 1412*a*.

The first body 9432*a* may restrict movement of the coupling body 9432 in a front-to-back direction. The front-to-back direction may mean the penetration direction of the extension body through-hole 1412. Further, the second body 9432*b* may restrict the vertical movement of the coupling body 9432. Further, the third body 9432*c* may restrict the widthwise movement of the coupling body 9432. The widthwise direction may mean a direction from the insertion hole 1412*a* toward the support hole 1412*b*.

The coupling body 9432 is coupled to the extension body through-hole 1412 in the following procedure. The coupling body 9432 may first be inserted into the insertion hole 1412*a*. At this time, the second body 9432*b* and third body 9432*c* may be positioned in the insertion hole 1412*a*. After the coupling body 9432 is inserted into the insertion hole 1412*a*, the coupling body 9432 may be slid toward the support hole 1412*b*. Once the coupling body 9432 is slid into the support hole 1412*b*, the second body 9432*b* may be positioned in the support hole 1412*b*, and the third body 9432*c* may be positioned at the boundary between the support hole 1412*b* and the insertion hole 1412*a*. The bottom surface of the second body 9432*b* may be supported on the perimeter of the support hole 1412*b* such that the connection body 9431 and the board support 94 may be positioned inside the cabinet 1 without falling down by gravity.

As described above, the structural shape of the first anchoring portion 141 and the first coupling portion 943 may be used to position the board support 94 inside the cabinet 1. Thereby, assemblability may be improved and assembly cost may be reduced. Further, since the first seating portion 141 is integrated with the mounting panel 13, structural stability may be improved.

In addition, the communication module 97 may be coupled to a side surface of the board support 94. The communication module 97 may be coupled to the board support 94 and positioned inside the cabinet 1.

Figure 14:
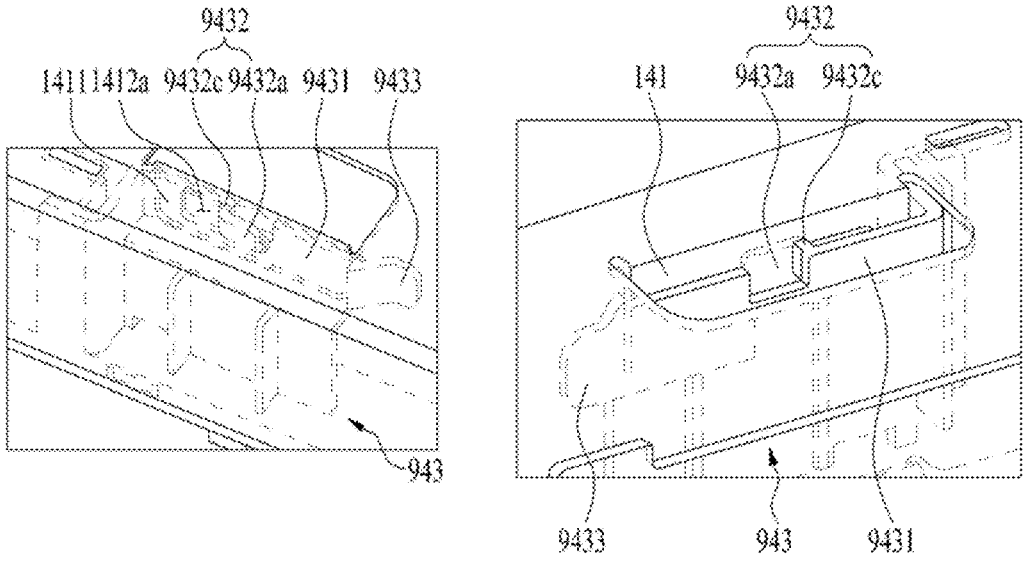
FIG. 14 shows an example of a coupling structure of a first coupling portion.
Figure 15:
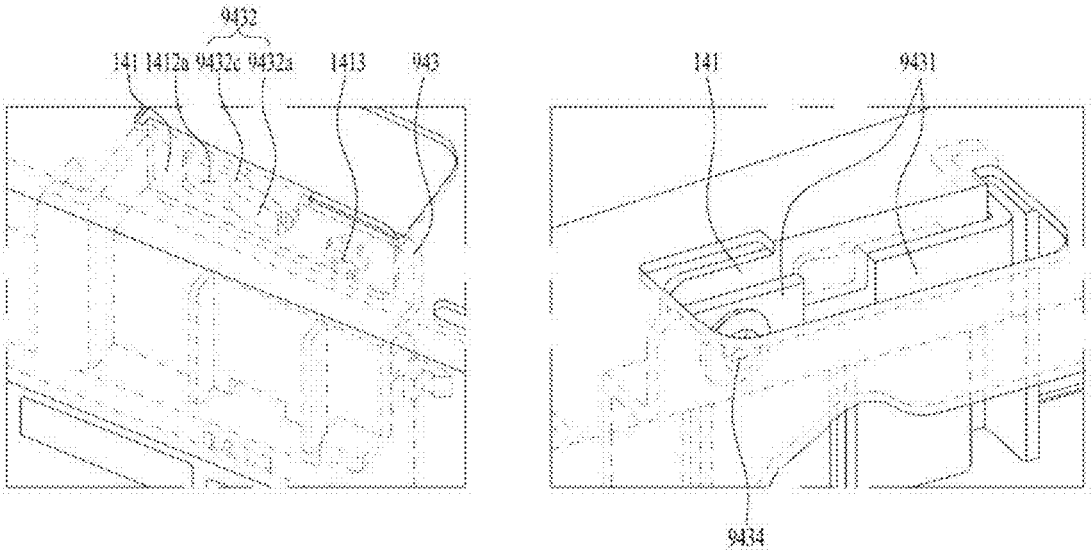
FIG. 15 shows another example of the coupling structure of the first coupling portion.

FIG. 14 is an enlarged view of a first seating portion and a first coupling portion according to one embodiment of the present disclosure. FIG. 15 is an enlarged view of a first seating portion and a first coupling portion according to another embodiment of the present disclosure. When a plurality of first seating portions and a plurality of first coupling portions are provided, the embodiments shown in FIGS. 14 and 15 may be implemented in a single laundry treatment apparatus.

Referring to FIG. 14, the first coupling portion 943 may further include an engagement body 9433 provided to the connection body 9431 to couple the connection body 9431 to the extension body 1411. The engagement body 9433 may be formed of an elastic material and formed in a hook shape removably attached to the extension body 1411.

The engagement body 9433 may be positioned to face the third body 9432*c*. The engagement body 9433 may be spaced apart from the coupling body 9432 to restrict movement of the board support 94. In particular, the engagement body 9433 may restrict movement of the coupling body 9432.

Specifically, the engagement body 9433 may restrict the widthwise movement of the coupling body 9432. As described above, the third body 9432*c* may restrict movement of the coupling body 9432. In particular, the third body 9432*c* may restrict movement in the direction from the insertion hole 1412*a* toward the support hole 1412*b*. On the other hand, the engagement body 9433 may restrict movement in a direction opposite to the direction of movement restricted by the third body 9432*c*. That is, the engagement body 9433 may restrict movement in a direction from the support hole 1412*b* toward the insertion hole 1412*a*.

Thus, the engagement body 9433 may prevent the coupling body 9432 in a slide-coupled position from sliding back out of the support hole 1412*b* toward the insertion hole 1412*a* to be decoupled. Since the engagement body 9433 may be hooked to restrict movement of the coupling body 9432, the board support 94 may be more firmly fixed without the need for a separate coupling member. Accordingly, the assemblability of the laundry treatment apparatus may be improved and the assembly cost may be reduced.

Referring to FIG. 15, the first seating portion 141 may further include an extension body fastening hole 1413 formed through the extension body 1411 in a penetrating manner. Further, the first coupling portion 943 may include a connection body fastening hole 9434 formed through the connection body 9431 in a penetrating manner to communicate with the extension body fastening hole 1413.

The extension body fastening hole 1413 may be spaced apart from the extension body through-hole 1412. In particular, the extension body fastening hole 1413 may be spaced apart from the extension body through-hole 1412 in a direction of slide-coupling of the coupling body 9432.

Further, the connection body fastening hole 9434 may be spaced apart from the connection body 9432. The extension body fastening hole 1413 and the connection body fastening hole 9434 may be joined by a fastening member (not shown) arranged to extend therethrough. The fastening member (not shown) may include a nut and a bolt coupled to each other. However, embodiments are not limited thereto. Various coupling methods may be used.

When the extension body fastening hole 1413 and the connection body fastening hole 9434 are firmly fixed by a coupling member (not shown), the connection body 9432 may be prevented from sliding back from the support hole 1412*b* toward the insertion hole 1412*a*. Thereby, the first seating portion 141 and the first coupling portion 943 may be more firmly fixed. Thus, the stability of the laundry treatment apparatus 100 may be improved.

The extension body 1411 may be formed by bending a portion of the top surface of the mounting panel 13 to be parallel with the mounting plate 138. That is, the first seating portion 141 may be formed by bending a portion of the top surface of the mounting panel 13 toward the inside of the cabinet. When the first seating portion 141 is formed in this way, the structural reliability of the first seating portion 141 may be further improved because the mounting panel 13 and the first seating portion 141 are integrated with each other.

A plurality of first seating portion 141 may be provided. Specifically, the plurality of first seating portions 141 may be spaced apart from each other. Also, a plurality of first coupling portions 943 may be provided. The number of the first coupling portions 943 may correspond to the number of the first seating portions 141.

When a plurality of the first seating portions 943 is provided, one first coupling portion 943 may include the engagement body 9433 and another first coupling portion 943 may include the connection body fastening hole 9434. In this case, the first seating portion 141 may include as many extension body fastening holes 1413 as the connection body fastening holes 9434.

By providing the engagement body 9433, assemblability may be improved. Also, by providing the connecting body fastening holes 9434, structural stability may be improved. Accordingly, by providing both the engagement body 9433 and the connection body fastening hole 9434, assemblability and structural stability may be improved.

Referring back to FIGS. 12 and 13, separately from the first seating portion 141 to which one side of the board support 94 is coupled, the panel seating portion 14 may include a second mounting portion 142 to which the opposite side of the board support 94 is coupled. Further, separately from the first coupling portion 943 provided on one side of the installation body 941, the board support 94 may include a second coupling portion 944 provided on the opposite side of the installation body.

Figure 16:
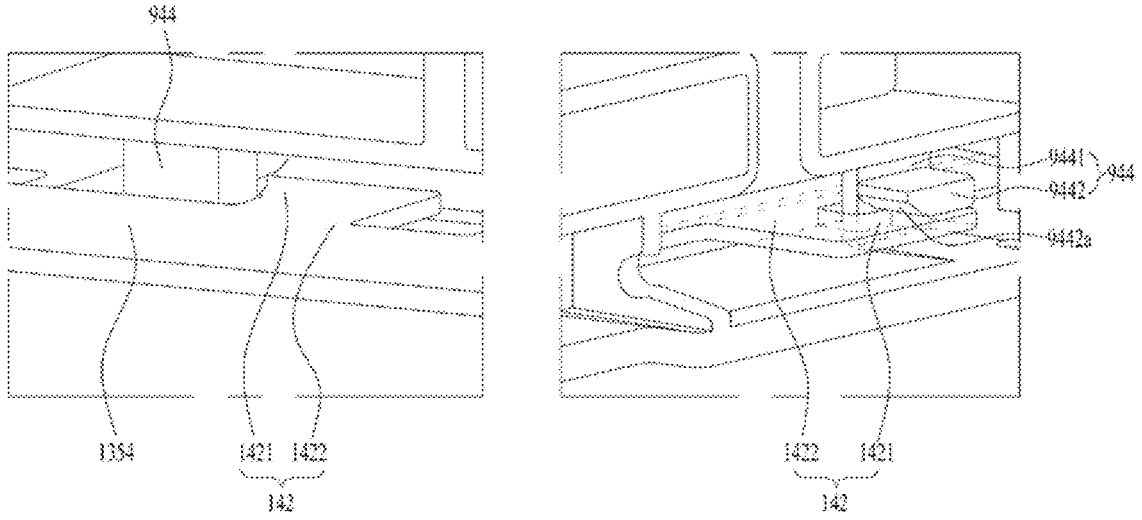
FIG. 16 shows an example of a coupling structure of a second coupling portion.

FIG. 16 is an enlarged view of the second coupling portion coupled to the second seating portion. Hereinafter, description will be given with reference to FIGS. 12, 13, and 16.

The second coupling portion 944 may be coupled to the second seating portion 142 to position the installation body 941 inside the cabinet 1. In particular, the second coupling portion 944 may be positioned between the window 91 and the control circuit board 95.

The second seating portion 142 may extend from the coupling rib 1354 supporting the bottom surface of the window 91 toward the installation body 941. In particular, the second seating portion 142 may extend from the coupling rib 1354 toward the second coupling portion 944.

Specifically, the second seating portion 142 may include a first rib 1421 spaced apart from the coupling rib 1354, and a second rib 1422 connecting the coupling rib 1354 to the first rib 1421. The first rib 1421 and second rib 1422 may be arranged perpendicular to each other. Thus, a space in which the second coupling portion 944 is seated may be formed between the coupling rib 1354, the first rib 1421, and the second rib 1422.

The second coupling portion 944 may include an engagement rib 9441 provided on the lower side of the installation body 941 and positioned between the first rib 1421 and the coupling rib 1354, and an engagement protrusion 9442 protruding from the engagement rib 9441 to contact the first rib 1421. The engagement rib 9441 may be positioned in a space formed between the coupling rib 1354, the first rib 1421, and the second rib 1422.

The engagement rib 9441 may be slidably coupled to the second resting portion 142. In particular, the engagement rib 9441 may be coupled by sliding toward the second rib 1422 in a hook-shaped open portion formed by the coupling rib 1354, the first rib 1421, and the second rib 1422.

Once the engagement rib 9441 is slidably coupled to the second seating portion 142, the coupling rib 1354 may restrict movement of the engagement rib 9441 toward the window. In addition, the first rib 1421 may restrict movement of the engagement rib 9441 in a direction away from the window.

Additionally, the second coupling portion 944 may include an engagement protrusion 9442 protruding from the engagement rib 9441. The engagement protrusion 9442 may contact the first rib 1421 with the second coupling portion 944 coupled to the second resting portion 142. In particular, the engagement protrusion 9442 may be positioned above the first rib 1421. The engagement protrusion 9442 may be restricted from moving downward by the first rib 1421. Accordingly, the engagement rib 9441 connected to the engagement protrusion 9442 may also be restricted from moving downward. That is, the engagement protrusion 9442 may contact the first rib 1421 to restrict the downward movement of the board support 94 by gravity.

By the above-described structure of the second seating portion 142 and the second coupling portion 944, the second coupling portion 944 may prevent the board support 94 from being displaced from its coupling position within the cabinet 1, without using a separate coupling member. Thus, the assemblability and structural stability of the laundry treatment apparatus may be improved.

The engagement protrusion 9442 may further include a guide surface 9442*a* provided to one surface facing the first rib 1421. The guide surface 9442*a* may be inclined upward toward the second rib 1422. The guide surface 9442*a* may guide the engagement protrusion 9442 to be aligned in position before the second coupling portion 944 is slidably coupled to the second seating portion 142.

Specifically, when the engagement protrusion 9442 is slid toward the coupling position with the guide surface 9442*a* in contact with the free end of the first rib 1421, the engagement protrusion 9442 will naturally move to the top of the first rib 1421 along the guide surface 9442*a*. Thus, the assemblability for coupling the second coupling portion 944 to the second seating portion 142 may be improved. That is, the guide surface 9442*a* may shorten the assembly time for the second coupling portion 944, thereby reducing assembly cost.

When the first coupling portion 943 is slidably coupled to the first seating portion 141, the second coupling portion 944 may also be slidably coupled to the second seating portion at the same time. The first coupling portion 943 and the second coupling portion 944 may be disposed at positions corresponding to the positions of the first seating portion 141 and second seating portion 142, respectively. Thereby, the assemblability of the board support 94 may be improved.

Hereinafter, the overall process of coupling the board support 94 to the panel mounting member 14 will be described. First, the coupling body 9432 is inserted into the insertion hole 1412*a*. At this time, the engagement rib 9441 is positioned spaced apart from the second seating portion 142. Then, by sliding the coupling body 9432 toward the support hole 1412*b*, the engagement body 9433 is engaged with one side of the extension body 1411. Then, the connection body fastening hole 9434 is arranged at a position where it communicates with the extension body fastening hole 1413. Further, when the coupling body 9432 is slid toward the support hole 1412*b*, the engagement rib 9441 is positioned between the coupling rib 1354 and the first rib 1421. Then, the engagement rib 9442 contacts an upper portion of the first rib 1421. Through the above-described process, the board support 94 may be firmly fixed to the panel seating portions 141 and 142. Thereby, the control circuit board 95 supported on the board support 94, and the information output unit 92 may be arranged at correct positions inside the cabinet 1. That is, the stability of the entire laundry treatment apparatus may be secured.

Figure 17:
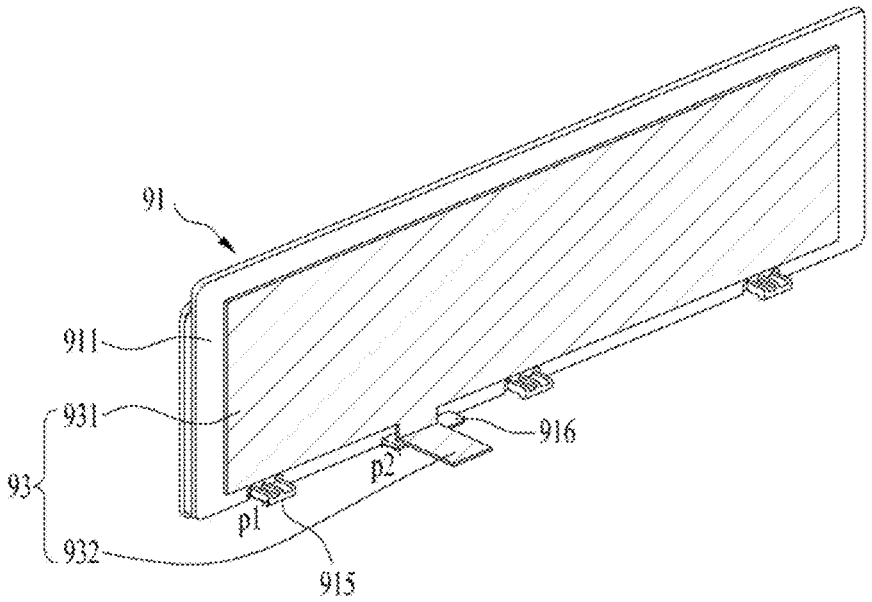
FIG. 17 shows an example of a combination of a window and a touch film.
Figure 17:
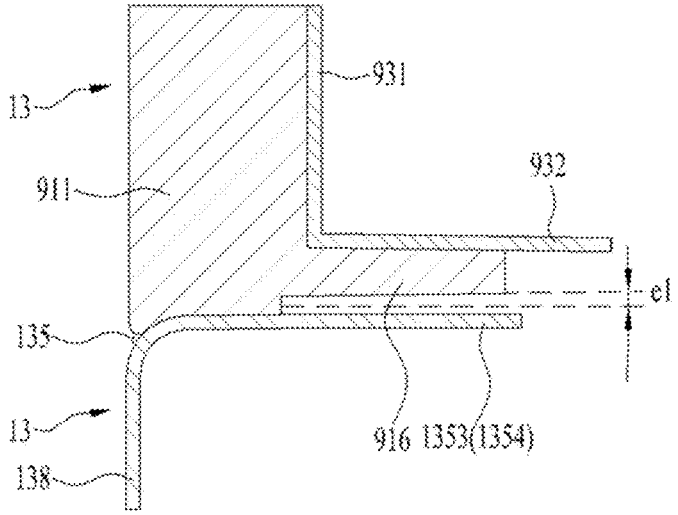

FIG. 17 is a perspective view and sectional view illustrating a combination of a window and a touch film.

The laundry treatment apparatus 100 according to one embodiment of the present disclosure may allow a user to input a control instruction by touching the window 91. In this case, a touch film 93 may be fixed on the window 91. In particular, the touch film 93 may be fixed on one surface opposite to the surface exposed to the outside of the cabinet 1. The touch film 93 may be connected to the control circuit board 95. When the user touches the window 91 exposed to the outside of the cabinet 1, a capacitive signal may be generated, and the touch film 93 may sense the capacitive signal. The sensed capacitive signal is delivered to the control circuit board 95, and the control circuit board 95 may sense a control input according to the position of the user's touch.

The window 91 may be formed of a non-conductive material, and the touch film 93 may be formed of a conductive material. The window 91 may be formed of a non-conductive material to have a preset thickness. The preset thickness may mean a thickness allowing a touch signal input on one surface to be sensed by the touch film 93 fixed on the opposite surface.

More specifically, the touch film 93 may include a film sensor 931 fixed to the window body 911 to sense whether a user's body contacts the window body 911, and a film wire 932 connecting the film sensor 931 to the control circuit board 95.

In particular, the film sensor 931 may be fixed to a surface of the window body 911 facing the side on which the control circuit board 95 is positioned. As described above, the film sensor 931 may be formed in a thin film shape. In addition, the film sensor 931 may be formed of a flexible material.

Further, the film wire 932 may extend from one side of the film sensor 931 and be connected to the control circuit board 95. The film wire 932 may be formed of the same flexible material as the film sensor 931. Thus, the film wire 932 may be connected to the control circuit board 95 by extending through or around a structure positioned between the film sensor 931 and the control circuit board 95.

Since the film sensor 931 and film wire 932 are configured to transmit a capacitive signal generated by the user's body to the control circuit board 95, they may be formed of a conductive material. Therefore, when the film sensor 931 or the film wire 932 comes into contact with the mounting panel 13 formed of a metal material, the electrical signal may be disturbed. That is, when the film wire 932 comes into contact with the mounting panel 13 on the path leading to the control circuit board 95, the control circuit board 95 may fail to accurately sense the user's touch input.

To address the above-described issue, the window 91 may include a window guide 916 that prevents the film wire 932 from contacting the mounting panel 13.

The window guide 916 may protrude from the window body 911 toward the control circuit board 95. Specifically, the window guide 916 may be positioned between the film wire 932 and the mounting panel 13. The film wire 932 may contact the window guide 916 and extend in a direction away from the mounting panel 13.

The window guide 916 may be formed of a non-conductive material such that electrical signals are prevented from being disturbed by a contact between the film wire 932 and the conductive material. The figure shows that the window guide 916 is positioned on the lower side surface of the window body 911, and the film wire 932 is seated on the top surface of the window guide 916. However, embodiments are not limited thereto. The window guide 916 may be positioned at various positions to prevent the film wire 932 from contacting the mounting panel 13.

The coupling rib 1354 may support the window body 911. Since the coupling rib 1354 may constitute part of the mounting panel 13, electrical signals may be disturbed when the film wire 932 contacts the coupling rib 1354. Accordingly, the window guide 916 may be positioned to overlap with the coupling rib 1354 in the height direction to prevent the film wire 932 from contacting the coupling rib 1354. In particular, the window guide 916 may be disposed between the film wire 932 and the coupling rib 1354 to prevent the film wire 932 from contacting the coupling rib 1354.

As described above, the window 91 may further include a window coupling portion 915 that fixes the window body 911. The window coupling portion 915 may fix the window body 911 such that the window body 911 is positioned in the panel installation hole 135.

The window coupling portion 915 may extend from the window body 911 to the side on which the control circuit board 95 is positioned. The window coupling portion 915 may extend in parallel with the window guide 916.

Figure 18:
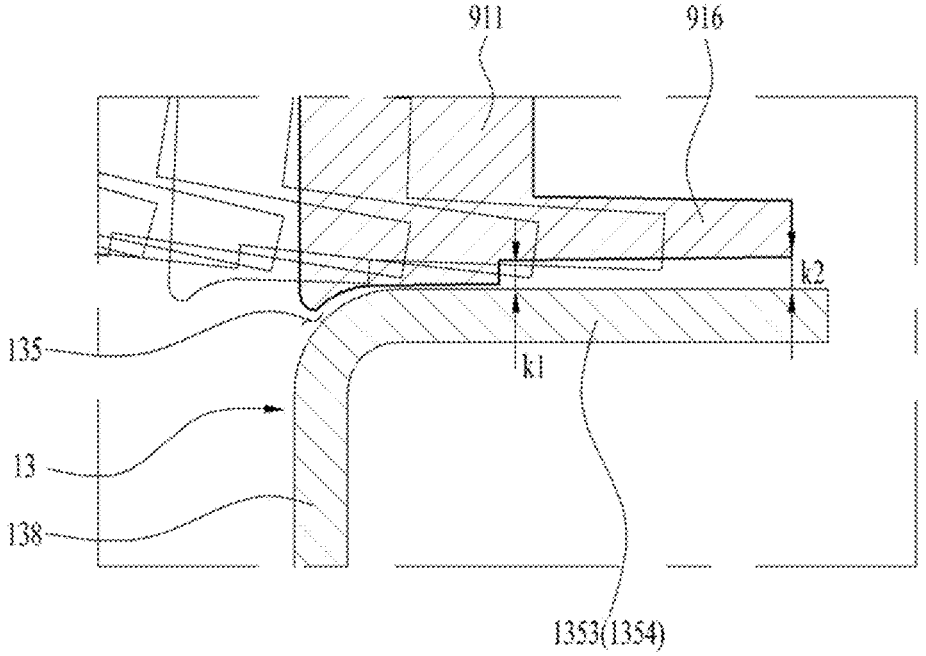
FIG. 18 illustrates an example of a process of coupling the window.

FIG. 18 illustrates a process of coupling the window 91 to the mounting panel 13.

Referring to FIGS. 17 and 18, in installing the window 91 on the mounting panel 13, the upper side of the window 91 may first be inserted into the panel installation hole and the lower side of the window 91 may be rotated around the center of rotation at the upper side of the window 91 as described above.

Specifically, referring to FIG. 9 together, the window body 911 of the window 91 may include the outer extension 912 and the inner extension 913. The inner extension 913 may extend upward from the upper side surface of the window body 911. Also, the window guide 916 may be provided on the lower side surface of the window body 911.

In the process of coupling the window 91, the inner extension 913 may be positioned inside the cabinet 1, and the window body may be rotated around the inner extension 913, which is the center of rotation. When the window 91 is coupled as described above, the window 91 may be coupled to the mounting panel 13 without a separate fastening member, and the assembly position may be adjusted based on the position of the inner extension 913. Accordingly, assemblability may be improved and assembly cost may be reduced.

In coupling the window 91 as described above, the window guide 916 disposed on the lower side of the window body 911 may interfere with the coupling rib 1354. Thus, the window guide 916 may be damaged or the coupling rib 1354 may be scratched.

In order to prevent the above-mentioned issue from occurring, the extension length p2 of the window guide may be set less than or equal to the extension length p1 of the window coupling portion. By configuring the window guide 916 as described above, damage to the window guide 916 or the coupling rib 1354 may be prevented.

Further, the free end of the window guide 916 may be positioned farther from the control circuit board 95 than the free end of the coupling rib 1354. In the case where the window guide 916 is positioned closer to the control circuit board 95 than the coupling rib 1354, the window guide 916 may be damaged during assembly of the window 91. Therefore, to prevent such an issue from occurring, the extension length of the window guide 916 may be adjusted as described above.

However, embodiments are not limited to the above example. The free end of the window guide 916 may be positioned closer to the control circuit board 95 than the free end of the coupling rib 1354 when there is no risk of causing damage to the window guide 916 during the assembly of the window 91.

The window guide 916 may be formed in a thin plate shape. Accordingly, when the window guide 916 contacts the coupling rib 1354, the current signal may be disturbed even though the film wire 932 is spaced apart from the coupling rib 1354. To prevent this situation, the window guide 916 may be spaced apart from the coupling rib 1354 by a predetermined distance.

When the window guide 916 is spaced apart from the coupling rib 1354, the window guide 916 may be further prevented from being damaged in the process of installing the window 91 on the mounting panel 13. Thereby, the assemblability of the window 91 may be improved, and the electrical signal transmitted through the film wire 932 may be prevented from being disturbed.

Referring to FIG. 18, in the process of installing the window 91, the free end of the window guide 916 is moved toward the coupling rib 1354 and then moved away from the coupling rib 1354 after passing a certain point.

To improve the assemblability of the window 91 and to prevent parts from being damaged, the window guide 916 may be arranged not to contact the coupling rib 1354 during assembly.

Referring to FIGS. 17 and 18, one surface of the window guide 916 facing the coupling rib 1354 may extend to be inclined upward from the window body 911 toward the control circuit board 95.

One surface of the window guide 916 facing the coupling rib 1354 may form a predetermined angle E1 with the coupling rib 1354. The one surface may be inclined upward from the window body 911 toward the control circuit board 95 to prevent the window guide 916 from contacting the coupling rib in the process of coupling the window 91.

The spacing distance between the window guide 916 and the coupling rib 1354 may increase as the distance from the window body 911 increases. The spacing distance k1 between the coupling rib 1354 and a portion of the window guide 916 disposed closer to the window body 911 may be less than the spacing distance k2 between the coupling rib 1354 and a portion of the window guide 916 disposed farther from the window body 911. The spacing distances k1 and k2 may increase with the increase in distance from the window body to prevent the window guide 916 from contacting the coupling rib 1354 during installation of the window 91.

Figure 19:
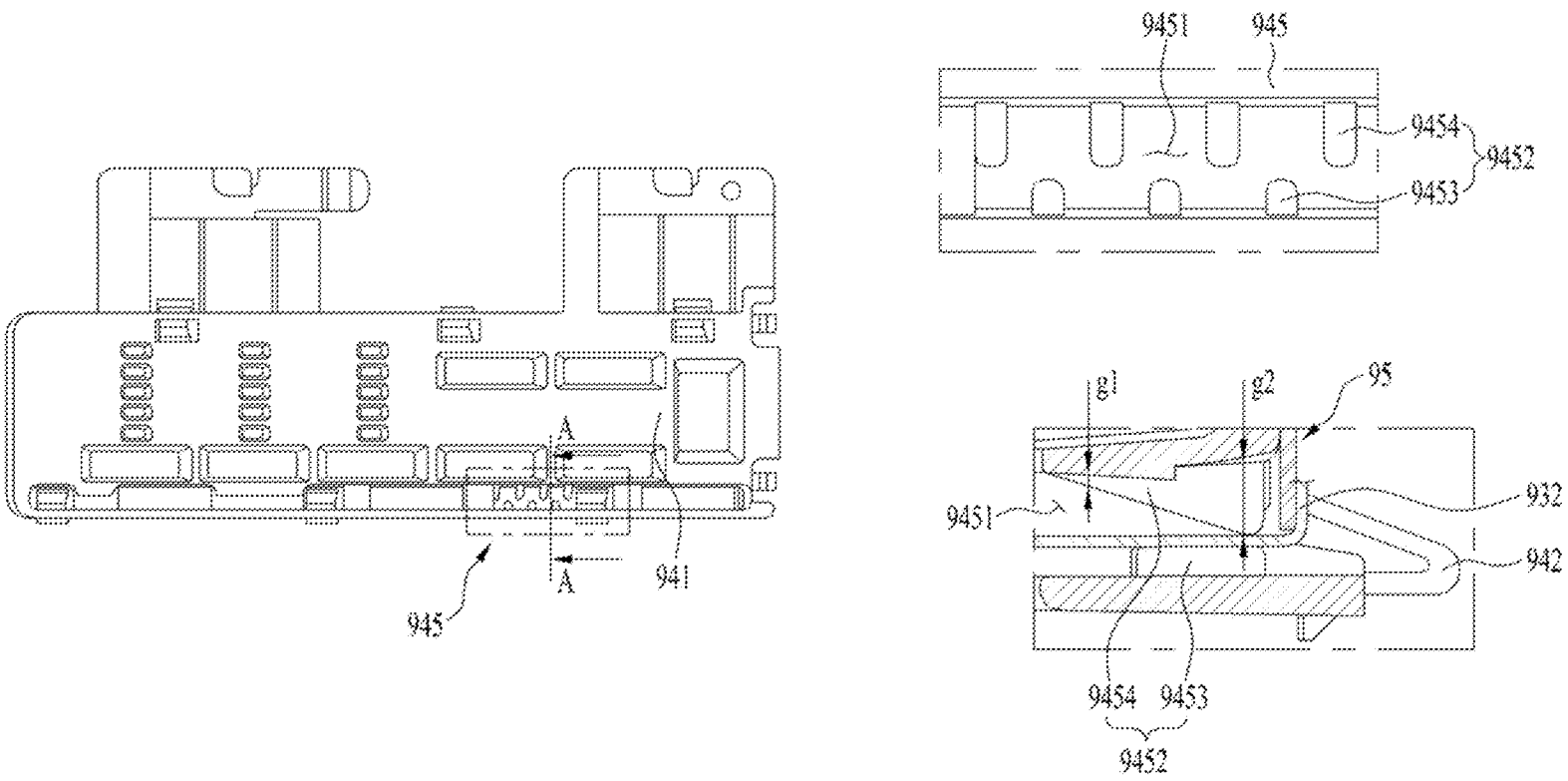
FIG. 19 shows an example of a wire passage.

FIG. 19 shows a board support according to one embodiment of the present disclosure. In particular, a wire passage provided in the board support is shown in detail.

Figure 20:
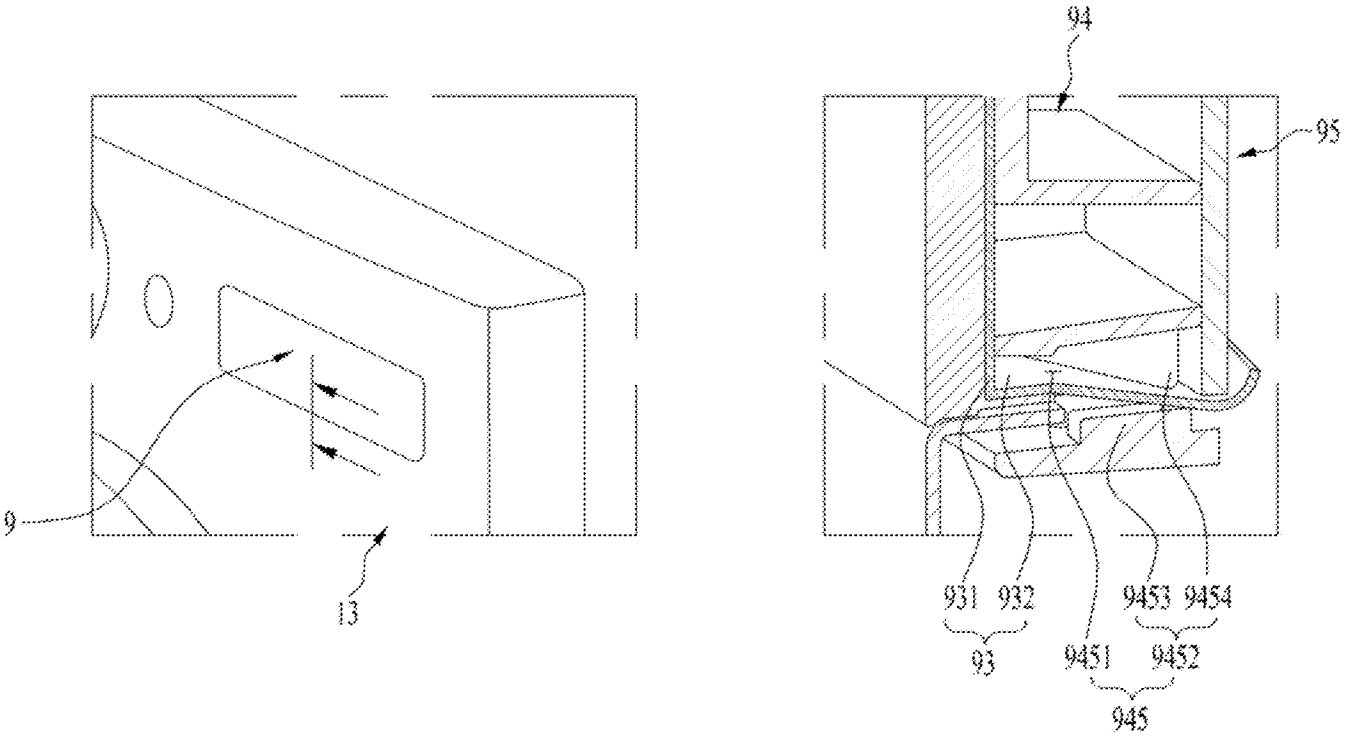
FIG. 20 is a cross-sectional perspective view of an example of the wire passage.

FIG. 20 is a cross-sectional view illustrating a film wire connected to a control circuit board through a wire passage according to one embodiment of the present disclosure.

Referring to FIG. 6, the board support 94 is disposed between the control circuit board 95 and the film sensor 931. Therefore, in order for the film wire 932 to connect the film sensor 931 to the control circuit board 95, the film wire 932 should extend around or through the board support 94.

When the film wire 932 extends around the board support 94, the film wire 932 may extend along an outer surface of the board support 94. Accordingly, the length of the film wire 932 may be increased, and the film wire 932 may contact the mounting panel 13. When the length of the film wire 932 is increased or the film wire 932 comes into contact with the mounting panel 13, the reliability of the electrical signal transmitted through the film wire 932 may be lowered.

In addition, the film wire 932 may rub or interfere with the portion of the board support 94 coupled to the mounting panel 13 while extending around the board support 94. Accordingly, there is a risk of tearing or damaging the film wire 932.

Therefore, in the case where the film wire 932 extends around the board support 94 in connecting the film sensor 931 and the control circuit board 95, the reliability and durability of the film wire 932 may be reduced.

In other words, it may be preferred in terms of reliability and durability of the film wire 932 to connect the film sensor 931 and the control circuit board 95 by extending the film wire 932 through the board support 94.

In accordance with the need as described above, the board support 94 according to one embodiment of the present disclosure may further include a wire passage 945 through which the film wire 932 extends. The wire passage 945 may extend through the installation body 941. The installation body 941 may be formed in a penetrated manner, and the film wire 932 may be connected to the control circuit board 95 through the wire passage 945.

As the wire passage 945 is provided, the film wire 932 may not need to extend around the board support 94 to connect the film sensor 931 to the control circuit board 95. Thus, the reliability and durability of the film wire 932 is improved.

Specifically, the wire passage 945 may include a wire passing hole 9451 formed through the installation body 941.

Specifically, the wire passing hole 9451 may be formed through the installation body 941 so as to be spaced apart from the light emitting member insertion hole 947. Further, the wire passing hole 9451 may be positioned closer to the film wire 932 than the light emitting member insertion hole 947. In addition, the wire passing hole 9451 may be disposed below the light emitting member insertion hole 947. The wire passing hole 9451 may have a larger area than the light emitting member insertion hole 947.

That is, the wire passing hole 9451 may be formed through the installation body 941 separately from the light emitting member insertion hole 947. In addition, the wire passing hole 9451 may be arranged close to the film wire 932 to prevent unnecessary extension of the length of the film wire 932. Further, the wire passing hole 9451 may be formed to have an area allowing the film wire 932 to be inserted thereinto.

Further, the wire passage 945 may include wire protrusions 9452 positioned along the perimeter the wire passing hole 9451 to determine the position of the film wire 932.

The film wire 932 may extend through the wire passing hole 9451 and extend not around but through the installation body 941 to connect the film sensor 931 to the control circuit board 95.

The wire protrusions 9452 may protrude from the perimeter of the wire passing hole 9451 toward the film wire 932. The film wire 932 may be positioned by a contact with the wire protrusions 9452.

The wire protrusions 9452 may support the film wire 932 such that the film wire 932 is fixed at a position without moving in the wire passing hole 9451. In the case where the film wire 932 moves in the wire passing hole 9451, it may contact other components, thereby reducing reliability and durability. The wire protrusions 9452 may restrict movement of the film wire 932 in the wire passing hole 9451, thereby improving reliability and durability of the film wire 932.

Further, the wire protrusions 9452 may include a spacing protrusion 9453 provided to support the film wire 932, and a guide protrusion 9454 provided to guide the film wire 932 to be inserted into the wire passing hole 9451.

The spacing protrusion 9453 may protrude toward the film wire 932 from a surface on one side of the perimeter of the wire passing hole 9451. Further, the guide protrusion 9454 may protrude from a surface on the opposite side of the perimeter of the wire passing hole 9451 toward the film wire 932.

The guide protrusion 9454 and the spacing protrusion 9453 may be arranged at positions facing each other. In particular, the film wire 932 may be inserted into the wire passing hole 9451 and positioned between the spacing protrusion 9453 and the guide protrusion.

In other words, one side of the film wire 932 may be supported on the spacing protrusion 9453 and the opposite side thereof on the guide protrusion 9454. In other words, as both sides of the film wire 932 are supported by the spacing protrusion 9453 and the guide protrusion 9454, the position of the film wire in the wire passing hole 9451 may be determined.

More specifically, the spacing protrusion 9453 may protrude upward from the surface on the bottom side of the perimeter of the wire passing hole 9451, and the guide protrusion 9454 may protrude downward from the surface on the top side of the perimeter of the wire passing hole 9451.

That is, the spacing protrusion 9453 may support the bottom surface of the film wire 932 to restrict downward movement of the film wire 932. On the other hand, the guide protrusion 9454 may support the top surface of the film wire 932 to restrict upward movement of the film wire 932.

When the film wire 932 is positioned close to the bottom side of the perimeter of the wire passing hole 9451, the film wire 932 may contact the mounting panel 13 and thus cause electrical signals to be disturbed. Accordingly, the spacing protrusion 9453 may position the film wire 932 to be spaced apart by a predetermined distance from the bottom side of the perimeter of the wire passing hole 9451. Thereby, the reliability of the film wire 932 may be improved.

Further, in the case where the film wire 932 is positioned close to the top side of the perimeter of the wire passing hole 9451, the film wire 932 may not pass smoothly through the wire passing hole 9451 and may interfere with the control circuit board 95. Accordingly, the guide protrusion 9454 may position the film wire 932 to be spaced apart by a predetermined distance from the top side of the perimeter of the wire passing hole 9451. Thereby, the film wire 932 may be allowed to easily pass through the wire passing hole 9451. Accordingly, assemblability may be improved, and assembly cost may be reduced.

Multiple guide protrusions 9454 and multiple spacing protrusions 9453 may be provided. The guide protrusions 9454 may be spaced apart from each other along the perimeter of the wire passing hole 9451. The spacing protrusions 9453 may also be spaced apart from each other along the perimeter of the wire passing hole 9451.

Specifically, the spacing protrusions 9453 may be spaced apart from each other in a direction orthogonal to the direction in which the film wire 932 is inserted. The guide protrusions 9454 may also be spaced apart from each other in the same manner as in the case of the spacing protrusions 9453.

As multiple spacing protrusions 9453 and multiple guide protrusions 9454 are provided, the position of the film wire 932 may be more securely set. Accordingly, the durability and reliability of the film wire 932 may be further improved.

Further, the guide protrusions 9454 and the spacing protrusions 9453 may be arranged not to overlap each other in a direction in which the guide protrusions 9454 are spaced apart from each other. In other words, the guide protrusions 9454 and the spacing protrusions 9453 may be arranged such that they do not overlap each other in the width direction of the wire passing hole 9451. Specifically, the sum of the protrusion height of the guide protrusions 9454 and the protrusion height of the spacing protrusions 9453 may be less than the height of the wire passing hole 9451.

In the case where the guide protrusions 9454 and the spacing protrusions 9453 overlap each other in the width direction of the wire passing hole 9451, the film wire 932 may be positioned between the spacing protrusion 9453 and the guide protrusion 9454 and thus be crumpled. In this case, the reliability and durability of the film wire 932 may be reduced.

Therefore, it may be preferred to adjust the protrusion heights of the guide protrusions 9454 and the spacing protrusions 9453 such that the protrusions do not overlap in the width direction of the wire passing hole 9451.

Further, the guide protrusions 9454 may be arranged such that they are prevented from overlapping the spacing protrusions 9453 in the height direction. In other words, the guide protrusions 9454 and the spacing protrusions 9453 may be arranged to be alternated along the width direction of the wire passing hole 9451.

In the case where the guide protrusions 9454 and the spacing protrusions 9453 are arranged to overlap in the height direction, the path through which the film wire 932 may extend may be narrowed. Accordingly, the assemblability for coupling of the film wire 932 to the wire passage 945 may be lowered.

Accordingly, the guide protrusions 9454 may be disposed such that they are prevented from overlapping the spacing protrusions 9453 in the height direction. Thereby, the assemblability of the film wire 932 may be improved.

One surface of the guide protrusion 9454, which is positioned to face the film wire 932, may be inclined. More specifically, when the guide protrusion 9454 is positioned on the top side surface of the wire passing hole 9451, one surface of the guide protrusion 9454 may be inclined downward to extend toward the control circuit board 95.

Further, the protrusion height g2 of the portion of the guide protrusion 9454 positioned closer to the control circuit board 95 may be greater than the protrusion height g1 of the portion positioned farther from the control circuit board 95.

In other words, the guide protrusions 9454 may limit the range of movement of the film wire 932 in the wire passing hole 9451. In this regard, it may limit the range of movement of the film wire 932 to be small for a portion disposed farther from the control circuit board 95, and may limit the range of movement of the film wire 932 to be large for a portion disposed closer to the control circuit board 95.

In other words, the guide protrusions 9454 may improve assemblability by allowing the film wire 932 to move in a large area when the film wire 932 is inserted into the wire passing hole 9451. On the other hand, as the film wire 932 is inserted into the wire passing hole 9451 and brought closer to the control circuit board 95, the range of movement of the film wire 932 may be further limited. Thereby, structural stability and reliability of the film wire 932 may be improved.

A process in which the film wire 932 is connected to the control circuit board 95 through the wire passage 945 is described below. First, the film wire 932 may be inserted into the wire passing hole 9451. Subsequently, the film wire 932 may contact the inclined surface of the guide protrusions 9454. As the film wire 932 continues to be inserted while the film wire 932 is in contact with the guide protrusions 9454, the film wire 932 may naturally move along the inclined surface toward the drum 3. Then, when the free end of the film wire 932 has completely passed through the wire passing hole 9451, the free end may be connected to the control circuit board 95.

Once the film wire 932 is connected to the control circuit board 95, one side surface of the film wire 932 may contact the spacing protrusions 9453 and the opposite side surface thereof may contact the guide protrusions 9454. Through a series of steps, the film wire 932 may be positioned within the wire passing hole 9451.

As described above, the guide protrusions 9454 may guide the film wire 932 through the wire passing hole 9451 during the insertion of the film wire 932 such that the film wire 932 is not caught or obstructed by the internal components. Thus, assemblability may be improved.

The wire passage 945 may be arranged to face the window guide 916. The film wire 932 may be connected to the control circuit board through the window guide 916 and the wire passage 945.

In other words, the window guide 916 may be configured to protrude toward the wire passage 945 from one surface of the window body 911 facing the wire passage 945.

Specifically, the film wire 932 may extend from the film sensor 931 and be guided to the wire passing hole 9451 along the window guide 916. In particular, the film wire 932 may be inserted into the wire passing hole 9451 with the bottom surface thereof supported by the window guide 916. The bottom surface of the film wire 932 positioned in the wire passing hole 9451 may be supported by the spacing protrusions 9453. Thus, the film wire 932 may be connected to the control circuit board 95 without being excessively folded or bent.

Figure 21:
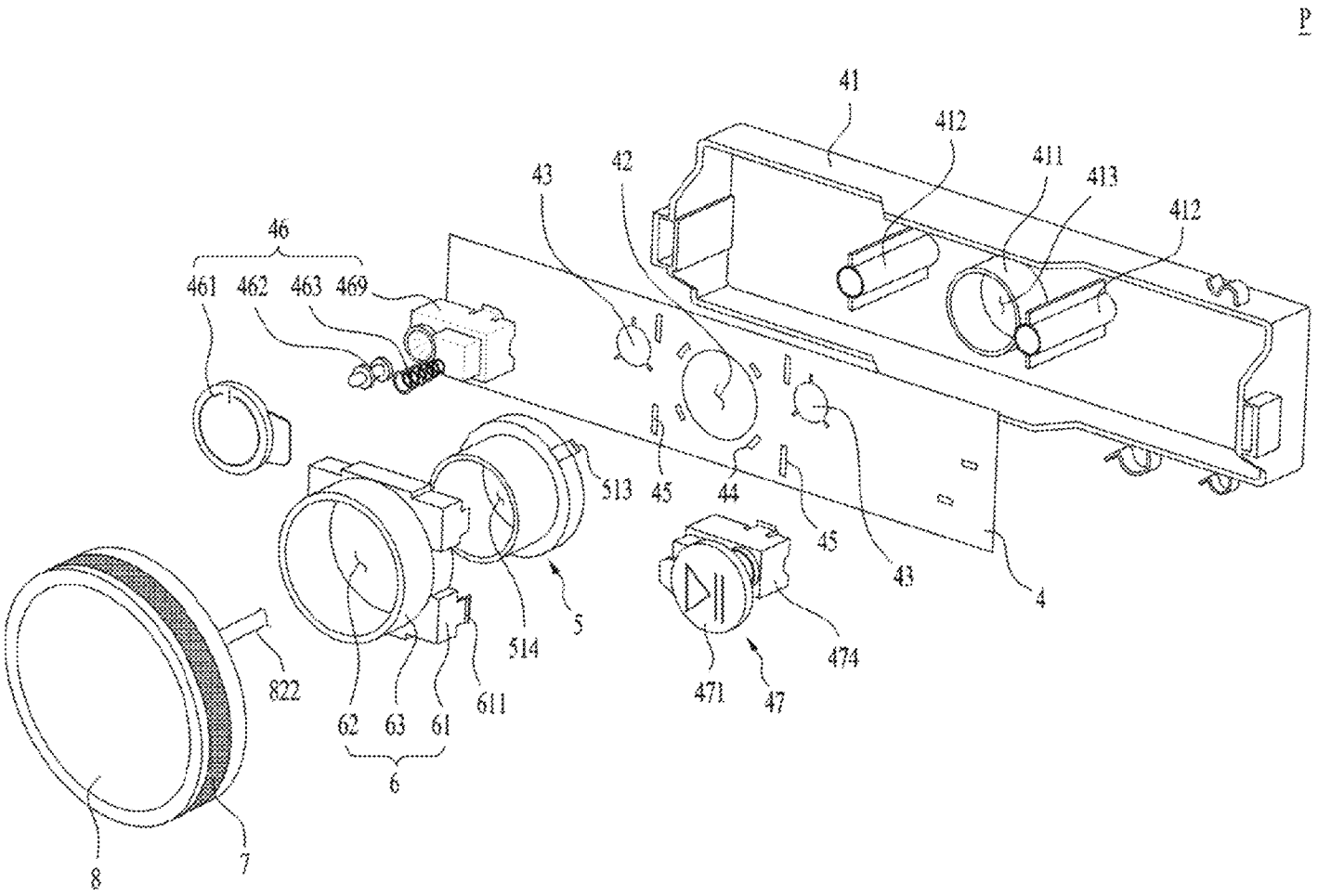
FIG. 21 shows a structure of an interface.

As shown in FIG. 21, the interface P may include a circuit board (first circuit board) 4 disposed inside the cabinet 1, an encoder 5 fixed to the circuit board and disposed inside the cabinet 1, an actuator 7 connected to the encoder 5 through the mounting panel 13, and an indicator 8 fixed to the encoder 5 or the first circuit board 4 through the mounting panel 13.

The first circuit board 4 is a substrate on which control circuits necessary for the control (power control or operation control) of at least one of the drive unit 32, the water supply valve 233 and the pump 252 are arranged, and may be fixed to the mounting panel 13 or the panel support 12 through a case 41.

The case 41 may have any shape as long as it allows the first circuit board 4 to be fixed to the mounting panel 13 or the panel support 12. FIG. 21 illustrates an example of the case 41 formed in the shape of a hexahedron with one side (the side facing the panel support) open.

The case 41 may be provided with a boss for positioning the first circuit board 4. FIG. 21 illustrates an example case where the boss includes a first boss 411 and a second boss 412. In this case, the first circuit board 4 may include a board through-hole 42 through which the first boss 411 is arranged, and a boss insertion hole 43 through which the second boss 412 is arranged. The second boss 412 may be disposed in the space on both left and right sides of the first boss 411, or may be disposed in the space on both top and bottom sides of the first boss 411.

The display part 8 is connected to a wire 822. The wire 822 may be configured as a power line to supply power to the display part, or may be configured as a communication line to allow the display part 8 to communicate with devices inside the cabinet, including the first circuit board 4.

The first boss 411 may be provided with a first boss through-hole 413, and the panel support 12 may be provided with a wire passing hole 123 (see FIG. 4). In this case, the wire 822 may extend into the cabinet 1 as it is inserted into the first boss through-hole 413 and the wire passing hole 123.

The first circuit board 4 may further include a first input unit 46 and a second input unit 47. The first input unit 46 may be configured to input a control instruction requesting power supply to the laundry treatment apparatus 100, and the second input unit 47 may be configured to input an instruction requesting execution of the control instruction indicated on the display part 8, or an instruction requesting temporary suspension of the control instruction being executed by the laundry treatment apparatus 100.

The first input unit 46 and the second input unit 47 may be configured to generate a control signal by sensing static electricity of the user's body.

The first input unit 46 may include a first button 461 exposed to the outside of the cabinet 1, a first sensor 464 fixed to the first circuit board 4, and a conductor (first button conductor) 463 connecting the first button and the first sensor. Similarly, the second input unit 47 may include a second button 471 exposed to the outside of the cabinet 1, a second sensing sensor 474 fixed to the first circuit board 4, and a conductor (second touch spring) (not shown) connecting the second button and the second sensing sensor.

As shown in FIG. 3, the mounting panel 13 may include a first button mounting portion 136 and a second button mounting portion 137. The first button 461 may be exposed to the outside of the cabinet 1 through the first button mounting portion 136, and the second button 471 may be exposed to the outside of the cabinet 1 through the second button mounting portion 137.

The first input unit 46 and the second input unit 47 may be disposed in the spaces on the left and right sides of the display part 8, respectively, or may be disposed in the spaces on the top and bottom sides of the display part 8, respectively. Alternatively, they may be vertically or horizontally arranged in the space on the left or right side of the display part 8.

As shown in FIG. 21, the first button conductor 463 and the second button conductor may be provided in the form of a coil, in order to provide resilience to the first button 461 and the second button 471. Further, in order to prevent the first button 461 and second button 471 from being separated from the button mounting portions 136 and 137, the first input unit 46 may be provided with a first stopper 462 to limit the range of motion of the first button, and the second input unit 47 may be provided with a second stopper (not shown) to limit the range of motion of the second button.

The encoder 5 is configured to rotatably secure the actuator 7 to the first circuit board 4 and to generate an electrical signal upon rotation of the actuator 7 (or generate an electrical signal set differently according to a rotation angle of the actuator).

Figure 22:
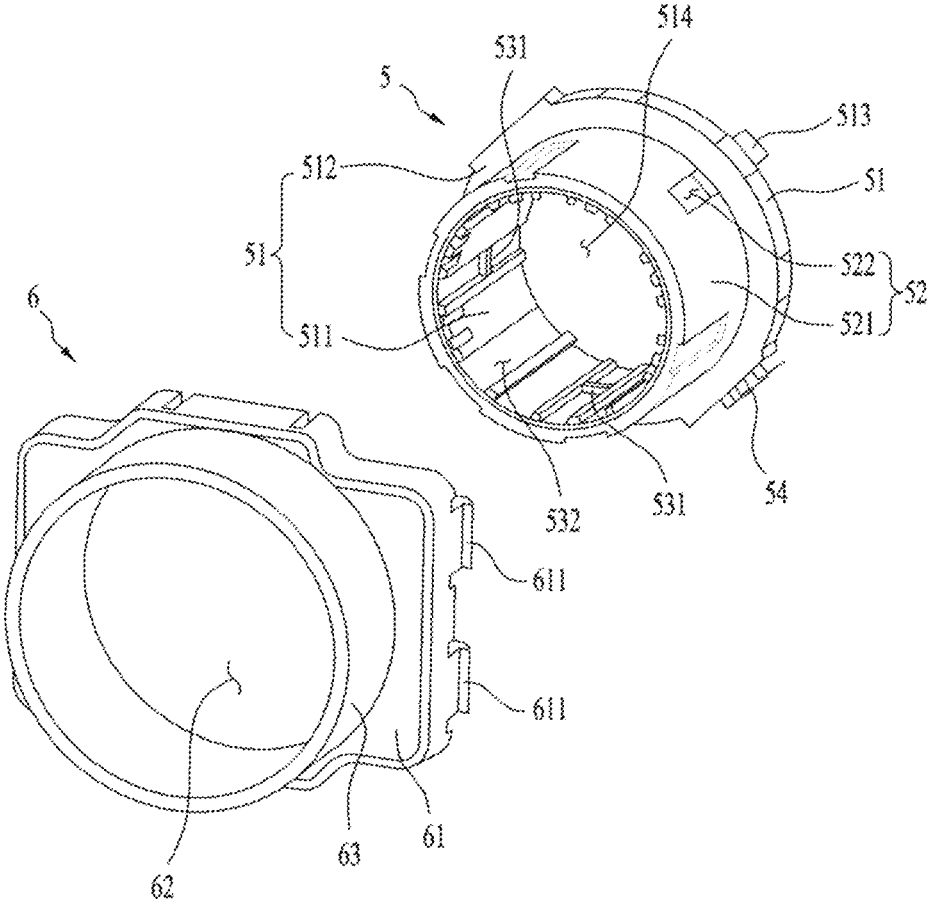
FIGS. 22 and 23 show an example of an encoder and an encoder cover provided in the interface.

As shown in FIG. 22, the encoder 5 may include a fixed part 51 fixed to the first circuit board 4 such that the display part 8 is fixed thereto, a rotary part 52 rotatably arranged on the fixed part 51 with the actuator 7 fixed thereto, and a signal generator 54 configured to generate an electrical signal upon rotation of the rotary part 52.

The fixed part 51 may include a fixed body 512 fixed to the first circuit board 4, a support body 511 extending from the fixed body 512, the rotary part 52 being rotatably fixed to the support body, and a body through-hole 514 formed through the fixed body and the support body and connected to the board through-hole 42 (and connected to the first boss through-hole).

The fixed body 512 may be formed in a cylindrical shape. The circumferential surface of the fixed body 512 or one surface of the fixed body (the surface facing the first circuit board) may be provided with a board fastening portion 513. In this case, the first circuit board 4 may be provided with an encoder fixing hole 44 (see FIG. 21) into which the board fastening portion 513 is inserted.

As shown in FIG. 21, multiple substrate fastening portions 513 and multiple encoder fixing holes 44 may be provided, and the encoder fixing holes 44 may be arranged to surround the board through-hole 42.

As shown in FIG. 22, a fastening body fixing portion 531 and a positioning groove 532 may be provided inside the body through-hole 514. The fastening body fixing portion 531 may fasten the display part 8 to the fixed part 51. The positioning groove 532 may prevent the display part 8 from rotating (to fix the position of the display part) when the display part 8 is inserted into the body through-hole 514.

The fastening body fixing portion 531 may be provided with a protrusion protruding from at least one of the support body 511 and the fixed body 512 toward the center of the body through-hole 514. The figure shows an example case where the fastening body fixing portion 531 is provided on the support body 511.

The positioning groove 532 may be formed by concavely bending one surface of the fixed part 51 having the body through-hole 514. In this case, the positioning groove 532 may be arranged along the longitudinal direction of the body through-hole 514.

The rotary part 52 may include a rotational body 521 rotatably coupled to the support body 511. The rotational body 521 needs to have a rotational body through-hole through which the support body 511 is arranged.

The rotational body 521 may be provided with a shaft fastening portion 522 to which the actuator 7 is fastened. The shaft fastening portion 522 may be a fastening hole formed through the circumferential surface of the rotational body 521, or may be a fastening groove formed by concavely bending the circumferential surface of the rotational body 521.

The signal generator 54 may include a magnet fixed to the rotational body 521, a sensor arranged on the fixed body 512 or the support body 511 to sense magnetic force, and a terminal connecting the sensor and the first circuit board 4. The magnet may include a plurality of permanent magnets spaced apart along the circumferential surface of the rotational body 521.

Figure 23:
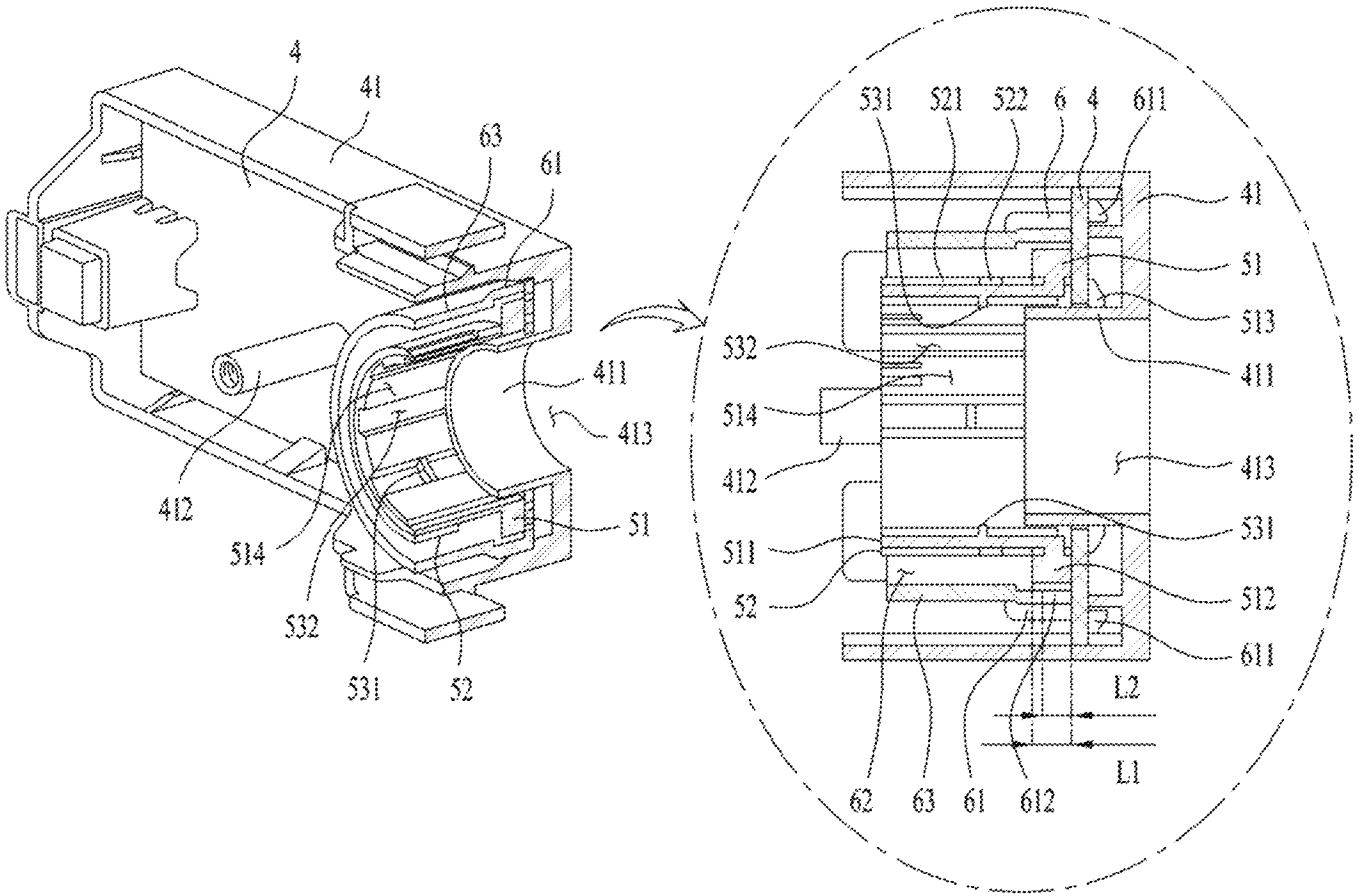

As shown in FIG. 23, the first circuit board 4 to which the encoder 5 is connected may be coated with an insulating material. The coating is intended to minimize the possibility that water is supplied to the first circuit board 4 to cause short circuiting. To prevent the rotational body 521 from being fixed to the support body 511 by the insulating material when the insulating material is applied onto one surface (the surface facing the mounting panel) of the first circuit board 4, the interface P may further include an encoder cover 6.

The encoder cover 6 may be fixed to the first circuit board 4 and formed in a pipe shape to surround the encoder 5. That is, as shown in the figure, the encoder cover 6 may may include a fixed body cover 61 fixed to the first circuit board 4 and arranged to surround the fixed body 512, and a cover through-hole 62 formed through the fixed body cover 61 to receive the encoder 5 inserted thereinto.

The fixed body cover 61 may be provided with a board fastening portion 611, and the first circuit board 4 may be provided with an encoder cover fixing hole 45, to which the board fastening portion 611 is fixed. Multiple board fastening portions 611 and multiple encoder cover fixing holes 45 may be provided, and the encoder cover fixing holes 45 may be arranged to surround the board fastening portion 513.

In order to discharge water introduced into the fixed body cover 61, a cover outlet 612 may be further provided on the circumferential surface of the fixed body cover 61. The cover outlet 612 is preferably disposed at the lowermost end of the circumferential surface of the fixed body cover 61.

The above-described insulating material is applied to the first circuit board 4 after both the encoder 5 and the encoder cover 6 are coupled to the first circuit board 4. The insulating material sprayed onto a partial region of the first circuit board 4 (the space outside the encoder cover) is introduced into the encoder cover 6 through the cover outlet 612. In this process, the distance L1 from the first circuit board to the top of the fixed body 512 may be set to be greater than or equal to the distance L2 from the first circuit board to the top of the cover outlet 612 such that the insulating material is blocked from being supplied to the rotational body 521.

The encoder cover 6 may further include a support body cover 63 extending from the fixed body cover 61 to surround the rotational body 521 (to surround the support body). The support body cover 63 may restrict movement of the actuator 7 in the radial direction of the cover through-hole 62. Accordingly, the support body cover 63 may prevent the actuator 7 from being separated from the rotational body 521.

Figure 24:
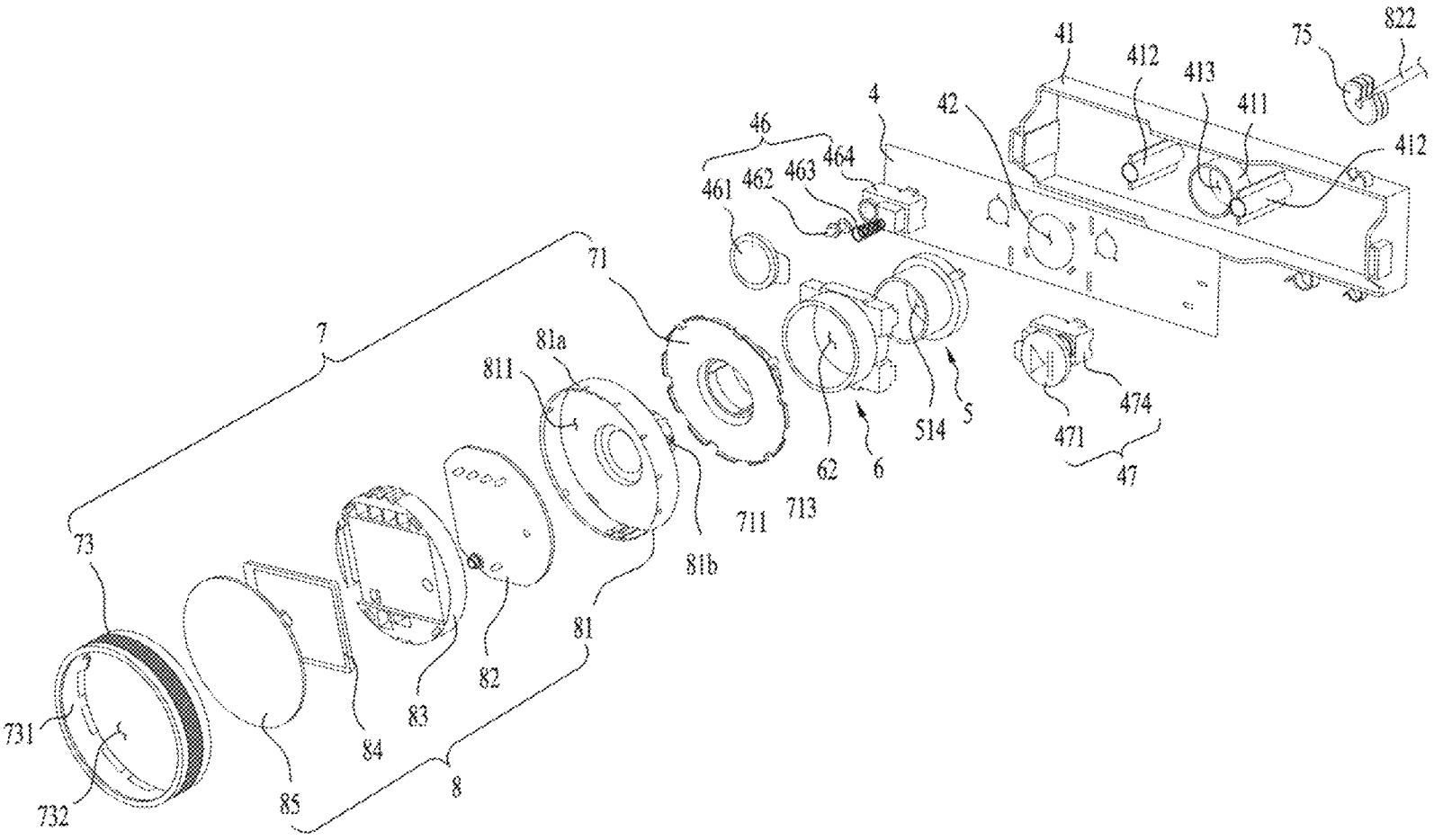
FIG. 24 shows an example of an actuator and indicator provided in the interface.

As shown in FIG. 24, the actuator 7 may include a shaft 71 extending through the mounting panel 13 and fixed to the rotational body 521, and a handle 73 fixed to the shaft 71 and positioned outside the cabinet 1.

The cabinet 1 is provided with the panel through-hole 134 (see FIG. 3) formed through the mounting panel 13, and the shaft 71 may be inserted into the panel through-hole 134.

Figure 25:
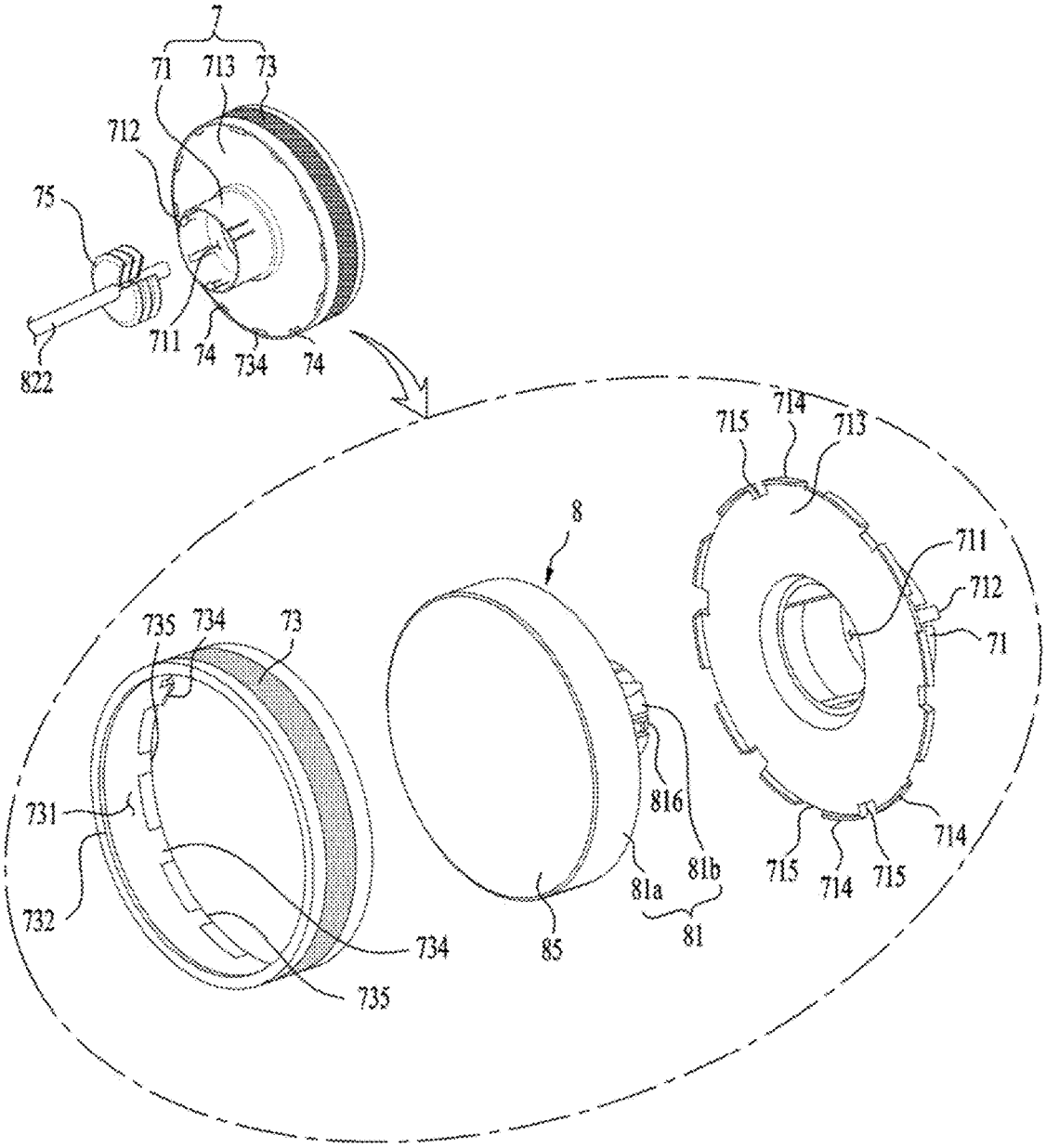
FIGS. 25 and 26 show a structure of the actuator.

As shown in FIG. 25, the shaft 71 may be provided as a pipe with a shaft through-hole 711 formed therein. The rotational body 521 provided in the encoder is inserted into the shaft through-hole 711, and the rotational body fastening portion 712 provided on the circumferential surface of the shaft 71 and disposed inside the shaft through-hole 711 is coupled to the shaft fastening portion 522 provided on the rotational body. Accordingly, the shaft 71 is fixed to the rotational body 521 by the rotational body fastening portion 712 and the shaft fastening portion 522.

The handle 73 is fixed to the shaft 71 so as to be disposed outside the cabinet 1, and the user may apply the force for rotation of the rotational body 521 to the shaft 71 using the handle 73.

The handle 73 may include an accommodation space 731 formed in the handle to communicate with the shaft through-hole 711, and a handle through-hole 732 formed through one surface of the handle 73 to allow the accommodation space 731 to communicate with the outside.

When the diameter of the handle 73 is set to be greater than the diameter of the shaft 71, the shaft 71 may further include a base 713 to which the handle 73 is fixed. The base 713 may be configured as a disk fixed to the circumferential surface of the shaft 71.

The handle 73 and the base 713 may be coupled to each other by a base fastening portion 734 provided on the handle 73 and a handle fastening portion 714 provided on the base 713.

Figure 26:
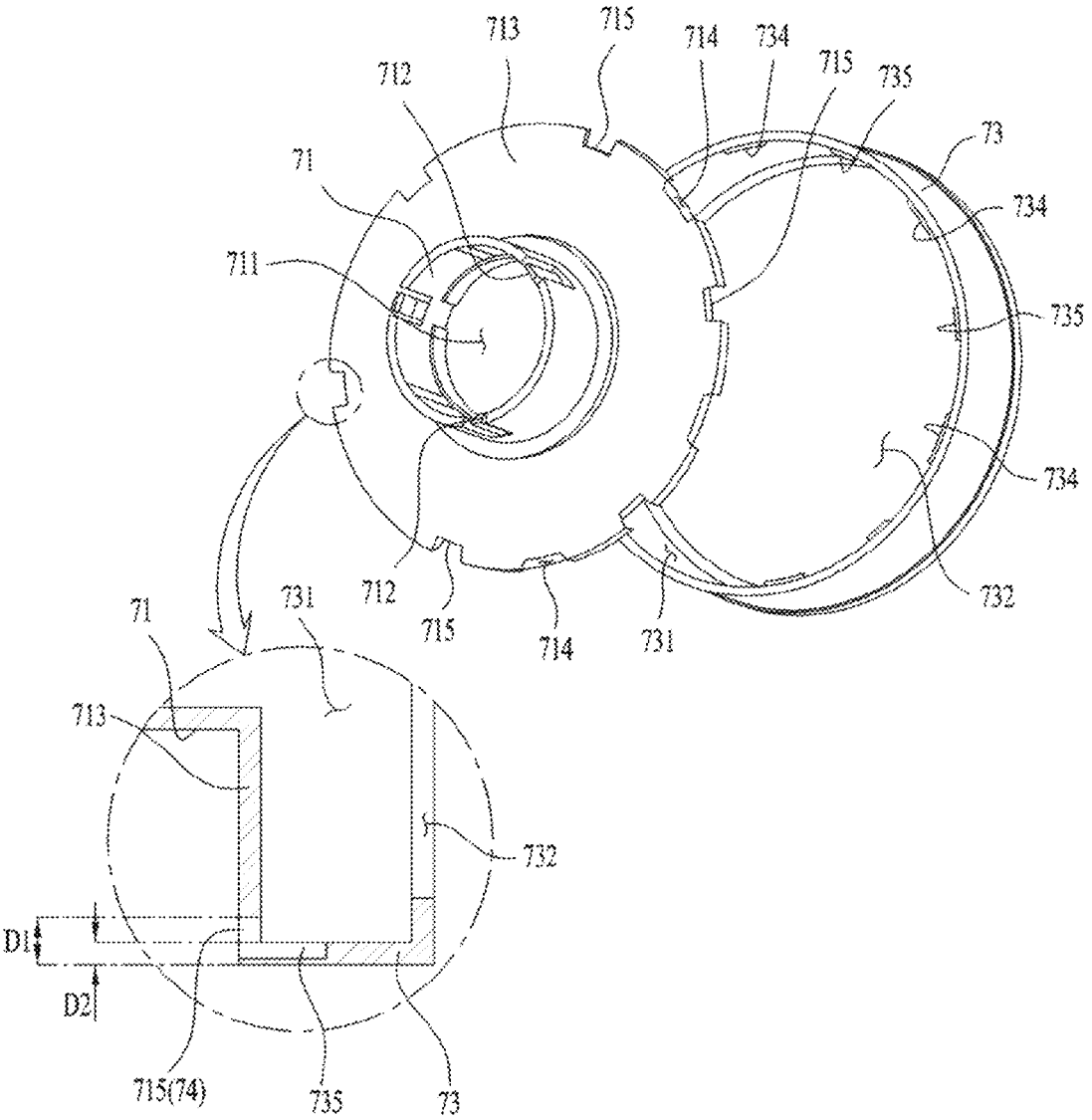

As shown in FIG. 26, the base fastening portion 734 may be provided with multiple protrusions fixed to the handle so as to be positioned in the accommodation space 731, and the handle fastening portion 714 may be configured as a groove provided on the base 713 to accommodate the protrusions.

In order to facilitate coupling of the handle 73 and the base 713, the handle 73 may have a fastening guide 735 disposed between one base fastening portion 734 and another base fastening portion 734, and the base 713 may have a guide groove 715 into which the fastening guide 735 is inserted. The guide groove 715 may be provided by bending the circumferential surface of the base 713 toward the shaft through-hole 711.

A handle outlet 74 may be further provided in either the handle 73 or the base 713 to discharge water or foreign substances introduced into the handle 73 from the handle 73. As shown in FIG. 26, the depth D1 of the guide groove 715 (the length from the edge of the base to the bottom surface of the guide groove) may be set to be greater than the height D2 of the fastening guide 735 (the length from the handle to the free end of the fastening guide). In this case, the handle outlet 74 may be set as a space defined between the guide groove 715 and the fastening guide 735.

Figure 27:
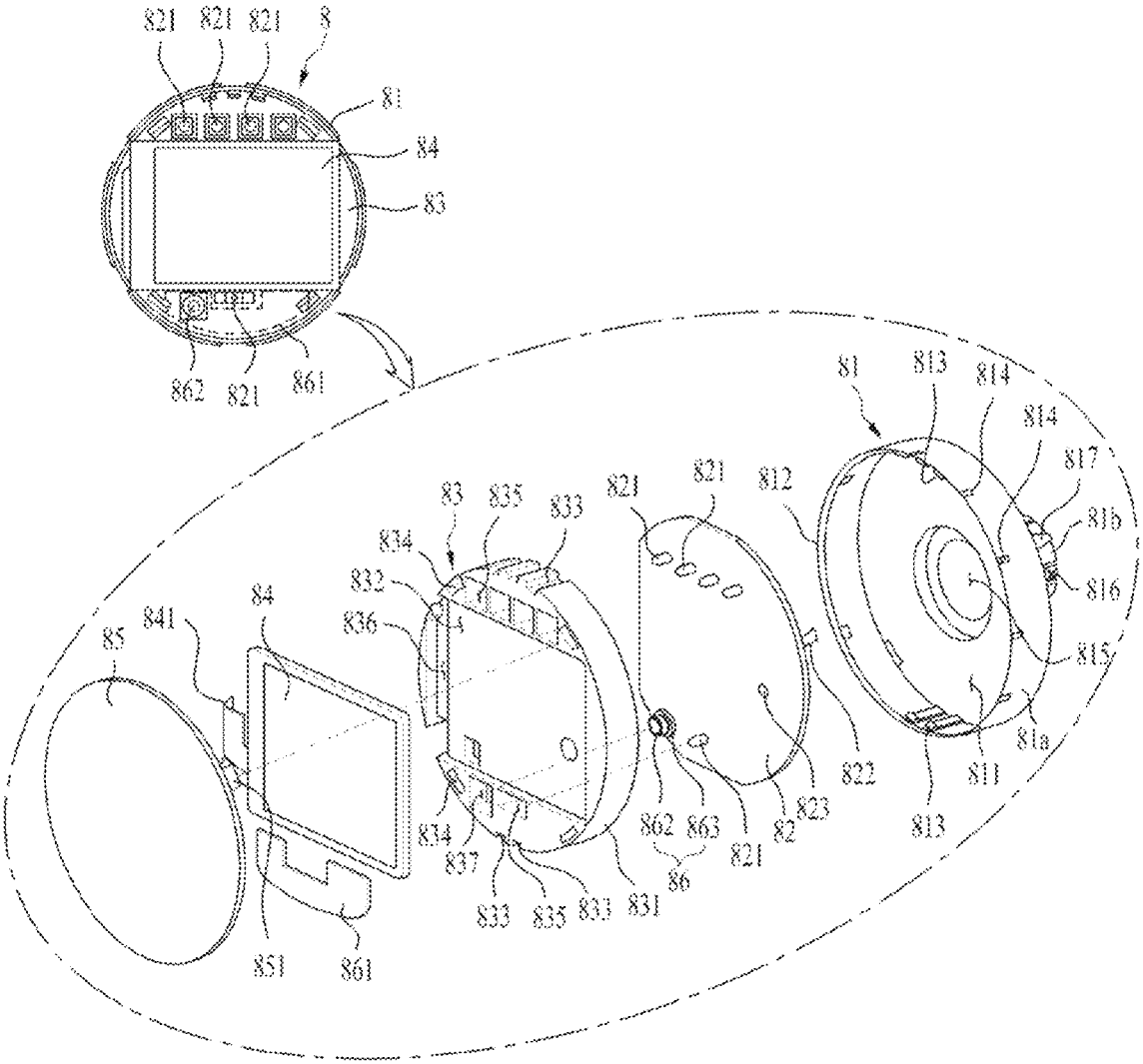
FIGS. 27 and 28 show a structure of the indicator.

FIG. 27 shows an example of the display part 8. The display part 8 may include a housing 81 fixed to the fixed body 512 of the encoder and positioned inside the accommodation space 731 of the actuator, a display 84 fixed to the housing and configured to display information (information related to the control, operation or the like of the laundry treatment apparatus), and a circuit board (second circuit board or display circuit board) 82 arranged in the housing and provided with a circuit to control the display 84.

The housing 81 may include a fastening body 81*b* inserted into the body through-hole 514 through the shaft through-hole 711 and fixed to the fixed body 512, and an accommodation body 81*a* fixed to the fastening body 81*b* and positioned in the accommodation space 731.

The accommodation body 81*a* may be formed in any shape as long as it can be inserted into the accommodation space 731. FIG. 19 shows an example of the accommodation body 81*a* having a cylindrical shape.

A mounting space 811 is formed in the accommodation body 81*a*. The mounting space 811 communicates with the accommodation space 731 provided in the handle through an accommodation body through-hole 812 (wherein the accommodation body through-hole communicates with the handle through-hole). That is, the accommodation body through-hole 812 is provided on a side facing the position of the handle through-hole 732 in the space provided by the accommodation body 81*a*.

Figure 28:
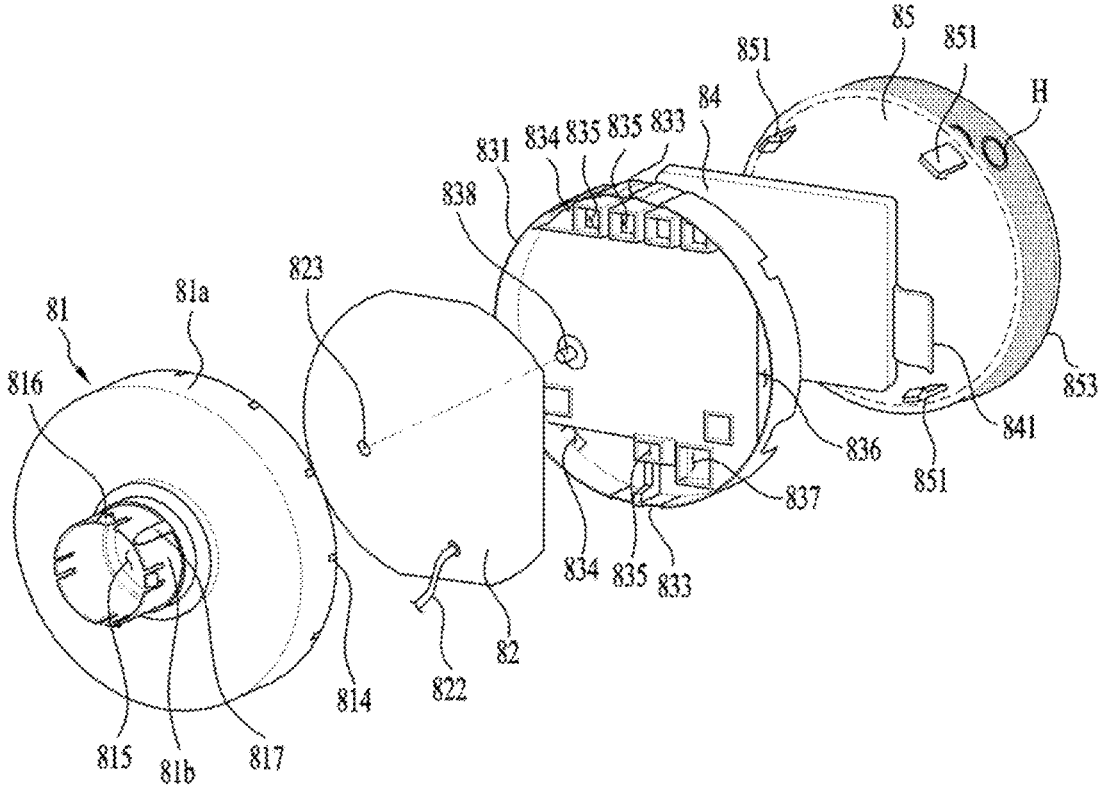

The fastening body 81*b* may be formed in any shape as long as it can be inserted into the shaft through-hole 711 and the encoder body through-hole 514. FIG. 28 shows an example of the fastening body 81*b* having a cylindrical shape. The fastening body 81*b* is provided with a fastening body through-hole 815 connected to the mounting space 811.

The circumferential surface of the fastening body 81*b* may be provided with a fixed body fastening portion 816. The fixed body fastening portion 816 serves to fix the housing 81 to the fastening body fixing portion provided in the encoder.

Further, the circumferential surface of the fastening body 81*b* may be further provided with multiple positioning protrusions 817.

The positioning protrusions 817 may have a shape insertable into the positioning grooves 532 provided in the encoder, and the positioning protrusions 817 are arranged at positions corresponding to the positions of the positioning grooves 532. The positioning protrusions 817 and the positioning grooves 532 serve to minimize the risk that the fastening body 81*b* fails to be coupled to the fastening body fixing portion 531 when the fastening body 81*b* is inserted into the body through-hole 514 (to ensure coupling of the fixed body fastening portion with the fastening body fixing portion).

As shown in FIG. 27, the second circuit board 82 is inserted into the mounting space 811, and a wire 822 connected to the second circuit board 82 is withdrawable out of the housing 81 through the fastening body through-hole 815. The second circuit board 82 may be provided with multiple lamps 821.

The second circuit board 82 may control the display 84 to display preset information according to electrical signals generated by the signal generator 54 when the handle 73 is rotated.

To maintain the spacing between the second circuit board 82 and the display 84 and to prevent damage to the lamps 821, a mounting part 83 positioned between the display 84 and the second circuit board 82 may be provided in the mounting space 811.

The mounting part 83 may include a mounting body 831 fixed to the accommodation body 81*a* and positioned inside the mounting space 811. The mounting body 831 may be formed in any shape as long as it can be inserted into the mounting space 811. FIG. 27 shows an example of the mounting body 831 formed in a roughly cylindrical shape.

One surface of the mounting body 831 is provided with a seating groove 832 to which the display 84 is fixed. The seating groove 832 may be provided with a connector through-hole 836. A connector (a flexible PCB or the like) 841 provided on the display 84 may be inserted into the connector through-hole 836 and connected to the second circuit board 82.

The mounting body 831 may be provided with lamp through-holes 835 into which the lamps 821 are inserted.

The number of the lamp through-holes 835 provided may be the same as the number of the lamps 821, and the positions of the lamp through-holes 835 should be set in a space of the mounting body positioned above the seating groove 832, or a space of the mounting body positioned below the seating groove 832. This is intended to ensure that light emitted from the lamps 821 is transmitted to the outside of the housing 81 through the lamp through-holes 835.

The mounting part 83 is fixed to the housing 81 by a mounting body fastening portion 813 provided on the accommodation body 81*a* and an accommodation body fastening portion 833 provided on the mounting body 831. The mounting body fastening portion 813 may include multiple protrusions disposed inside the mounting space 811, and the accommodation body fastening portion 833 may include a groove provided on the circumferential surface of the mounting body 831 (one surface of the mounting body that contacts the accommodation body) such that the mounting body fastening portion 813 is fixed thereto.

The number of the mounting body fastening portions 813 may be the same as the number of the accommodation body fastening portions 833, and the positions of the mounting body fastening portions 813 and the accommodation body fastening portions 833 may correspond to each other.

In order to enhance the fastening of the mounting body 831, the accommodation body fastening portion 833 may be provided with an upper fastening portion arranged at a higher position than the seating groove 832 and a lower fastening portion arranged at a lower position than the seating groove 832. Unlike the example shown in the figure, the accommodation body fastening portion 833 may be provided on the left and right sides of the accommodation groove.

To prevent water and foreign substances from being introduced into the display 84 and the second circuit board 82, the accommodation body 81*a* may be further provided with a cover 85.

The cover 85 may be fixed to at least one of the accommodation body 81*a* and the mounting body 831, and be arranged to close the accommodation body through-hole 812. The cover 85 may include a material having transparency that allows the information displayed on the display 84 and the light emitted by the lamps 821 to be visible from the outside.

When the cover 85 is configured to be fixed to the mounting body 831, the cover 85 may include cover fixing protrusions 851 that protrude toward the mounting body 831, and the mounting body 831 may include fixing protrusion fastening portions 834 to which the cover fixing protrusions 851 are fastened.

As shown in FIG. 28, the second circuit board 82 may also be fixed to the mounting body 831. That is, the mounting part 83 may be provided with a protrusion 838 protruding from the mounting body 831 toward the second circuit board 82, and the second circuit board 82 may be provided with a protrusion through-hole 823 into which the protrusion 838 is inserted.

The cover 85 may further include a coversheet 853 that reduces the transparency of the cover. The transparency of the coversheet may be set to make it difficult to see the interior of the mounting space 811 from the outside (the transparency of the coversheet may be set lower than the transparency of the cover). The coversheet 853 may be fixed to the surface of the cover 85, and a letter or symbol H may be provided in the area of the coversheet through which the lamp through-holes 835 are projected.

As shown in FIG. 27, the interface P may further include a selector 86 configured to receive a control instruction input to select a control instruction displayed on the display 84.

The selector 86 may be configured to sense whether the user's body is in contact with the cover 85 to determine whether the control instruction displayed on the display 84 is selected by.

That is, the selector 86 may include a sensor 863 provided on the second circuit board 82 to sense static electricity on the user's body, and conductors 861 and 862 connecting the sensor 863 to the cover 85. The conductors 861 and 862 may include a first conductor 861 fixed to the cover 85, and a second conductor 862 connected at one end to the first conductor 861 and at the opposite end to the sensor 863. In this case, the mounting body 831 may be provided with a conductor through-hole 837 into which the second conductor 862 is inserted.

The first conductor 861 is a means to expand the area available for user contact facilitate the input of control instructions. In the interface P with the above-described structure, a display region R1 is formed in the upper space of the cover 85 and an input region R2 is formed in the lower space of the cover 85, as shown in FIG. 1. Thus, by setting the area of the first conductor 861 to be wide, the area of the input region R2 may expanded, and accordingly the user may be allowed more easily input control instructions. The area of the first conductor 861 may be set to ¼ to ½ of the area of the cover 85.

The interface P with the above-described structure may enable display of control instructions, search of displayed control instructions, and selection of a displayed control instruction, and minimize the space required for installation. However, the interface P with the above-described structure requires a means to prevent water or foreign substances from being introduced into the display part 8 and the actuator 7, or to discharge the water or foreign substances to the outside.

Figure 29:
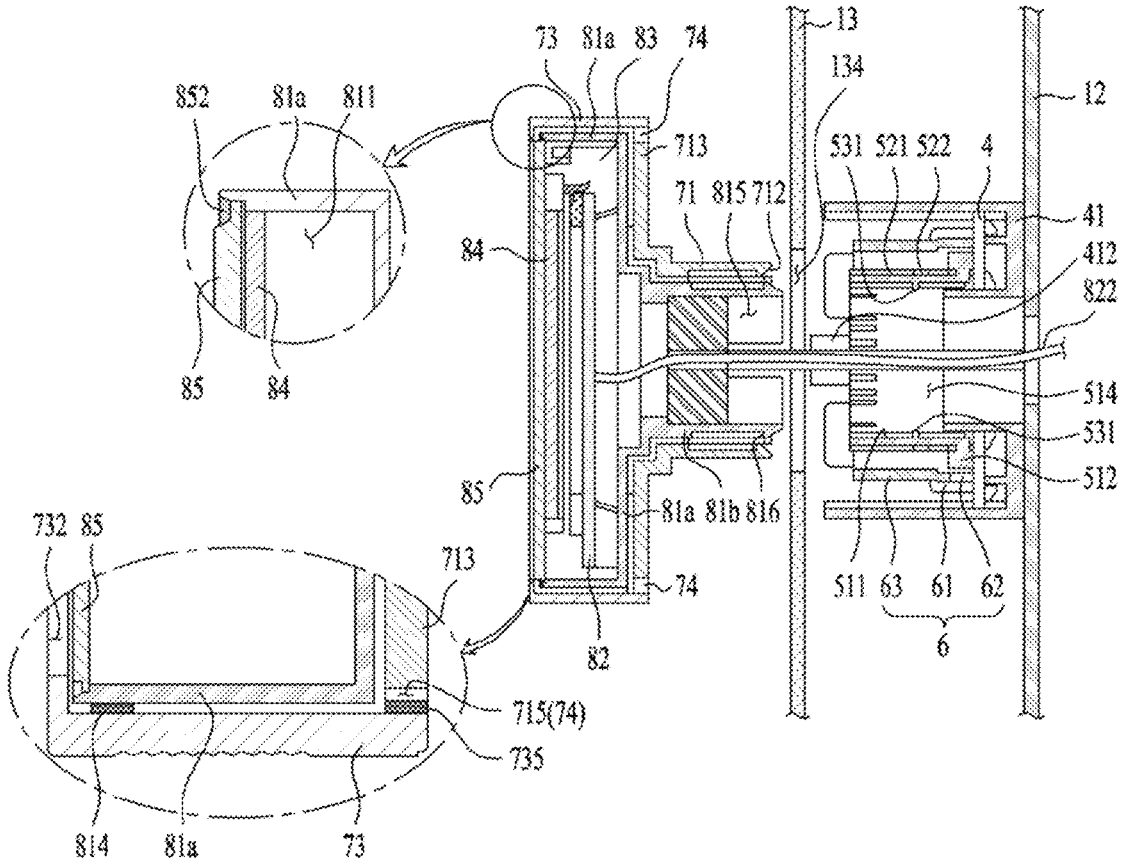
FIG. 29 shows an example of an assembly structure of the interface.

As shown in FIG. 29, the actuator 7 include a means to discharge water or foreign substances introduced into the handle through-hole 732 to the outside of the accommodation space 731, and the display part 8 may include a means to block water or foreign substances from being introduced into the housing 81.

As previously described, the actuator 7 is capable of discharging water or foreign substances introduced into the accommodation space 731 to the outside of the accommodation space through the handle outlet 74 provided in the handle.

The display part 8 may include a sealing portion (or fastening body sealing portion) 75, which prevents foreign substances from being introduced into the fastening body through-hole 815, and a cover sealing portion 852, which seals the space between the cover 85 and the accommodation body through-hole 812.

The cover sealing portion 852 may include an adhesive material that is sprayed onto the accommodation body 81*a* along the edge of the cover 85 to fill the space between the cover 85 and the accommodation body 81*a* and fix the cover 85 to the accommodation body 81*a*.

The sealing portion 75 may be inserted into the fastening body through-hole 815 to fix the position of the wire 822 and to block foreign substances such as water from being introduced into the fastening body through-hole 815.

Figure 30:
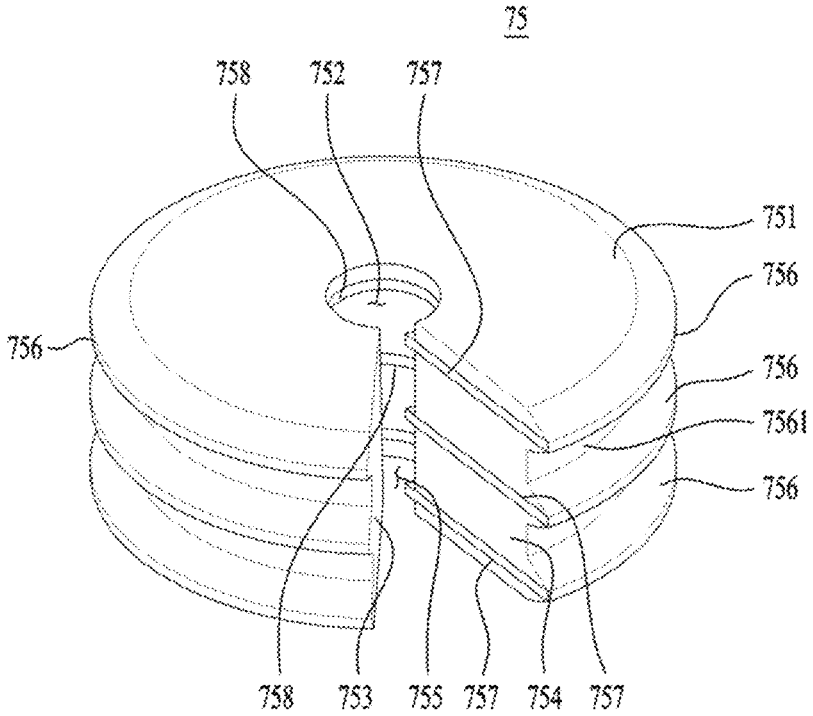
FIG. 30 shows an example of a sealing portion provided to the actuator.

FIG. 30 shows an example of the sealing portion 75. The sealing portion 75 of FIG. 30 includes a sealing body 751 inserted into the fastening body through-hole 815, a sealing body through-hole 752 formed through the sealing body 751 to allow the wire 822 to be inserted thereinto, and cut-open portion 753, 754, and 755 formed by cutting away a circumferential surface of the sealing body 751 to connect the circumferential surface of the sealing body 751 to the sealing body through-hole 752.

The sealing body 751 may be formed in any shape as long as it can be inserted into the fastening body through-hole 815. FIG. 30 shows an example of the sealing body 751 formed in a cylindrical shape.

The diameter of the sealing body 751 may be set to be greater than the diameter of the fastening body through-hole 815. In this case, the material of the sealing body 751 may be rubber, silicone or the like having a relatively large resilience such that the fastening body through-hole 815 may be closed through press-fitting.

The cut-open portion may include a first cut-open surface 753 extending from a circumferential surface of the sealing body 751 toward the center of the sealing body through-hole 752, a second cut-open surface 754 extending from the circumferential surface of the sealing body 751 toward the center of the sealing body through-hole 752 and spaced apart from the first cut-open surface 753, and an cut-open groove 755 formed between the first cut-open surface 753 and the second cut-open surface 754. The wire 822 may be inserted into or withdrawn from the sealing body through-hole 752 via the an cut-open groove 755.

The spacing between the first and second cut-open surfaces 753 and 754 may be sett to a length allowing the two cut-open surfaces 753 and 754 to contact each other to close the cut-open groove 755 when the sealing body 751 is inserted into the fastening body through-hole 815.

In order to more reliably prevent foreign substances from being introduced into the space formed between the circumferential surface of the sealing body 751 and the fastening body through-hole 815, the circumferential surface of the sealing body 751 may be further provided with a first contact protrusion 756.

The first contact protrusion 756 may include a band-shaped protrusion extending from the first cut-open surface 753 to the second cut-open surface 754 along the circumferential surface of the sealing body 751. The first contact protrusion 756 may include multiple band-shaped protrusions arranged spaced apart from each other along the height direction of the sealing body 751.

The sealing body 751 may be further provided with a second contact protrusion 757 to prevent foreign substances from being introduced into the cut-open groove 755. The second contact protrusion 757 may protrude from at least one of the first cut-open surface 753 and the second cut-open surface 754 toward the other one.

Further, the second contact protrusion 757 may connect the first contact protrusion 756 to the sealing body through-hole 752, or connect the sealing body through-hole 752 to a point 7561 positioned between two first contact protrusions 756.

To prevent foreign substances from being introduced into the space between the wire 822 and the sealing body through-hole 752, the sealing body through-hole 752 may be provided with a third contact protrusion 758. This is because even when the diameter of the sealing body through-hole 752 (the diameter formed when the sealing body is inserted into the fastening body through-hole) is set smaller than the diameter of the wire 822, the possibility of foreign substances entering through the sealing body through-hole 752 cannot be excluded.

The third contact protrusion 758 may include a band-shaped protrusion that protrudes from a side of the sealing body 751 defining the sealing body through-hole 752 toward the center of the sealing body through-hole 7552. The third contact protrusion 758 may extend from the first cut-open surface 753 to the second cut-open surface 754 and be connected to the second contact protrusion 757.

Hereinafter, the assembly process for the interface P described above will be described with reference to FIG. 29.

The first circuit board 4 is fixed to the case 41 with the encoder 5 and the encoder cover 6 coupled thereto. The surface of the first circuit board 4 fixed to the case 41 has an insulating material applied thereto.

The case 41 may be fixed to the cabinet 1 through the mounting panel 13, or may be fixed to the cabinet 1 through the panel support 12. When the case 41 is fixed to the mounting panel 13, the case 41 may be fixed to the mounting panel 13 by a bolt that is fixed to the second boss 412 through the mounting panel 13, and the mounting panel 13 may be fixed to the panel support 12 by a bolt or the like.

When the shaft 71 of the actuator 7 is inserted into the panel through-hole 134 provided in the mounting panel after the mounting panel 13 is fixed to the panel support 12, the shaft 71 may be fixed to the rotational body 521 of the encoder, and the fastening body 81*b* of the display part may be fixed to the support body 511 of the encoder.

That is, when the shaft 71 is inserted into the panel through-hole 134, the rotational body fastening portion 712 provided on the shaft is fixed to the shaft fastening portion 522 provided on the rotational body, and the fixed body fastening portion 816 provided on the fastening body 81*b* is fixed to the fastening body fixing portion 531 provided in the body through-hole 514. Accordingly, the actuator 7 is rotatably fixed to the first circuit board 4 by the rotational body 521, and the display part 8 is fixed to the first circuit board 4 by the support body 511.

In this case, the wire 822 withdrawn to the outside through the fastening body through-hole 815 may be inserted into the cabinet 1 through the body through-hole 514 provided in the encoder, the first boss through-hole 413 provided in the case, and the wire passing hole 123 provided in the panel support.

The interface P with the structure described above will display preset control instructions (search and change control instructions) on the display 84 whenever the user turns the handle 73 (whenever the encoder generates an electrical signal).

When a desired control instruction is displayed on the display 84, the user may select the displayed control instruction using the selector 86, and the control instruction selected using the selector 86 may be initiated when the user inputs an execution instruction through the second input unit 47.

Since the handle 73 is rotatably coupled to the first circuit board 4, while the housing 81 of the display part is fixed to the first circuit board 4, it is necessary to keep the distance between the handle 73 and the housing 81 constant. This is because if the distance between the handle 73 and the housing 81 is not kept constant, the rotation of the handle 73 may be constrained.

In order to keep the distance between the handle 73 and the housing 81 constant, at least one of the circumferential surface of the accommodation body 81*a* or the accommodation space 731 provided in the handle may be further provided with a spacer.

FIG. 27 shows one example of the spacer. The spacer 814 in FIG. 27 is a protrusion protruding from the circumferential surface of the accommodation body 81*a* toward the circumferential surface of the handle 73. The spacer 814 may include multiple protrusions equally spaced apart from each other along the circumferential surface of the accommodation body 81*a*. As shown in the figure, the spacer may include a protrusion protruding from the circumferential face of the handle 73 toward the circumferential surface of the accommodation body 81*a*.

The above-described structure, control method, and assembly method of the interface and laundry treatment apparatus are merely intended to illustrate an example of the interface and laundry treatment apparatus, and the scope of the present disclosure is not limited to the above-described embodiments.

The invention claimed is:

1. A laundry treatment apparatus comprising:

a cabinet comprising a mounting panel, the mounting panel defining a panel inlet and a panel installation hole;

a drum rotatably disposed inside the cabinet and configured to receive laundry, the drum defining a drum inlet that faces the panel inlet;

a control circuit board disposed inside the cabinet; and a window comprising:

a window body disposed in the panel installation hole, a film sensor disposed at the window body and configured to sense whether a user contacts the window body, a film wire that connects the film sensor to the control circuit board, and a window guide that protrudes from the window body toward the control circuit board and blocks the film wire from contacting the mounting panel.

2. The laundry treatment apparatus of claim 1, wherein the window guide is disposed between the film wire and the mounting panel.

3. The laundry treatment apparatus of claim 2, wherein the mounting panel comprises:

a coupling rib that extends from an edge of the panel installation hole toward the control circuit board and supports the window body, and wherein the window guide overlaps with the coupling rib along a height direction of the cabinet.

4. The laundry treatment apparatus of claim 3, wherein the window guide is disposed between the coupling rib and the film wire.

5. The laundry treatment apparatus of claim 3, wherein the window further comprises:

a window coupling portion that extends from the window body toward the control circuit board and couples the window body to the coupling rib, and wherein an extension length of the window guide toward the circuit board is less than or equal to an extension length of the window coupling portion toward the circuit board.

6. The laundry treatment apparatus of claim 3, wherein an end of the window guide is disposed farther from the control circuit board than an end of the coupling rib.

7. The laundry treatment apparatus of claim 3, wherein the window guide is spaced apart from the coupling rib.

8. The laundry treatment apparatus of claim 7, wherein a distance between the window guide and the coupling rib increases as the window body extends toward the control circuit board.

9. The laundry treatment apparatus of claim 3, wherein the window guide has a surface that faces the coupling rib, that is inclined upward with respect to the coupling rib, and that extends toward the control circuit board.

10. The laundry treatment apparatus of claim 1, wherein the window further comprises:

an outer extension that extends from an edge of the window body and is disposed outside the cabinet; and an inner extension that extends from the edge of the window body and is disposed inside the cabinet.

11. The laundry treatment apparatus of claim 10, wherein the inner extension extends upward from a top surface of the window body, and wherein the window guide protrudes toward the control circuit board from a surface of the window body facing the control circuit board.

12. The laundry treatment apparatus of claim 11, wherein the window guide is disposed at a lower side the window body.

13. The laundry treatment apparatus of claim 1, further comprising a board support, the board support comprising:

an installation body disposed between the window body and the control circuit board; and a wire passage that accommodates the film wire connected to the control circuit board, the wire passage extending through the installation body.

14. The laundry treatment apparatus of claim 13, wherein the window guide protrudes from a surface of the window body toward the wire passage.

15. The laundry treatment apparatus of claim 1, wherein the film sensor is fixed to a surface of the window body facing the control circuit board.

16. The laundry treatment apparatus of claim 1, wherein the mounting panel further defines a panel through-hole that passes through the mounting panel, and wherein the laundry treatment apparatus further comprises:

a first circuit board disposed inside the cabinet; and an encoder comprising (i) a fixed part fixed to the first circuit board, (ii) a rotary part rotatably coupled to the fixed part, and (iii) a signal generator configured to generate an electrical signal based on rotation of the rotary part.

17. The laundry treatment apparatus of claim 16, further comprising an actuator, the actuator comprising:

a shaft inserted into the panel through-hole and coupled to the rotary part, the shaft defining a shaft through-hole that passes through the shaft and receives the rotary part; and a handle fixed to the shaft and positioned outside the cabinet, the handle being configured to receive force for rotating the shaft, the handle having:

an accommodation space that is defined inside the handle and in fluid communication with the shaft through-hole, and a handle through-hole that passes through a surface of the handle and fluidly connects the accommodation space with an outside of the handle.

18. The laundry treatment apparatus of claim 17, further comprising a display part, the display part comprising:

a fastening body inserted into the shaft through-hole and fixed to the fixed part;

an accommodation body fixed to the fastening body and disposed inside the accommodation space; and a display that is fixed to the accommodation body and faces the handle through-hole, the display being configured to display information.

19. The laundry treatment apparatus of claim 18, wherein the display is configured to display preset information based on the electrical signal generated by the signal generator.

20. The laundry treatment apparatus of claim 18, wherein the actuator is disposed at the mounting panel and spaced from the window, wherein the handle defines an outer circumferential surface of the actuator, and wherein the display is disposed at a front surface of the actuator and surrounded by the handle.

* * * * *